US006067066A

United States Patent [19]

Kubota et al.

[11] Patent Number: 6,067,066

[45] Date of Patent: May 23, 2000

[54] VOLTAGE OUTPUT CIRCUIT AND IMAGE DISPLAY DEVICE

[75] Inventors: Yasushi Kubota, Sakurai; Osamu Sasaki, Tenri; Hiroshi Yoneda, Ikoma, all of Japan

[73] Assignee: Sharp Kabushiki Kaisha, Osaka, Japan

[21] Appl. No.: 08/712,644

[22] Filed: Sep. 11, 1996

[30] Foreign Application Priority Data

| | | | |
|---|---|---|---|
| Oct. 9, 1995 | [JP] | Japan | 7-261898 |
| Jan. 29, 1996 | [JP] | Japan | 8-013287 |
| Mar. 22, 1996 | [JP] | Japan | 8-066941 |

[51] Int. Cl.[7] ..... G09G 3/20

[52] U.S. Cl. ..... 345/98; 345/100

[58] Field of Search ..... 345/95, 98, 99, 345/100, 210, 211

[56] References Cited

U.S. PATENT DOCUMENTS

| | | | |
|---|---|---|---|
| 4,748,444 | 5/1988 | Arai | 340/784 |
| 5,337,070 | 8/1994 | Kitajima et al. | 345/211 |
| 5,596,349 | 1/1997 | Kobayashi et al. | 345/147 |
| 5,729,246 | 3/1998 | Masuko | 345/98 |
| 5,790,089 | 8/1998 | Ono et al. | 345/94 |
| 5,828,357 | 10/1998 | Tamai et al. | 345/89 |

FOREIGN PATENT DOCUMENTS

| | | |
|---|---|---|
| A-5-035200 | 2/1993 | Japan . |
| 6-314080 | of 1994 | Japan . |
| A-6-175610 | 6/1994 | Japan . |
| 7-50389 | of 1995 | Japan . |

OTHER PUBLICATIONS

TFT–LCDs Using Newly Designed 6–bit Digital Data Drivers, H. Okada et al., SID 93 Digest, 1993, pp. 11–14.

High–Quality TFT–LCD Drive Using Low–Voltage Driver, T. Furuhashi et al., SID 93 Digest, 1993, pp. 15–18.

Low–Power 6–bit Column Drive for AMLCDs, B. Conner et al., SID 94 Digest, 1994, pp. 351–354.

*Primary Examiner*—Richard A. Hjerpe
*Assistant Examiner*—Vanel Frenel

[57] ABSTRACT

A voltage output circuit has decoders, a selecting circuit, a logical circuit and an output circuit in order to select one of plural gradation power source lines for a prescribed period based upon k bits and m bits of an n-bit digital signal. The k bits of the digital signal are converting into $2^k$ decoded signals by one decoder, and another m bits are converted into $2^m$ decoded signals by the other decoder. The selecting circuit generates a signal for selecting one of periods which were obtained by dividing one horizontal scanning period into $2^k$ based upon k-numbered timing signals by using the $2^k$ decoded signals. The logical circuit generates $2^n$ signals composed of combinations of the signals from the selecting circuit and the $2^m$ decoded signals. Moreover, one of the $2^m$ gradation power source lines is selected by an output switch by using the signal from the logical circuit. As a result, in an image display device using a digital signal as an input video signal, a number of gradation power source lines is reduced and the arrangement of driving circuits is simplified without deteriorating display quality. As a result, a cost of the image display device can be lowered.

83 Claims, 64 Drawing Sheets

VOLTAGE OUTPUT CIRCUIT AND IMAGE DISPLAY DEVICE

FIELD OF THE INVENTION

The present invention relates to a voltage output circuit for selecting a voltage of a power source line based upon a digital input signal and taking in the voltage so as to output the voltage, more specifically, a voltage output circuit which is capable of realize multi-gradation display with high definition and an image display device using such a voltage output circuit as a driving circuit for outputting a data signal.

BACKGROUND OF THE INVENTION

Conventionally, various driving method which are applied to an image display device such as a liquid crystal display device have been suggested and put to practical use. What is particularly researched and developed is an active matrix driving method. This method is suitable for graphics display, and is being researched and developed enthusiastically.

As shown in FIG. 52, a liquid crystal display device adopting the active matrix driving method is provided with a picture element array 101, a data signal line driving circuit 102 and a scanning signal line driving circuit 103. The picture element array 101 has a plurality of data signal lines SL and a plurality of scanning signal lines GL which cross one another. A picture element 104 is provided to a portion which is surrounded by the two adjacent data signal lines SL and two adjacent scanning signal lines GL, and the picture elements 104 are arranged over the entire part of the picture element array 101 in a matrix pattern.

The data signal line driving circuit 102 samples an inputted video signal DAT in synchronization with a timing signal such as a clock CKS within one horizontal scanning period and amplifies the sampled signal if necessary so as to write it to each data signa line SL. The signal to be written corresponds to gradation representing a luminance level of an image to be displayed. When the scanning signal line driving circuit 103 successively selects the scanning signal lines GL in synchronization with a timing signal such as a clock CKG per horizontal scanning period, the scanning signal line driving circuit 103 controls an on/off operation of a switching element (for example, thin film transistor), not shown, in the picture element 104. As a result, the video signal (data) written to each data signal line SL is written to each picture element 104, and the written data are retained.

In the conventional active matrix-type liquid crystal display device, the switching element, i.e. a picture element transistor is generally composed of an amorphous silicon thin film formed on a transparent substrate. Moreover, circuits such as the data signal line driving circuit 102 and the scanning signal line driving circuit 103 are composed of IC which is installed from the outside.

On the contrary, in recent years, according to demands for improvement in driving force of the picture element transistor, lowering of mounting cost of a driving IC, reliability in mounting, etc. to accompany the increase in size of a screen, a technique that the picture element array 101 and the driving circuits 102 and 103 are formed monolithically by using a polycrystal silicon thin film is reported. Moreover, in order to attain the further increase in size of a screen and a lower price, an element is tried to be formed by using an polycrystal silicon thin film on a glass substrate at a processing temperature not higher than a distortion point of glass (about 600° C.).

The following describes a method of writing a video signal to the data signal line SL in such a liquid crystal display device. As the driving method of the data signal line SL, there exists an analog method and a digital method.

In the conventional analog-type data signal line driving circuit, as shown in FIG. 53, a shift register 120 is rest in synchronization with a start pulse SPS which is created based upon a horizontal synchronizing signal, etc. contained in an analog video signal DAT. As a result, a sampling signal is successively outputted to gates of analog switches TR in synchronization with a clock CSK having approximately a period obtained by dividing one horizontal scanning period by a number of channels of the data signal lines SL.

A video signal DAT is inputted commonly to sources of the analog switches TR from an video signal source, not shown. The video signal DAT is successively sampled by the analog switches TR and held by hold capacitors C so as to be applied to the data signal lines SL as a gradation signal.

At this time, in the picture elements 104 connected to the scanning signal lines GL selected by the scanning signal line driving circuit 103, the switching element SW is turned on. As a result, the gradation signal applied to the data signal lines SL in the above manner is written to a picture element capacity $C_P$ through the switching element SW. The written gradation signal is held until next sampling time, and thus an image is displayed.

In the analog-type data signal line driving circuit, in order to obtain a display image with high resolution and high definition for display of a high-definition television image and computer image, horizontal resolution should be increased by increasing a number of the data signal lines. However, when a number of the data signal lines is increased, there arises such a problem that defective writing of the gradation signal to the picture element capacity occurs.

For example, in the case of VGA (Video Graphics Array) method, since one horizontal scanning period (1H) is 1/(480×60)≈30 μsec, if horizontal resolution is 640 lines, a period $T_{on1}$ of turning ON the analog switches TR becomes 46 μsec according to the following equation:

$$T_{on1}=30\times10^{-6}/640=46\ (n\ sec)$$

On the contrary, since a time $T_{s1}$ required for writing the gradation signal to the picture element capacity $C_P$ accurately (not less than 99%) is required at least 5 times longer than time constant, if a capacity value of the picture element capacity $C_P$ is 20 pF and conduction resistance of the analog switches TR is 1 kΩ, the time $T_{s1}$ is calculated according to the following equation:

$$T_{s1}=20\times10^{-9}\times1\times10^{3}\times5=100\ (n\ sec)$$

In the above-mentioned data signal line driving circuit, since the period $T_{on1}$ as a sampling period is so short with respect to the time $T_{s1}$ that the gradation signal cannot be written to the picture element capacity $C_P$ accurately.

Meanwhile, in the conventional digital-type data signal line driving circuit, as shown in FIG. 54, when a scanning signal SCAN is inputted, a sampling pulse is outputted from the scanning circuit 105 in time series. The video data DAT are sampled by a sampling circuit 106 in synchronization with the sampling pulse.

After the sampled n-bit digital signal is retained by a latch 107, it is transferred in synchronization with a transfer signal TF in next horizontal scanning period, and it is decoded by a decoder 108. As to a plurality of switching transistors, not shown, composing an output switch 109, their on/off operation is controlled by the decoded signal from the decoder 108. When one of the switching transistors is turned on, one of the $2^n$ gradation power source lines is selected, and the selected gradation power source line is connected to the data signal line SL.

The above data signal line driving circuit can display a $2^n$-gradation image, but since the same number of gradation power source lines as a number of gradations are required, multi-gradation display is limited in a practical use, so 8-gradation or not more than 16-gradation image is usually displayed.

In a data signal line driving circuit shown in FIG. 55, a digital signal sampled by the sampling circuit 106 is divided into m-bit and h-bit. The respective signals are converted into $2^m$-numbered decoded signals and $2^h$-numbered decoded signals through latches 110 and the decoders 111. $2^m$-numbered decoded signals are applied to the output switch 109 in order to select two of $2^m+1$ gradation power source lines. The $2^h$ decoded signals are applied to a medial value generator 112 for generating a medial value of two voltages outputted from the output switch 109.

As to the medial value generator 112, a plurality of resistors are connected in a series between adjacent gradation power source lines, and the medial value generator 112 is a circuit for generating a medial value by dividing of the resistor. For example, such a circuit is suggested in SID '94 DIGEST P. 351–354. Moreover, in the data signal line driving circuit, as to the medial value generator 112, a number of gradation power source lines is decreased to about ⅛ of a number of gradations (9 power source lines for 64-gradation display) by selecting two gradation power source lines by the output switch 109.

In addition, another arrangement for decreasing a number of gradation power source lines is a digital driver using a vibrating voltage as shown in FIG. 56. As suggested in SID '93 DIGEST p. 11–14, this uses a signal which vibrates between two voltages $V_{cc}$ and $V_{ss}$, and according to its duty ratio, a halftone image can be displayed. In example in FIG. 56, voltages $V_1$ through $V_8$ for 8 gradations are outputted according to the two voltages $V_{cc}$ and $V_{ss}$, but if this method is expanded, similarly to the data signal line driving circuit shown in FIG. 55, 64-gradation display becomes possible by using the 9 gradation power source lines.

In addition, another method, as shown in FIG. 57, is a driving method such that by inputting a ramp voltage $V_R$ whose level changes in a range of low level to high level like staircase to one power source line, the voltage of the power source line is taken in at timing (gradation basic signals $F_1$ through $F_n$) corresponding to display data (see Japanese Examined Patent Publication No. 7-50389/1995 (Tokukohei 7-50389)). With this method, theoretically, an image with any number of gradations can be displayed by using only one power source line.

In the case where the aforementioned elements (transistor, resistor, etc.) composed of a polycrystal silicon thin film are produced on a glass substrate, since a grain diameter of silicon crystal becomes large, the grain diameter and the size of the elements becomes approximately the same. Therefore, elements composed of a polycrystal silicon thin film has such a disadvantage that scattering of properties is unavoidable unlike elements formed on a monocrystal silicon substrate.

When the resistance divider of the medial value generator 112 are arranged by using such elements, dispersion occurs in values of the respective resistors. For this reason, in a data signal line driving circuit having the medial value generator 112, it is difficult to obtain a high-accurate medial value, an increase in a number of gradations is limited. For example, in the data signal line driving circuit shown in FIG. 55, when the increase in a number of gradations in a practical use is permitted to 4 times by the resistance divider, the maximum number of gradations to be displayed by combinations of 9 gradation voltages is 32 gradations, so this arrangement is not suitable for high gradation display.

In addition, in the polycrystal silicon thin film transistor, its driving force (mobility of carrier) is dozens times to several hundred times larger than the amorphous silicon thin film transistor. For this reason, in the case where the polycrystal silicon thin film transistor is used as a picture element transistor, if a bus line (data signal line) and the picture element transistor are regarded as a low pass filter, a cut-off frequency of the low pass filter becomes high. Therefore, when a halftone image is displayed according to the aforementioned vibrating signal by using such elements, an integration of the vibrating signal becomes insufficient. As a result, it might be impossible to achieve gradation display.

In addition, as disclosed in Japanese Examined Patent Publication No. 7-50389/1995 (Tokukohei 7-50389), in the driving method using only one power source line to which a ramp voltage is applied, a number of power source lines is one, but a given time for taking-in of a gradation signal is one fraction of a number of gradations for a horizontal scanning period. For this reason, a number of display gradations is actually limited by time constant of a data signal line (particularly a load capacity).

The following details the driving circuit disclosed in Japanese Examined Patent Publication No. 7-50389/1995 (Tokukohei 7-50389) on reference to FIGS. 58 and 59. Here, for convenience of explanation, those members that have the same arrangement and functions as the data signal line driving circuit shown in FIG. 53 are indicated by the same reference numerals. n-bit digital video data DAT are inputted to the driving circuit, and this video data DAT are applied commonly to a plurality of latch cells composing a latch 121. Each latch cell latches the video data DAT in synchronization with a sampling signal from each output terminal of the shift register 120. As a result, the video data DAT are successively stored in each latch cell according to the sampling signal which are successively outputted in a horizontal scanning direction.

The signals respectively stored in the latch cells are outputted to latch cells composing a latch 122. In the latch 122, the data respectively stored in the latch cell of the latch 121 are simultaneously latched in synchronization with a transfer signal TF and retained until next transfer signal TF is inputted. The data stored in the latch 122 are transferred to a comparing circuit 123. An n-bit gradation reference signal GR, which corresponds to the range of off-level to on-level of liquid crystal and changes periodically, is inputted commonly to comparator cells composing the comparing circuit 123.

The above-mentioned respective comparator cells output sampling signals to gates of the corresponding analog switches TR only for a period that the data from the latch 122 coincide with bit signals $GR_1$ through $GR_n$ composing the gradation reference signal GR shown in FIG. 59, namely, for a period $T_{on}$ which is given to one gradation level of the gradation voltage GV. Meanwhile, the gradation voltage GV whose amplitude level changes periodically in synchronization with the gradation reference signal GR is inputted commonly to the sources of the analog switches TR. As a result, a voltage corresponding to luminance level of an analog video signal which is a base of the video data DAT is outputted from the analog switches TR through the hold capacitors C to the data signal lines SL.

As shown in FIG. 59, the gradation voltage GV changes at a step corresponding to $2^n$ gradation for one horizontal scanning period (1H) in the range of the minimum level to the maximum level. Moreover, the gradation voltage GV and the gradation reference signal GR are rest in synchronization with a start pulse SP.

In the above driving circuit, a sampling period $T_{on2}$ of the data signal lines SL becomes $1H/2^n$ according to one horizontal scanning period (1H) and a number of gradations $2^n$. However, since a video signal does not actually exists during all the one horizontal scanning periods, the sampling period $T_{on2}$ becomes shorter.

As mentioned above, when a conduction resistance of the analog switch TR is 1 kΩ and a capacity value of the picture element capacity $C_P$ is 20 pF, a time $T_{s2}$ required for writing the gradation voltage GV to the picture element capacity $C_P$ is 100 n sec which is the same as the time $T_{s1}$. On the contrary, in the case of the VGA mode, since one horizontal scanning period is 30μ sec as mentioned above, when a number of display gradations is 256, the sampling period $T_{on2}$ is calculated according to the following formula:

$$T_{on2}=30\times10^{-6}/256=117\ (n\ sec)$$

As described above, in the above driving circuit, since the sampling period $T_{on2}$ is longer than the time $T_{s2}$, the gradation voltage GV can be written to the picture element capacity $C_P$ accurately, 256-gradation display by the VGA mode can be realized.

In the data signal line driving circuit 102 shown in FIG. 53, a time obtained by dividing one horizontal scanning period by a number of picture elements per one line was the sampling period. On the contrary, in the driving circuit shown in FIG. 58, a time obtained by dividing one horizontal scanning period by a number of gradations was the sampling period, thereby realizing high resolution and high definition.

However, in the case where a number of gradations is such a fairly large value as 512 gradations, since the sampling period $T_{on2}$ is 59 n sec, the sampling period $T_{on2}$ becomes shorter than the time $T_{s2}$. For this reason, in the case of high gradation, the gradation voltage GV cannot be written to the picture element capacity $C_P$ accurately even by the driving circuit shown in FIG. 58.

The following describes mounting of the above driving circuit. As shown in FIG. 60, a driving circuit 131 which is provided as an integrated circuit is mounted on a side of a display section 132 on an insulating substrate (not shown). More concretely, data signal lines SL formed on the insulating substrate and output terminals 133 of the driving circuit 131 are electrically connected one another by soldering through a contact pads 134 provided on the ends of the data signal lines SL.

A width of the contact pad 134 is wider than the data signal lines SL so as to have allowance for displacement of the driving circuit 131. Therefore, wiring intervals of the data signal lines SL should be secured according to the width of the contact pad 134. However, if there exists such a limitation on the wiring intervals, the wiring intervals of the data signal lines SL cannot be made small, so it is difficult to improve resolution.

In order to remove the above defectiveness, a driving circuit 135 shown in FIG. 61 is considered to be used. The driving circuit 135 has output terminals arranged in two different rows alternately. Contact pads 136 provided on the ends of the odd numbered data signal lines $SL_1$, $SL_3$, . . . are arranged on a side which is closer to a display section 132 on the driving circuit 135. Contact pads 137 provided on the ends of the even numbered data signal lines $SL_2$, $SL_4$, . . . are arranged on a side which is farther from the display section 132 on the driving circuit 135.

As shown in FIG. 62 which is enlarged drawing of a J section in FIG. 61, the contact pads 137 have a width $W_1$, and the data signal lines SL have a width $W_2$ which is narrower than $W_1$. Therefore, when the data signal lines SL are arranged respectively between the adjacent contact pads 136, the limitation on the wiring intervals due to the width $W_1$ is eased. As a result, the high resolution can be realized by making the intervals of the data signal lines SL narrower.

However, since a width $W_3$ between the contact pads 136 cannot be made narrower than the width $W_2$, it is impossible to further improve the resolution.

Furthermore, the following describes power consumption of the above-mentioned driving circuit. For example, in the analog switches TR composed of the n-channel-type field effect transistors, a relationship shown in FIG. 63 is fulfilled between a gate-source voltage $V_{gs}$ and a drain current $I_d$. In order to sufficiently apply the drain current $I_d$ (gradation signal), an electric potential $V_g$ of a gate electrode should have a value obtained by adding a threshold value voltage $V_{th}$ required for conduction of the analog switches TR and allowance a to an electric potential $V_s$ of a source electrode.

For this reason, as shown in FIG. 64, when the value of an amplitude of the gradation voltage GV is $V_{amp}$, an amplitude $V_a$ of a sampling signal should be at least $V_{amp}$+Vth+α. Namely, the sampling signal to the analog switches TR should have a larger voltage than a voltage to be applied to the picture element capacity $C_P$ through the data signal lines SL. Therefore, it is impossible to lower a driving voltage, which meets demands for lower power consumption.

In addition, in order to realize the lower power consumption, as shown in FIG. 59, it is considered that the dynamic range $V_{dyn}$ of the gradation voltage GV is made small. As the dynamic range $V_{dyn}$ corresponds to the range of off-level to on-level, the dynamic range $V_{dyn}$ of the gradation voltage GV can be small by using liquid crystal with small dynamic range $V_{dyn}$.

However, in the case of 512 gradations, when the dynamic range $V_{dyn}$ is 5V, variations ΔV of the gradation voltage GV per one gradation becomes not more than 10 mV. Such control of the very small gradation voltage GV is difficult, and is not practical.

In addition, in order to lower power consumption, as shown in FIG. 65, a method of dividing the data signal line driving circuits into a first block 141 through a third block 143 has been used.

As shown in FIG. 66, power source voltages $BV_1$ through $BV_3$ and clocks $BCK_1$ through $BCK_3$ are successively applied to the first through third blocks 141 through 143 according to horizontal scanning per about ⅓ period of one horizontal scanning period (1H). Therefore, the first through third blocks 141 through 143 are actuated only for about ⅓ period of 1H, and they stops for remaining ⅔ period. When the data signal line driving circuit is driven dividedly, as mentioned above, the power consumption can be reduced to about ⅓.

However, even if the above method is applied to the data signal line driving circuit 102 shown in FIG. 58, the sections other than the shift register 120 are actuated for most of the period. For this reason, it is necessary to always supply the power source and the clock CSK to the sections other than the shift register 120, a decrease in the power consumption cannot be expected much.

SUMMARY OF THE INVENTION

It is an object of the present invention to provide a voltage output circuit which is capable of outputting plural gradation voltages and an image display device which is capable of realizing display with multi-gradation by providing the voltage output circuit to the image display device. It is another object of the present invention to provide a voltage output circuit or an image display device which is capable of plural gradation voltages and of lowering power consumption.

In order to achieve the above objects, a first voltage output circuit of the present invention includes:

a plurality of power source lines to which different voltages are applied per divided period obtained by dividing a scanning period into a plurality of periods; and a selecting output section for selecting one of the power source lines for at least one divided period of the divided periods based upon a plural bit digital signal so as to output a voltage applied to the selected power source line during the divided period.

In accordance with the above configuration, when a multi-bit digital signal is inputted, one power source line is selected by the selecting output section based upon the digital signal for one or more divided periods. As a result, a voltage outputted to the power source line selected for the period is outputted.

Therefore, in the case where the first voltage output circuit is applied to a data signal line driving circuit of an image display device, a number of power source lines becomes smaller compared with the gradation of an image to be displayed. As a result, the configuration of the power source (gradation power source), which is provided outside the first voltage output circuit and outputs the voltage, becomes simple, and a number of external terminals for connection of the power source lines is greatly decreased. Moreover, since the divided period has an enough length such as 1/a number of divisions of a scanning time, in the case where a scanning period is a horizontal scanning period, a precise-gradation voltage is outputted. Therefore, cost of the power source and mounting cost of the voltage output circuit can be lowered.

More specifically, the first voltage output circuit further includes:

a first decoder for outputting $2^m$ decoded signals based upon m bits ($1<m<n$) from the n-bit digital signal; and a second decoder for outputting $2^k$ decoded signals based upon k bits ($k=n-m$) of the digital signal. Moreover, $2^m$ power source lines are provided for the digital signal, and the selecting output section includes:

a period selecting section for selecting at least one divided period of the divided $2^k$ periods based upon the decoded signal from the second decoder;

an output control section for outputting a control signal, which is effective in one of the power source lines only for the divided period selected by the period selecting section, based upon an output signal from the period selecting section and the decoded signal from the first decoder; and an output section which conducts due to the control signal from the output control section and outputs a voltage to be applied to the selected power source line.

In accordance with the above configuration, when the n-bit digital signal is inputted, $2^k$ decoded signals and $2^m$ decoded signals are created by the first and second decoders based upon k bits and m bits obtained by dividing the n bits. Then, at least one of the divided periods is selected by the period selecting section according to the decoded signal from the second decoder. Meanwhile, for example, an AND of the output signal of the period selecting section and the decoded signal from the first decoder is taken by the output control section, and a control signal, which is effective on one of the power source lines only for a period selected by the period selecting section, is outputted. When the output section conducts according to the control signal, the voltage for the selected period is outputted from the output section through one selected power source line.

As a result, a number of the power source lines required for displaying a $2^n$-gradation image becomes $2^m$, so its number is greatly decreased. For example, in the case where a 64-gradation image is displayed, if m=3, a number of the power source lines is 8.

In addition, since the output section has $2^m$ transfer gates respectively connected to the power source lines, only one transfer gate intervenes at the time of taking in the voltages from the power source lines. For this reason, as to the conducting characteristic between the power source lines and the output lines, the resistance becomes low, thereby suppressing a fall of the voltages. As a result, the voltages can be outputted from the power source lines to the output lines satisfactorily.

In the first voltage output circuit, the ranges of the voltages to be applied respectively to the power source lines for the scanning period are separated from each other among the power source lines, so a variation of the voltage level on each power source line becomes small. For this reason, a time required for stability of the voltage level becomes shorter, and a scale of an external power source (gradation power source) for applying a voltage to the power source lines can be small. Moreover, in the power source, one voltage generating circuit can be used for adjacent voltages to be generated, inversion of a gradation due to output dispersion of the voltage generating circuit hardly occurs.

In order to achieve the above objects, a second voltage output circuit of the present invention includes:

a plurality of power source lines to which different voltages are applied per divided period obtained by dividing a scanning period into a plurality of periods;

a selecting output section for selecting two of the power source lines for at least one divided period of the divided periods based upon a plural bit digital signal so as to output voltages applied to the selected power source lines during the divided period; and a medial value generating section for generating a medial value of two voltages selected by the selecting output section.

In accordance with the above configuration, when the plural bit digital signal is inputted, two of the power source lines are selected by the selecting output section based upon the digital signal for one or more divided periods. As a result, two voltages, which are outputted to the selected power source lines for the divided periods, are outputted. Then, a voltage between the two voltages is generated in the medial value generating section by using a resistance divider.

Therefore, in the case where the second voltage output circuit is applied to a data signal line driving circuit of an image display device, a number of the power source lines can be smaller compared to the gradations of an image to be displayed. As a result, the configuration of the power source (gradation power source) provided outside the voltage output circuit becomes simple, and a number of external terminals for connecting the power source lines is greatly decreased. Moreover, since the divided period has an enough length such as 1/a number of divisions of a scanning time, in the case where a scanning period is a horizontal scanning period, a precise-gradation voltage is outputted. Furthermore, since a voltage between the two voltages is outputted by the medial value generating section, voltages having more different levels can be obtained. Therefore, cost of the power source circuit and mounting cost of the voltage output circuit can be lowered, and a great increase in a number of gradations can be realized.

More specifically, the second voltage output circuit further includes:

a first decoder for outputting $2^m$ decoded signals based upon m bits (1<m<n) from the n-bit digital signal;

a second decoder for outputting $2^k$ decoded signals based upon k bits (1<k<n−m) of the digital signal; and a third decoder for outputting $2^h$ decoded signals based upon h bits (h=n−m−k) of the digital signal. Moreover, in the second voltage output circuit, $2^m$+1 power source lines are provided for the n-bit digital signal, and the selecting output section includes:

a period selecting section for selecting at least one divided period of the divided $2^k$ periods based upon the decoded signal from the second decoder;

an output control section for outputting a control signal, which is effective in two of the power source lines only for the divided period selected by the period selecting section, based upon an output signal from the period selecting section and the decoded signal from the first decoder; and an output section which conducts due to the signal from the output control section and outputs a voltage to be applied to the selected power source line. Further, in the second voltage output circuit, the medial value generating section selects one of voltages divided plurally between two voltages based upon the decoded signal from the third decoder.

In accordance with the above configuration, when the n-bit digital signal is inputted, $2^k$ decoded signals, $2^m$ decoded signals and $2^h$ decoded signals are created by the first through third decoders based upon k bits, m bits and h bits obtained by dividing n bits. Then, at least one period of the divided periods is selected by the period selecting section according to the decoded signal from the second decoder.

Meanwhile, an AND of the output signal from the period selecting section and the decoded signal from the first decoder is taken by the output control section, and a control signal, which is effective on the two power source lines only for the divided period selected by the period selecting section, is outputted. Then, when the output section conducts based upon the signal, two voltages for the selected period are outputted from the selected two power source lines. Moreover, in the medial value generating section, one of the $2^h$ voltages between the two voltages is generated based upon the decoded signal from the third decoder.

As a result, a number of power source lines required for displaying a $2^n$-gradation image becomes $2^m$=+1, so the number is greatly decreased. For example, if m=k=h=2, a 64-gradation image can be displayed by five power source lines. Moreover, if m=3, K=3 and h=2, a 256-gradation image can be displayed by nine power source lines.

In addition, since the output section has $2^{m+1}$ transfer gates respectively connected to the power source lines, only one transfer gate is used at the time of taking a voltage from the two power source lines into the medial value generating section. For this reason, as to the conducting characteristic between the power source lines and the output, the resistance becomes low, thereby suppressing a fall of the voltages. As a result, the voltages can be outputted from the power source lines to the output lines satisfactorily.

In the second voltage output circuit, since the ranges of the voltages to be applied respectively to the power source lines for the scanning period are continued among the power source lines, two voltages having adjacent levels to be applied to the medial value generating section can be easily obtained. Therefore, the configuration of the power source (gradation power source) for generating voltages can be simplified.

When the first and second voltage output circuits has a counter for generating k-numbered pulse signals having different periods, the period selecting section outputs $2^k$ period selecting signals, which are effective for the divided periods, by using the k pulse signals outputted from the counter based upon the clock. As a result, it is not required to input k pulse signals from outside, and thus a number of input signal lines becomes small. Therefore, the configuration of the voltage output circuit can be simplified. Therefore, cost of the power source and mounting cost of the voltage output circuit can be lowered.

In the first and second voltage output circuits, when the period selecting section selects one of the divided periods, the circuit configuration can be simplified.

In the first and second voltage output circuits, when the period selecting section selects a continuing period from a first period to a period of inputting a desired digital signal in the divided periods, time required for taking in a voltage with such a level that insufficient writing with respect to a capacity of the output line may occur can be secured longer, so voltages can be outputted precisely. Therefore, in the case where the first and the second voltage output circuit having the above configurations are applied to a data signal line driving circuit of an image display device, the period selecting section can write a video signal to data signal lines satisfactorily.

In order to achieve the above objects, a first image display device of the present invention includes:

a plurality of picture elements arranged in a matrix pattern for displaying;

data signal lines connected to the picture elements; and a data signal line driving circuit having a voltage output circuit, the voltage output circuit including:

(a) a plurality of power source lines to which different voltages are applied per divided period obtained by dividing a horizontal scanning period into a plurality of periods; and (b) the same number of selecting output sections as the data signal lines for selecting one of the power source lines for at least one of the divided periods based upon a video signal composed of a multi-bit digital signal so as to output a voltage, which is applied to the power source line selected for the divided period, to the data signal lines.

In the first image display device, when the voltage output circuit having the same configuration as the first voltage output circuit is provided, a number of power source lines becomes smaller compared to gradations of an image to be displayed, thereby simplifying the configuration of the power source gradation power source) and decreasing a number of external terminals for power source lines. Moreover, since time required for writing a video signal to the data signal line is secured enough, a precise voltage can be obtained. Therefore, cost of the first image display device can be lowered, and the quality of display can be improved.

In order to achieve the above objects, a second image display device of the present invention includes:

a plurality of picture elements arranged in a matrix pattern for displaying;

data signal lines connected to the picture elements; and a data signal line driving circuit having a voltage output circuit, the voltage output circuit including:

(a) a plurality of power source lines to which different voltages are applied per divided period obtained by dividing a horizontal scanning period into a plurality of periods;

(b) the same number of selecting output sections as the data signal lines for selecting two of the power source lines for at least one of the divided periods based upon a video signal composed of a multi-bit digital signal so as to output voltages, which is applied to the power source lines selected for the divided period, to the data signal lines; and (c) the same number of medial value generating sections as the data signal lines for generating a voltage between two voltages selected by the selecting output sections.

In the second image display device, when the voltage output circuit having the same configuration as the second voltage output circuit is provided, a number of power source lines becomes smaller compared with gradations of an image to be displayed, so the configuration of the power source is simplified, and a number of external terminals for power source lines is decreased. Moreover, since time required for writing a video signal to the data signal lines is secured enough, a precise voltage can be obtained. Furthermore, more voltages with different levels can be obtained from the medial value generating section. Therefore, cost of the power source and mounting cost of the voltage output circuit can be lowered, and a number of gradations can be greatly increased.

In the first and second image display devices, when polarities of the voltages to be applied to the power source lines are alternately changed per horizontal scanning period, a satisfactory image where a flicker is not conspicuous can be displayed.

In the first and second image display devices, when polarities of the voltages to be applied to the power source lines are alternately changed per vertical scanning period, a number of switching of the output polarities in the power source is decreased. For this reason, the power consumption of the first and second image display device can be reduced.

In the first and second image display devices, when the digital signal, which is generated by using a pseudo gradation display method which utilizes a characteristic of human eyes, is inputted, besides the gradation display by the voltage output circuit, more multi-gradation display becomes possible. Therefore, the quality of display of the first and second image display devices can be greatly improved.

In the first and second image display devices, since switching elements composing the picture elements are polycrystal silicon thin film transistors, time required for writing a video signal to the picture elements becomes short, a video signal can be written satisfactorily also for $1/2^k$ period of one horizontal scanning period.

In the first and second image display devices, when data signal line driving circuit is composed of a polycrystal silicon thin film transistor, the data signal line driving circuit can be formed on one substrate where the picture elements are formed by the same process, thereby simplifying the process for manufacturing an image display device. Therefore, cost of the first and second image display devices as the products can be lowered.

In order to achieve the above objects, a third voltage output circuit of the present invention includes:

a plurality of power source lines to which different voltages are applied per divided period obtained by dividing a scanning period into plural periods, the voltages changing within prescribed voltage ranges which are different respectively; and a selecting output section for comparing a multi-bit reference signal with a video signal composed of a multi-bit digital signal for determining the divided periods, and when both the signals coincide with each other, selecting one of the power source lines for the divided period determined by the coincident reference signal so as to output a voltage applied to the power source line selected for the divided period.

In accordance with the above configuration, when a multi-bit digital signal is inputted, the digital signal is compared with a reference signal by the selecting output section. As a result of the comparison, when both the signals coincide with each other, one of the power source lines is selected. Since the power source line is selected for the divided period determined by the coincident reference signal, a specified level of a voltage applied to the power source line is outputted for the divided period.

Since voltages, which change in prescribed voltage ranges which are different respectively, are applied to the power source lines, it is possible to gradually change the voltages by dividing conventional one voltage range into plural voltage ranges. For example, in the case where the voltage range is divided into two, voltage maintaining time per divided period can be doubled.

The time for outputting the voltages from the power source lines to each output line is determined by a number of gradations of the image display device, but as mentioned above, when the voltage range is divided and they are supplied to the respective power source lines, time for outputting voltages can be secured longer. As a result, in the case where the third voltage output circuit is applied to a data signal line driving circuit of an image display device, enough power can be supplied to loads of hold capacitors, etc. connected to the output lines of the data signal line driving circuit. Therefore, a number of the output lines according to resolution required for the image display device can be easily increased.

In order to achieve the above objects, a third image display device of the present invention includes:

a plurality of picture elements arranged in a matrix pattern for displaying, the picture elements have display medium;

data signal lines connected to the picture elements; and a data signal line driving circuit having a voltage output circuit, the voltage output circuit including:

(a) a plurality of power source lines to which different voltages are applied per divided period obtained by dividing a horizontal scanning period into plural periods, the voltages changing within different voltage ranges of off-level to on-level of the display medium; and (b) the same number of selecting output sections as the data signal lines for comparing a multi-bit reference signal with a video signal composed of a multi-bit digital signal for determining the divided periods, and when both the signals coincide with each other, selecting one of the power source lines for the divided period determined by the coincident reference signal so as to output a voltage applied to the power source line selected for the divided period.

In the third image display device, like the case where the third voltage output circuit is applied to a image display device such as a TFT active-matrix liquid crystal display device, time for outputting voltages to the data signal lines can be secured longer. In such a manner, when a plurality of power source lines are provided, a decrease in a number of gradations in inverse proportion to the time for outputting voltages can be compensated. In such a manner, high gradation can be realized without lowering an ability to write voltages to the data signal lines, and as a result, the image display device with high resolution can be easily provided.

More specifically, the selecting output sections in the data signal line driving circuit includes, for example:

an output control section for outputting a control signal which is effective only for the divided period determined by the reference signal when the reference signal coincides with the digital signal; and an output section which conducts due to the control signal from the output control section and outputs the voltage to be applied to the selected power source line. Moreover, the output section includes the same number of transistors as the power source lines for outputting the voltage from the power source line to the common data signal line.

In the above arrangement, it is preferable that the selecting output section further includes:

a series capacitor being connected to control terminals of the transistors for inputting the control signal therein; and a resistor connected across input terminals of the transistors connected to the power source lines and the control terminals. As a result, since the electric potentials of the control terminals and the input terminals becomes the same through the resistor in the transistors, the series capacitor is charged by the potentials. Therefore, when the control signal is inputted to the control terminal, the voltage of the control signal is added to the voltage of the input terminal, and as a result, a voltage outputted from the source of the control signal can be suppressed low. For this reason, the power consumption of the data signal line driving circuit can be lowered, and the scale of the data signal line driving circuit can be small.

It is preferable that the data signal line driving circuit in the third image display device is composed of first and second driving sections having one power source line respectively, and the first and second driving sections are arranged on both sides of the display section including the picture elements from which the data signal lines are taken out, and a first power source voltage and a second power source voltage which is higher than the first power source voltage are applied to the first driving section, while the first power source voltage and a third power source voltage which is lower than the first power source voltage are applied to the second driving section.

In accordance with the above configuration, since the data signal line driving circuit has two power source lines, a range of voltages to be applied to the respective power source lines becomes a range obtained by dividing the voltage range of off-level to on-level of the display medium into two. Therefore, in the data signal line driving circuit, the time for outputting voltages can be secured twice as long as the conventional configuration.

In addition, when the first and second power source voltages and the first and third power source voltages are applied respectively to the first driving section and the second driving section composing the data signal line driving circuit, the display medium such as liquid crystal, which should be a.c. driven in order to obtain reliability of display, can be easily used.

For example, if the first power source voltage has an earth level, the power source voltage having positive polarity is applied to the first driving section, and the power source voltage having negative polarity is applied to the second driving section. For this reason, in the data signal line driving circuit, a.c. driving of the display medium can be realized between the first driving section and the second driving section. Moreover, since the power source voltage becomes approximately ½ of the conventional one, the power consumption can be decreased, and a withstand voltage of the data signal line driving circuit can be lowered in order to decrease an area of the data signal line driving circuit.

It is preferable that the data signal line driving circuit in the third image display device is formed as an integrated circuit chip so as to be mounted to a prescribed mounting area on a substrate where the picture elements are formed, and the data signal line driving circuit has a first output terminals and second output terminals for outputting the voltages to the data signal lines, the first output terminals being arranged in a side edge which is close to the picture elements at a prescribed pitch, the second output terminals being arranged in a side edge which is farther from the picture elements at the above pitch so as to be displaced from the first output terminals by ½ pitch. Moreover, the first output terminals are connected to end sections of the data signal lines arranged on the picture element side, and the second output terminals are connected to end sections of the data signal lines through bypass wiring formed on an electrically conductive layer which is different from an electrically conductive layer on which the data signal lines are formed, on a substrate.

In accordance with the above configuration, the first and second output terminals are provided on both the sides of the data signal line driving circuit, and a bypass wiring for connecting the second output terminals to the data signal lines are formed on the substrate. As a result, respective pitches of the first and second output terminals can be narrower than the conventional ones.

In the case where the first output terminals and second output terminals are connected through contact pads, in order to obtain enough soldering strength between the contact pads and the first and second output terminals, or in order to obtain an enough allowance for displacement at the time of mounting the integrated circuit chip to the substrate, it is required to make a width of the contact pad wide. In order to respond this requirement, as mentioned above, the first output terminals and second output terminals are provided on both the sides of the data signal lines. As a result, two data signal lines can be formed per arrangement pitch of the contact pads. Therefore, even in the case of using the contact pads, the resolution can be improved easily.

In accordance with the above configuration, it is preferable that the data signal line driving circuit in the third image display device includes:

first switching elements respectively connected between one output terminal and one data signal line of the data signal line driving circuit in a series; and second switching elements respectively connected between the output terminal and a data signal line which is adjacent to and pairs with the above data signal line in a series. Moreover, the first switching elements and second switching elements conduct compensatingly per ½ period in the horizontal scanning period.

In such a manner, when the first switching elements and the second switching elements are provided, a number of the output terminals of the integrated circuit chip can be approximately ½ without decreasing the resolution, namely, a number of the data signal lines. For this reason, an allowance can be given to the pitch of the output terminals of the integrated circuit chip.

In addition, in the case where the first and second switching elements are composed of complementary metal oxide semiconductor whose conduction is controlled by a common control signal, a number of the signal lines for applying a control signal can be decreased. More concretely, the arrangement that the first switching elements are n-channel type elements and the second switching elements are p-channel type elements is given.

In order to achieve the above objects, a fourth image display device of the present invention includes:

a plurality of picture element electrodes arranged in a matrix pattern;

common electrodes arranged so as to respectively face the picture element electrodes through the display medium;

data signal lines connected to the picture element electrodes;

a data signal line driving circuit having a voltage output circuit, the voltage output circuit including:

(a) power source lines to which a voltage, which is changed N times for a horizontal scanning period within a voltage range where the voltage becomes 1/N of a maximum voltage required for driving the display medium, are applied; and (b) the same number of selecting output sections as the data signal lines for comparing a multi-bit reference signal with a video signal composed of a multi-bit digital signal for determining the divided periods, and when both the signals coincide with each other, outputting a voltage applied to the power source line for the divided period determined by the coincident reference signal; and a common potential generating section for giving N-numbered common electric potentials, which are different from each other by a level equal to the voltage range, to the common electrode one by one per different period in the horizontal scanning period in synchronization with the changing of the voltage.

In the fourth image display device, the voltage is changed to $+V_G$ from the earth potential, for example, and in the case of N=2, the electric potential of the common electrode becomes the earth potential, for example, for either of the periods of the first half and the latter half of the horizontal scanning period. On the contrary, the electric potential of the common electrode becomes $-V_G$ for the other period. As a result, since a voltage in the range of 0 to $2V_G$ is applied to the display medium, $2V_G$ is a maximum voltage which is required for driving the display medium and corresponds to the range of off-level to on-level of the display medium.

For this reason, in the above arrangement, since the voltage is 1/N of the maximum voltage in order to drive the display medium, ability to generate voltages is greatly lowered compared with conventional image display devices. Therefore, the power consumption of the data signal line driving circuit can be decreased.

More specifically, the fourth image display device further includes a power source circuit for generating voltages to be applied to the power source and inverting polarity of the voltages per horizontal scanning period. Moreover, in the fourth image display device, the selecting output section includes:

an output control section for outputting a control signal which is effective only for the divided period determined by the reference signal when the reference signal coincide with the digital signal; and an output section which conducts due to the control signal from the output control section and outputs the voltage to be applied to the selected power source line. Furthermore, the output section includes:

a p-channel type transistor and an n-channel type transistor for outputting the voltages from the power source lines to the common data signal line, the p-channel and n-channel type transistors are connected to each other in parallel; and an inverter for inverting the control signal which is applied one of the p-channel type transistor and the n-channel type transistor so that both the p-channel and n-channel type transistors conduct in response to the control signal.

In accordance with the above arrangement, since the output section includes the p-channel type transistor, the n-channel type transistor and the inverter, the output section outputs both kinds of the voltages having positive and negative polarities. Moreover, the polarities of the voltages are inverted by the power source per horizontal scanning period. As a result, the driving voltage to be applied to the display medium becomes a voltage whose polarity is inverted per horizontal scanning period, and the display medium is a.c. driven.

Therefore, reliability of the display medium, such as liquid crystal, to be a.c. driven with respect to deterioration with age can be improved, and a deterioration in display, such as a flicker, can be suppressed.

It is preferable that the common electric potential generating section in the fourth image display device inverts the polarity of the common electric potential so that it is opposite to the polarity of the voltage. In accordance with this arrangement, the changing range of the voltage can be small, and a variation in the driving voltage to be applied to the display medium can be large.

It is preferable that the fourth image display device further includes a power source for generating voltages to be applied to the power source lines, and varying a rate of change of the voltage for the horizontal scanning period. Moreover, in the fourth image display device, the common electric potential generating section includes:

a counter for outputting a multi-bit code signal based upon a clock;

a decoder for decoding the code signals so as to output selecting signals which are effective for different periods respectively;

analog switches for selecting one of reference voltages, which becomes a reference of the common electric potential, based upon the selecting signal, the reference voltages forming plural pairs of the two reference electric potentials whose absolute values are the same and polarities are different; and a buffer for buffering and amplifying the selected reference voltage so as to generate the common electric potential.

In accordance with the above arrangement, due to the power source, the rate of change in the voltage changes for a horizontal scanning period. For this reason, when the rate of change is set so as to become big at the beginning and the end of horizontal scanning period and small around the center of horizontal scanning period, non-linearity of gradations with respect to an applied voltage to display medium such as liquid crystal can be corrected. As a result, the variation in one gradation becomes uniform, thereby making it possible to correct a gamma characteristic of the display medium.

For fuller understanding of the nature and advantages of the invention, reference should be made to the ensuing detailed description taken in conjunction with the accompanying drawings.

DETAILED DESCRIPTION OF THE PREFERRED EMBODIMENTS

[EMBODIMENT 1]

The following describes the first embodiment of the present invention on reference to FIGS. 1 through 43.

Figure 2:
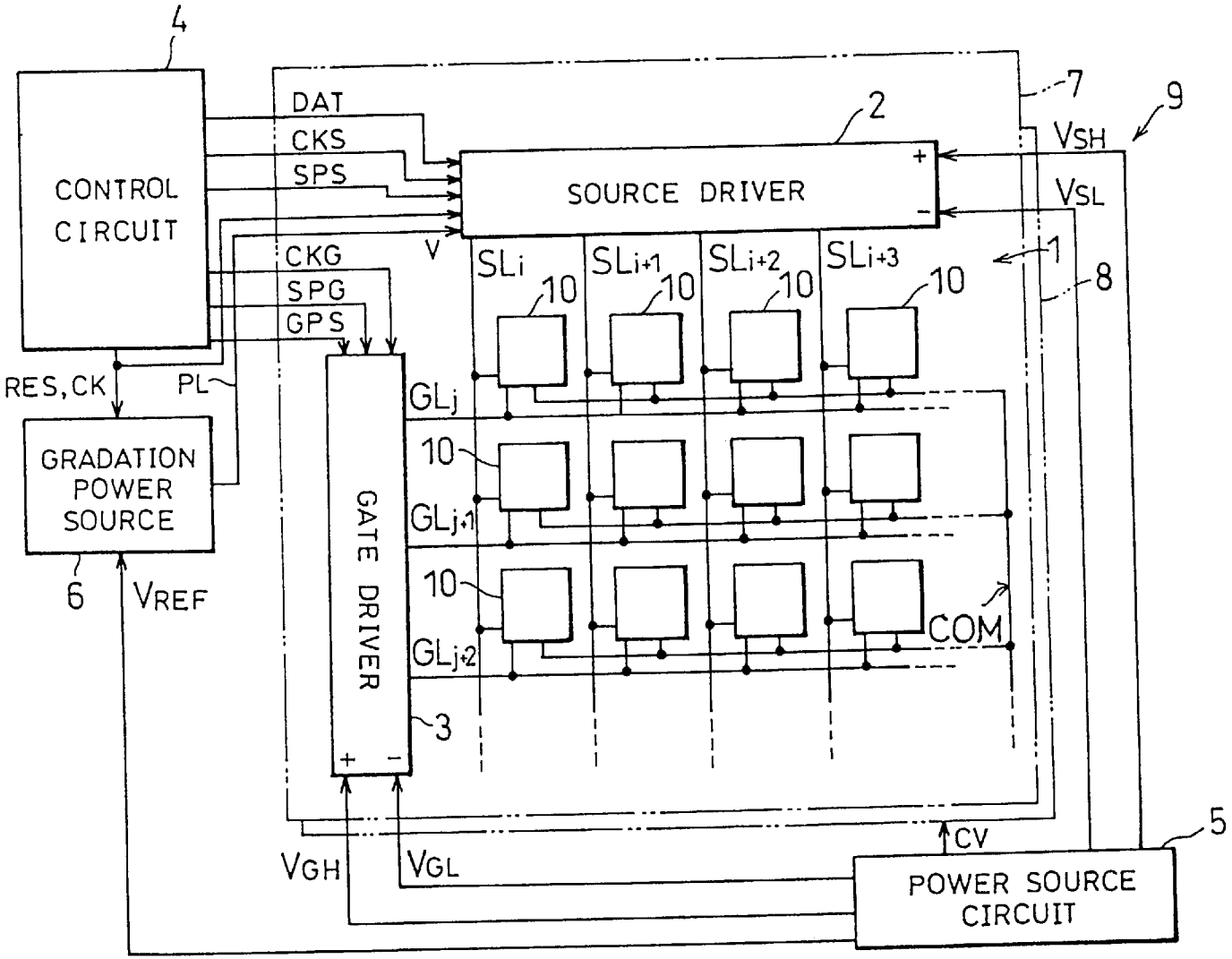
FIG. 2 is a block diagram which shows a schematic arrangement of the liquid crystal display device.

An image display device according to the present embodiment is a liquid crystal display device adopting an active-matrix driving method, and as shown in FIG. 2, the device is provided with a picture element array 1, a source driver 2, a gate drive 3, a control circuit 4, a power source circuit 5 and a gradation power source 6.

The picture element array 1, the source driver 2 and the gate driver 3 are formed on a substrate 7. The substrate 7 is made of an insulating and light transmitting material such as glass. Moreover, the substrate 7 and a substrate 8 which are made of the same material as the substrate 7 are laminated each other, and liquid crystal is sealed therebetween, thereby arranging a liquid crystal panel 9.

A plurality of source lines SL and a plurality of gate lines GL are arranged on the picture element array 1 so as to intersect at right angles each other. Moreover, a picture element 10 is provided to an area which is surrounded by the adjacent gate lines GL and the adjacent source lines SL, and all the picture elements 10 are arranged in a matrix pattern.

Figure 3:
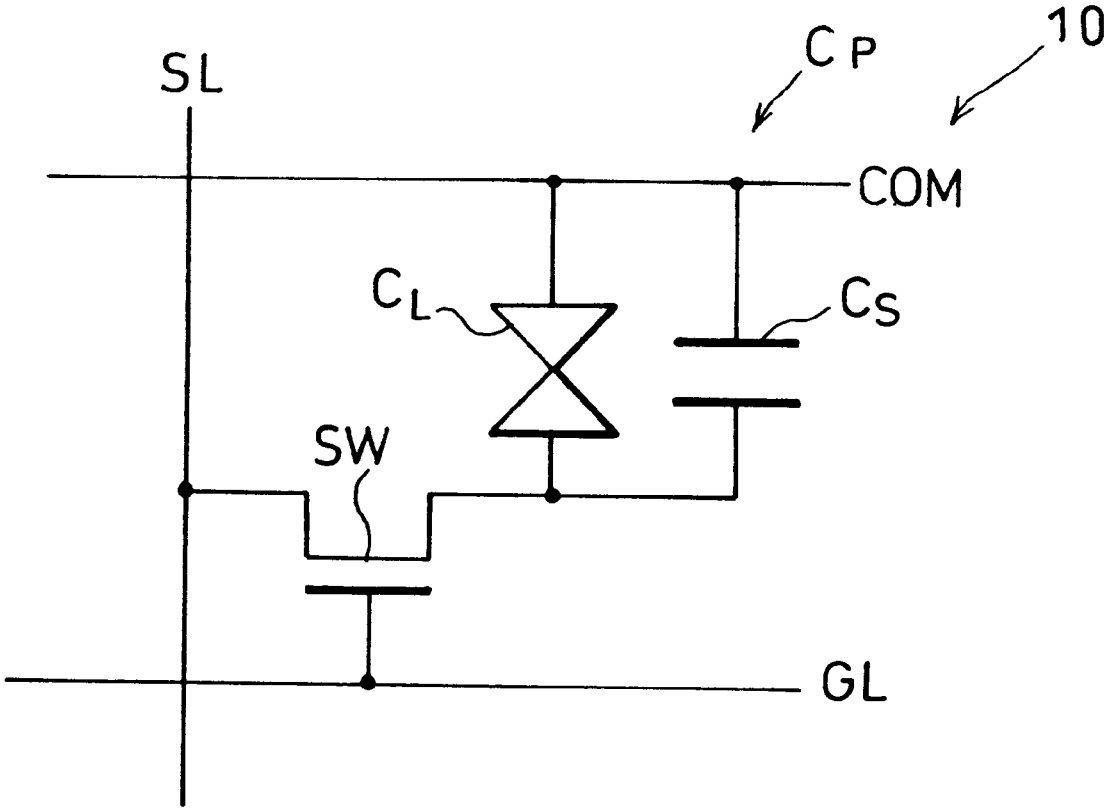
FIG. 3 is a circuit diagram which shows an arrangement of a picture element in the liquid crystal display device in FIG. 2.
Figure 4:
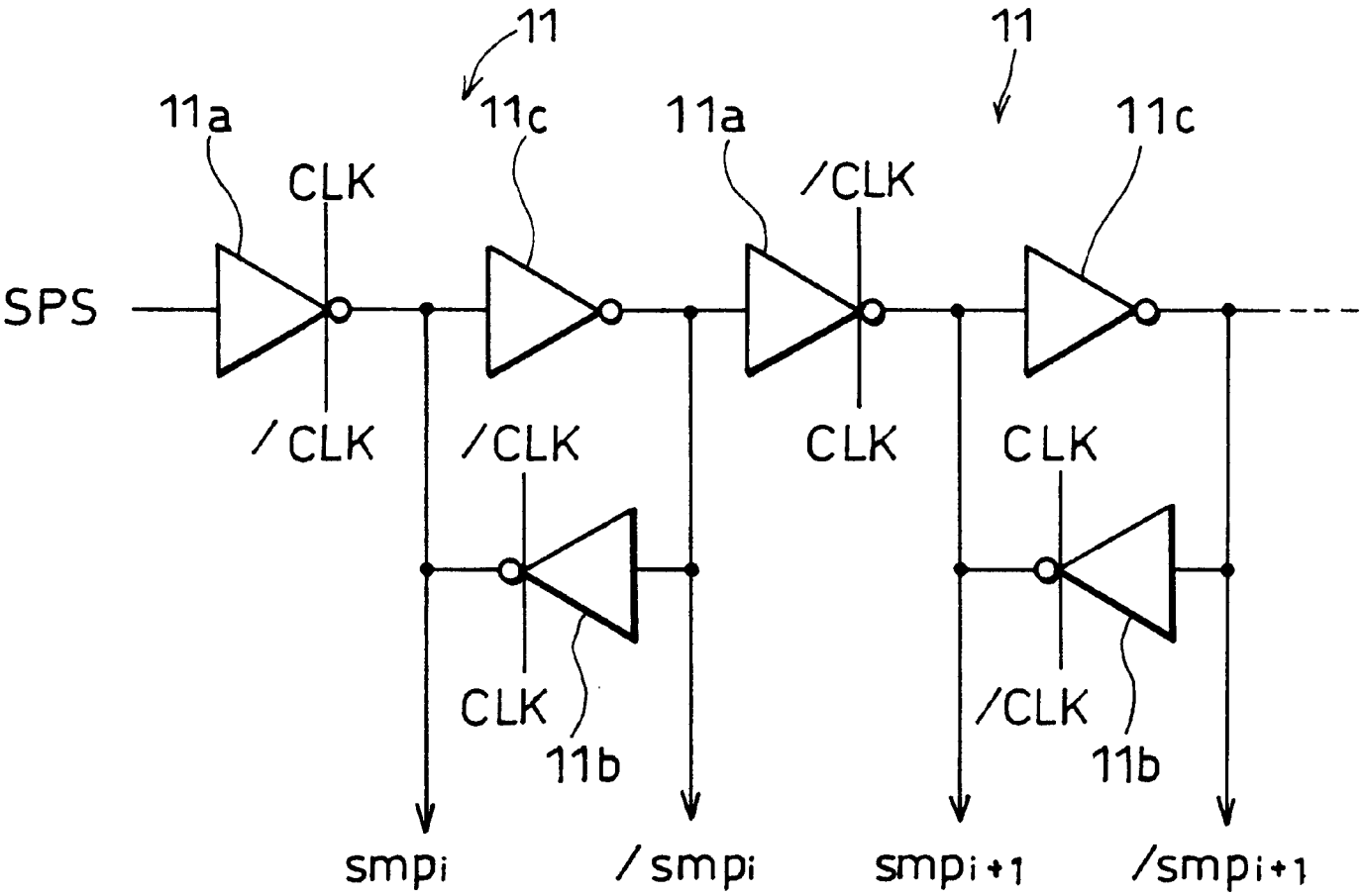
FIG. 4 is a circuit diagram which shows an arrangement of a scanning circuit in the first source driver.

As shown in FIG. 3, the picture element 10 is arranged so as to have a switching element SW composed of a field effect transistor and a picture element capacity $C_P$. The picture element capacity $C_P$ has a liquid crystal capacity $C_L$, and an auxiliary capacity $C_S$ is added thereto as required.

The source line SL is connected to one electrode of the picture element capacity $C_P$ through a source and a drain of the switching element SW. A gate of the transistor SW is connected to the gate line GL, and the other electrode of the picture element capacity $C_P$ is connected to a common electrode COM which is used commonly to all the picture elements. Then, transmissivity or reflectance of liquid crystal is modulated with a voltage to be applied to each liquid crystal capacity $C_L$ so that display is performed.

The source driver 2 selects one of plural gradation voltages from the gradation power source 6 during a specified period so as to output the selected gradation voltage to one source line SL based upon an inputted digital video signal. The source driver 2 is detailed later by illustrating first through third source drivers.

The gate driver 3 successively selects the gate lines GL based upon control signals CKG, SPG and GPS from the control circuit 4, and controls on/off operation of the switching element SW in the picture elements 10. As a result, data (gradation signals) given to each source line SL are written to each picture element 10. The written data are retained in the picture elements 10.

The control circuit 4 outputs a digital video signal DAT and control signals CKS and SPS to the source driver 2, and simultaneously outputs the control signals CKG, SPG and GPS to the gate driver 3. Moreover, the control circuit 4 outputs various control signals required for selecting the gradation voltages.

The power source circuit 5 is a circuit which generates power source voltages $V_{SH}$, $V_{SL}$, $V_{GH}$ $V_{GL}$, a common electric potential CV and a reference voltage $V_{REF}$. The power source voltages $V_{SH}$ and $V_{SL}$ having different levels are applied to the source driver 2. The power source voltages $V_{GH}$ and $V_{GL}$ having different levels are applied to the gate driver 3. The common electric potential CV is given to the common electrode COM provided to the substrate 8. The reference voltage $V_{REF}$ is applied to the gradation power source 6.

The gradation power source 6 as power source means has a plurality of voltage generating circuits, not shown. The gradation power source 6 generates plural gradation voltages V having levels in different ranges based upon the reference voltage $V_{REF}$ by means of the voltage generating circuits, and applies the gradation voltages V to the source drive 2 through a gradation power source line PL. In addition to the reference voltage $V_{REF}$, a clock CK and a reset signal RES for resetting per 1 H are supplied from the control circuit 4 to the gradation power source 6, and the gradation power source 6 generates the gradation voltages V having a staircase-like waveform based on the clock CK and the reset signal RES.

Figure 1:
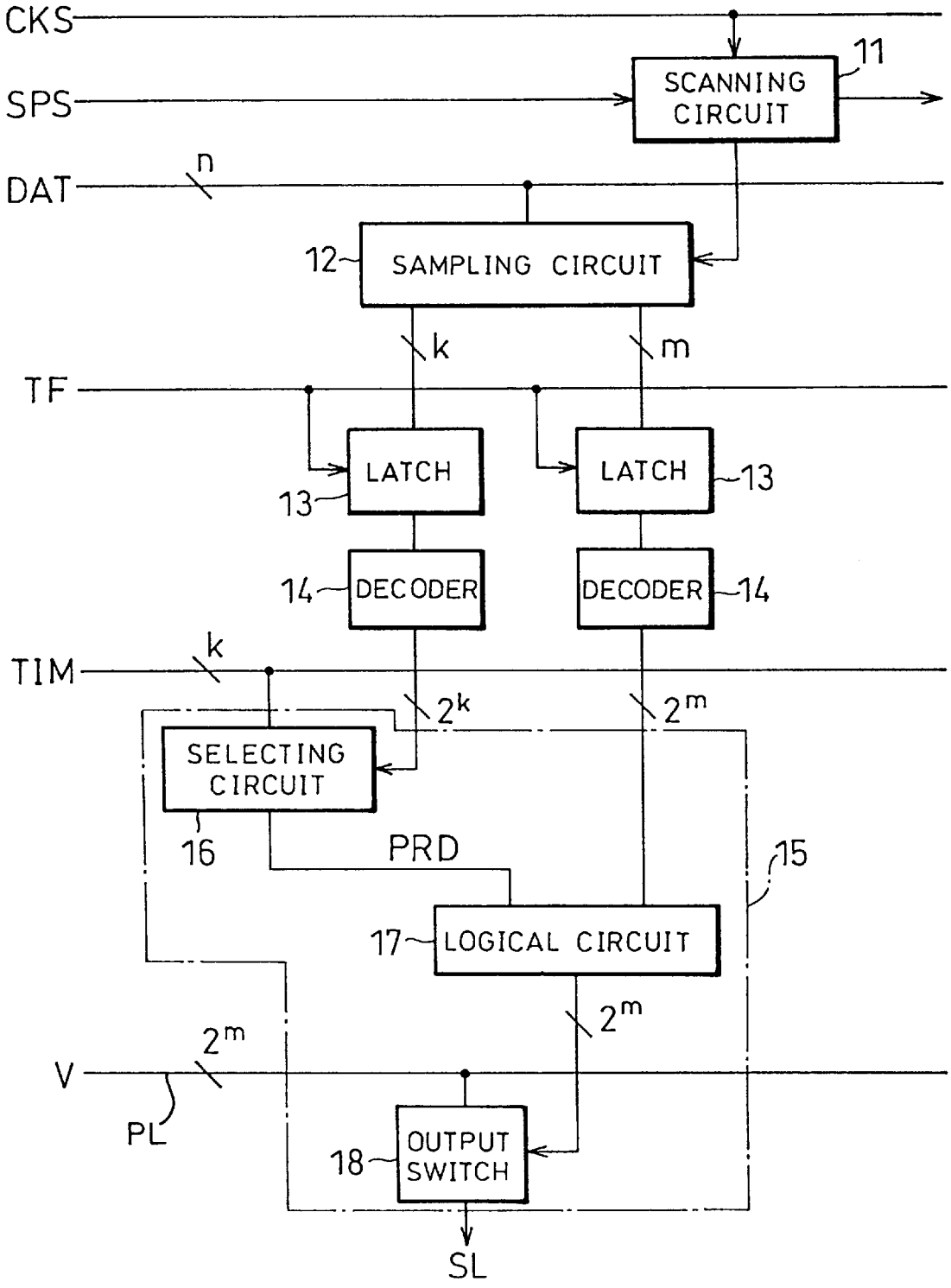
FIG. 1 is a block diagram which shows an arrangement of a first source driver in a liquid crystal display device according to the first embodiment of the present invention.

As shown in FIG. 1, the first source driver includes a scanning circuit 11, a sampling circuit 12, latches 13, decoders 14 and a selecting output circuit 15.

As shown in FIG, 4, the scanning circuit 11 includes a latch composed of clocked inverters 11*a* and 11*b* and an inverter 11*c*, and it generates sampling signals $smp_i$ and $/smp_i$ for sampling one digital signal based on a start pulse SPS. A shift register, which is arranged so that the scanning circuits 11 are connected so as to have many stages, successively shifts the start pulse signal SPS in synchronization with the clock CKS (CLK and /CLK).

Here, the sampling signal $/smp_i$ is an inverted signal of the sampling signal $smp_i$. Moreover, the clock /CLK is an inverted signal of the clock CLK.

Figure 5:
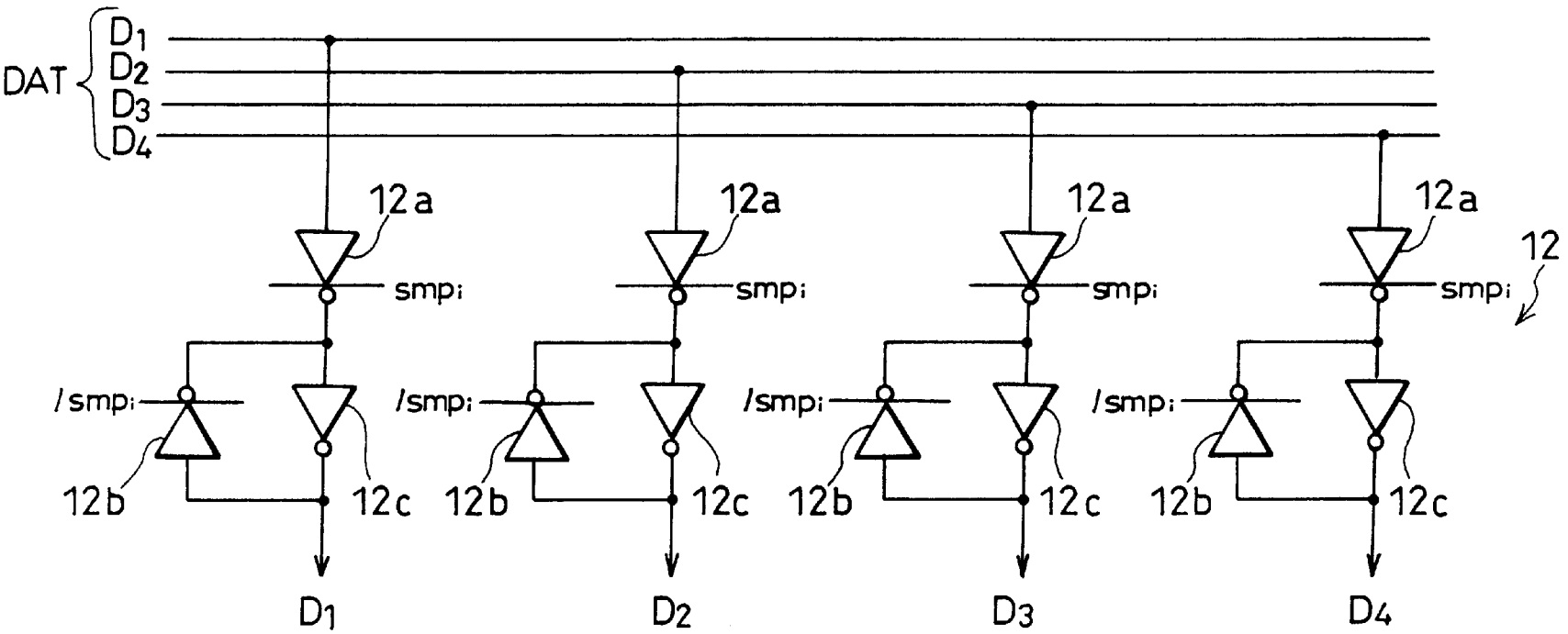
FIG. 5 is a circuit diagram which shows an arrangement of a sampling circuit in the first source driver.

As shown in FIG. 5, the sampling circuit 12 includes the same number of circuits as a number of bits of a digital signal. The above circuit is composed of clocked inverters 12*a* and 12*b* and inverters 12*c*. The sampling circuit 12 shown in FIG. 5 has an arrangement in the case of the 4-bit digital signal DAT. The sampling circuit 12 has the approximately same configuration as the latch in the scanning circuit 11, but the sampling signals $smp_i$ and $/smp_i$ are applied to the clocked inverters 12*a* and 12*b*.

Figure 6:
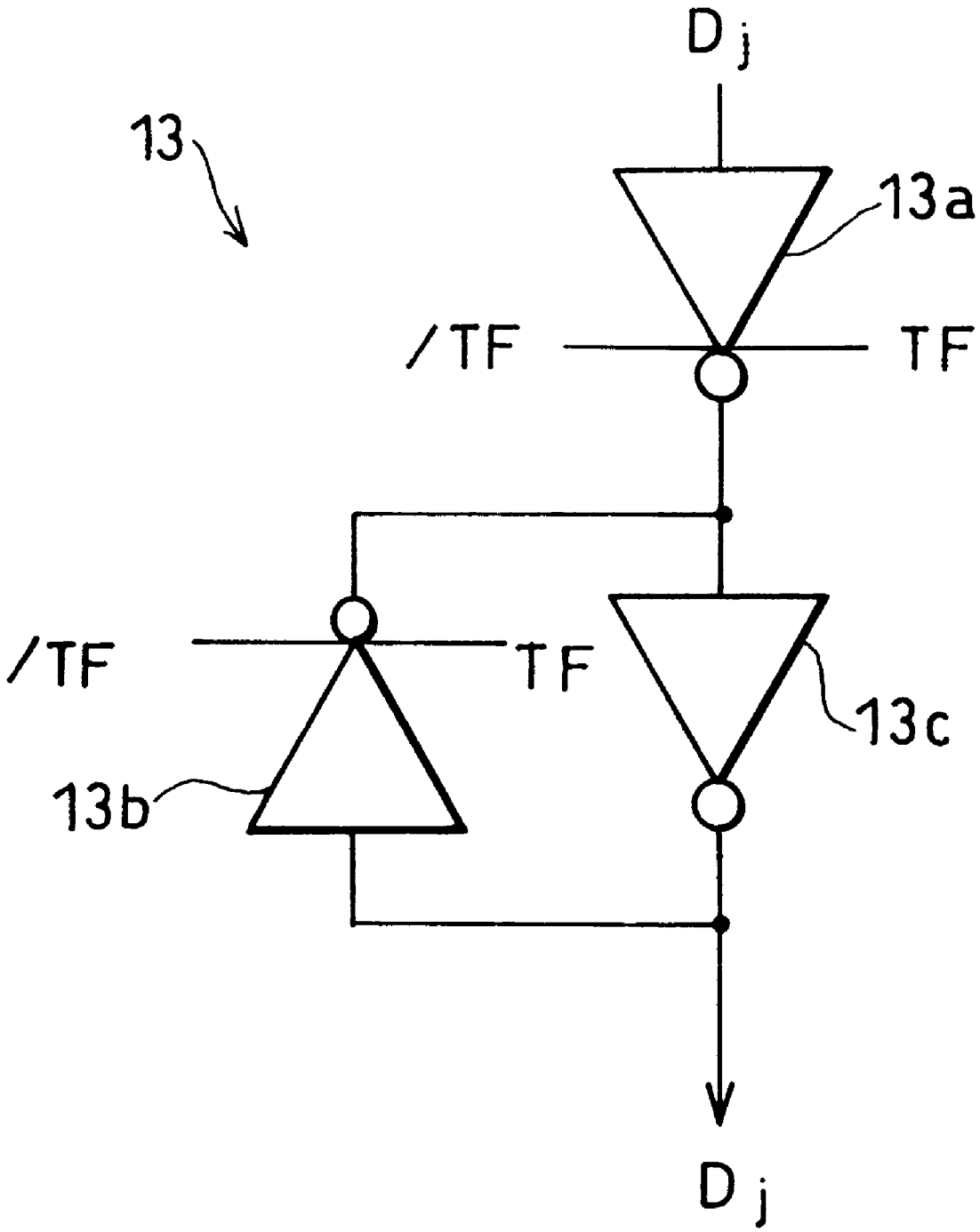
FIG. 6 is a circuit diagram which shows an arrangement of a latch in the first source driver.

The latches 13 retain the highest k-bits and lowest m-bits of n-bit digital signal DAT outputted from the sampling circuit 12. The bits retained in the latches 13 are not necessarily divided into the higher rank and the lower rank. As shown in FIG. 6, the latch 13 includes the same number of circuits as a number of bits of data to be retained. The above circuit is composed of clocked inverters 13*a* and 13*b* and an inverter 13*c*. The circuit transfers the retained signal $D_j$ to the decoders 14 in synchronization with a transfer signal TF (including an inverted transfer signal /TF).

Figure 7:
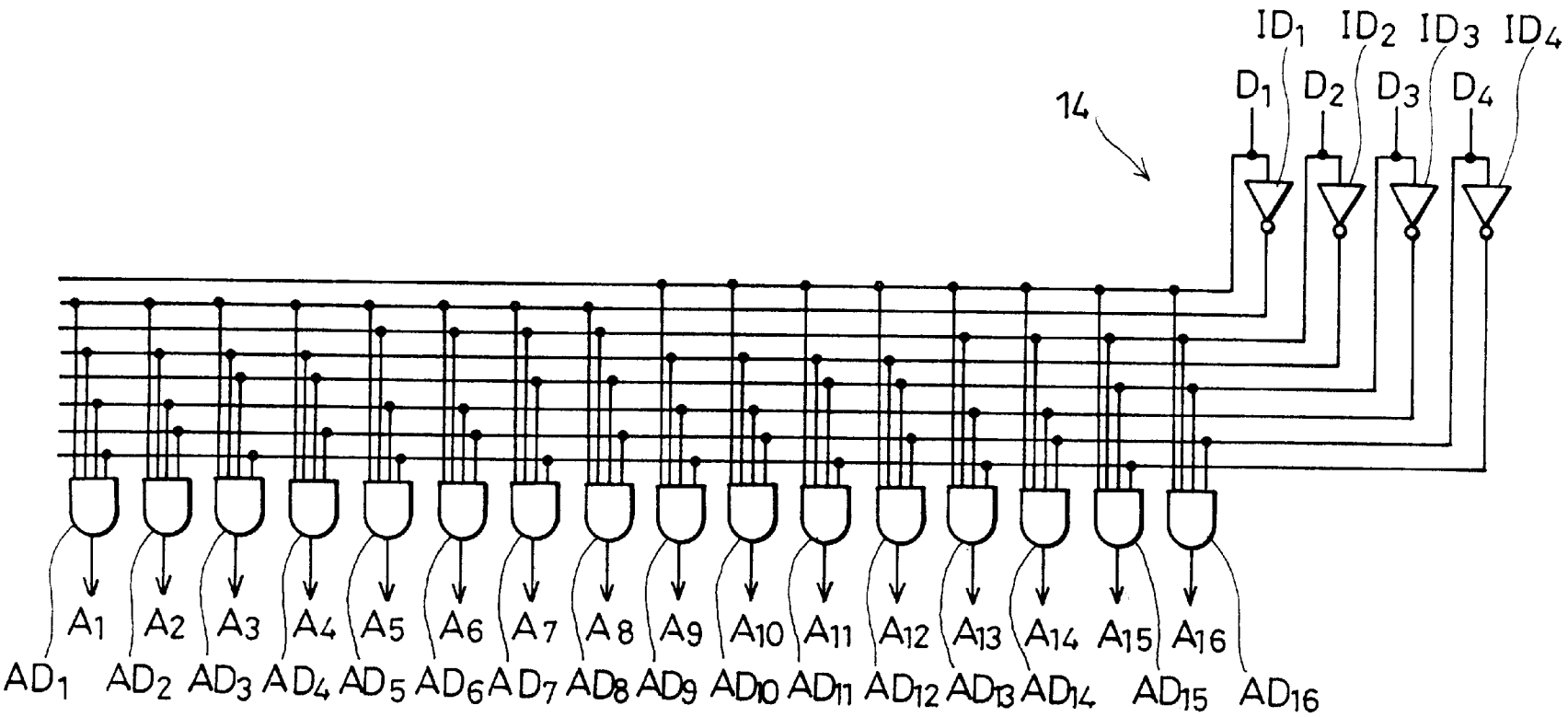
FIG. 7 is a circuit diagram which shows an arrangement of a decoder in the first source driver.

The decoders 14 output $2^k$ decoded signals A and $2^m$ decoded signals A based on the bit signal $D_j$ transferred from the latches 13. As shown in FIG. 7, for example, the decoder 14 includes inverters $ID_1$ through $ID_j$ which invert j-numbered bit signals $D_1$ through $D_j$ and AND circuits $AD_1$ through $AD_f$ ($f=2^j$).

In the case of j=4, the AND circuits $AD_1$ through $AD_{16}$ obtain AND of four signals in different combinations of bit signals $D_1$ through $D_4$ and the bit signals $D_1$ through $D_4$ inverted by the inverters $ID_1$ through $ID_4$.

The selecting output circuit 15 selects a level during one specified period of one gradation voltage of plural gradation voltages based on the decoded signals from the decoders 14.

Figure 8:
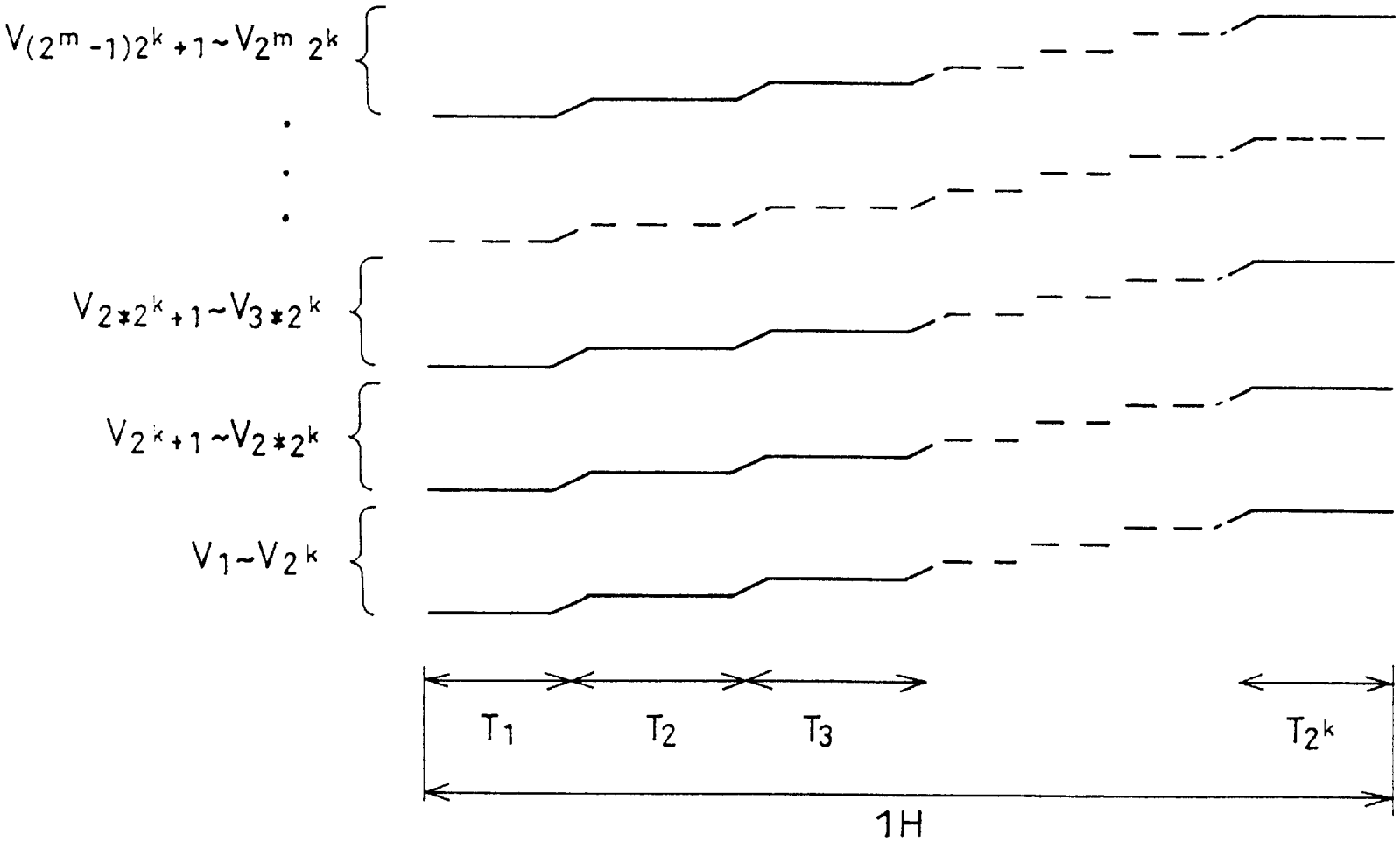
FIG. 8 is a waveform chart which shows waveforms of a staircase gradation voltage to be applied to the first source driver.

As shown in FIG. 8, the gradation voltages are generated by the gradation power source 6 so that their levels are not overlapped among the $2^m$ gradation power source lines PL. Moreover, the gradation voltage has a ramp waveform such that its level successively rises like staircase during periods $T_1$ through $T_2{}^k$ which is divided into $2^k$ from the front of a horizontal scanning period (1H) (each divided period is about $1/2^k$ of the horizontal scanning period). The gradation voltages of $V_1$ through $V_{2^k}$, $V_{2k+1}$ through $V_{2*2}$, . . . , $V_{(2^m-1)2^k+1}$ through $V_{2^m2^k}$ are applied to the gradation power source lines PL.

Figure 9:
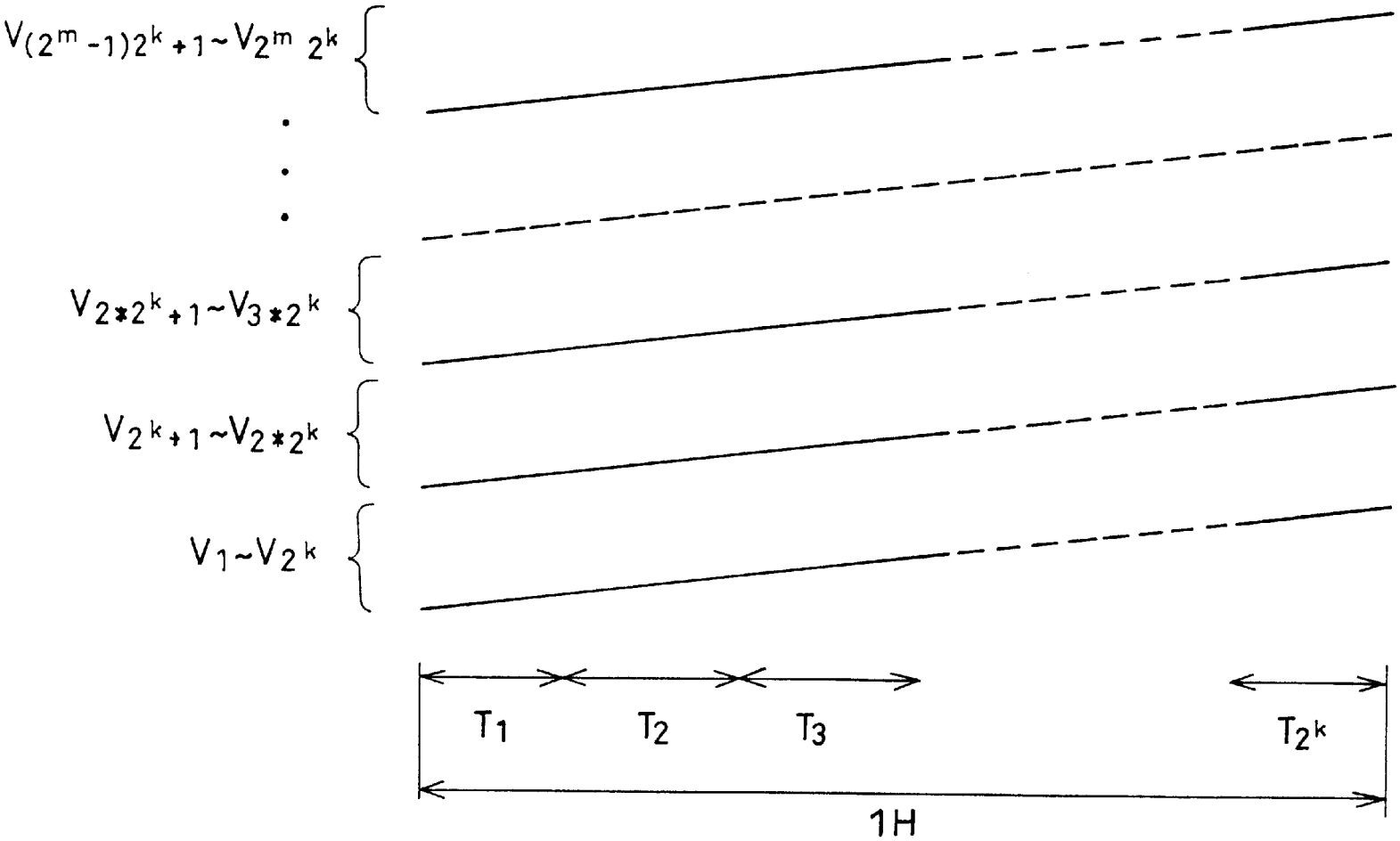
FIG. 9 is a waveform chart which shows waveforms of a linear gradation voltage to be applied to the first source driver.
Figure 10:
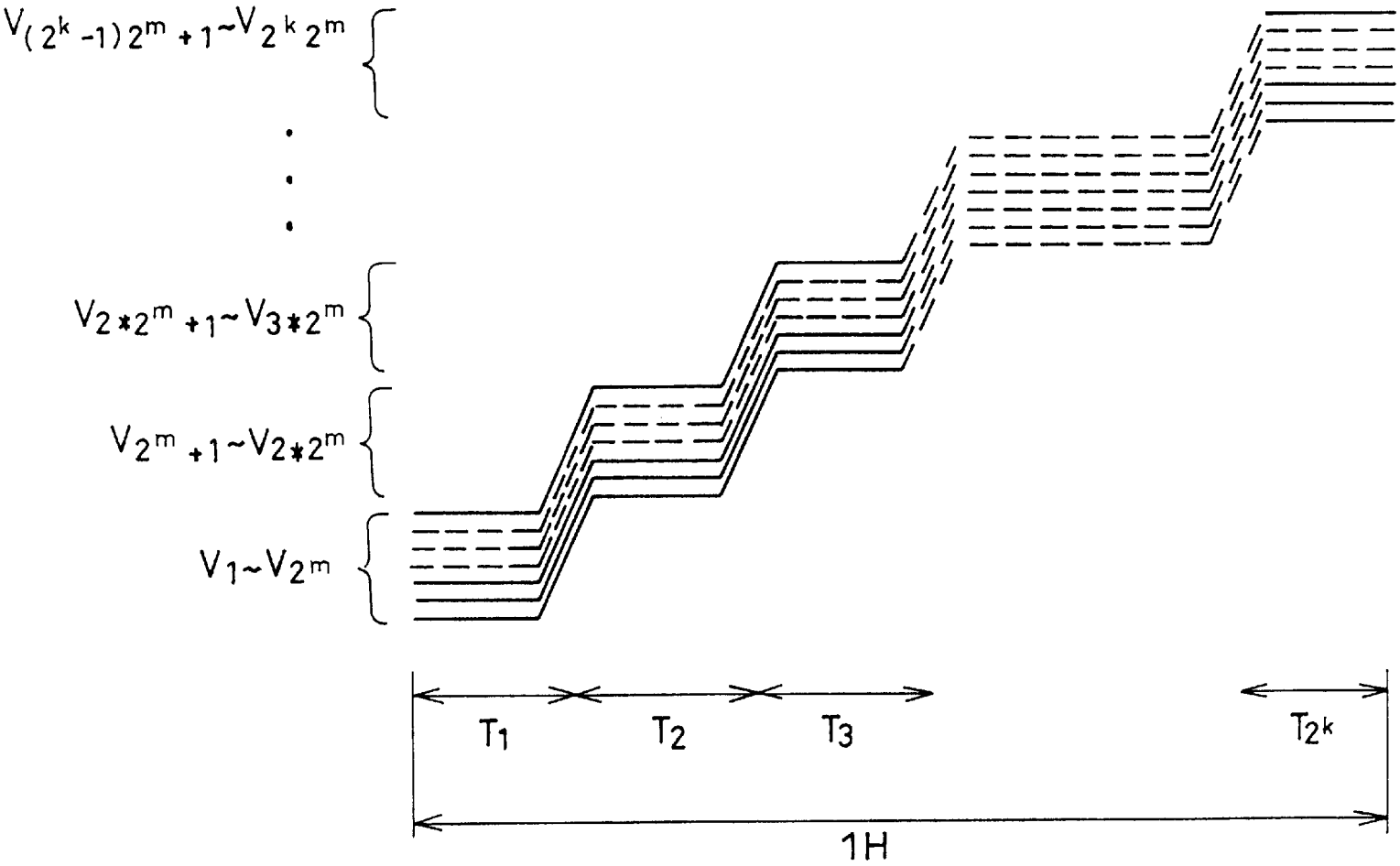
FIG. 10 is a waveform chart which shows waveforms of another staircase gradation voltage to be applied to the first source driver.
Figure 11:
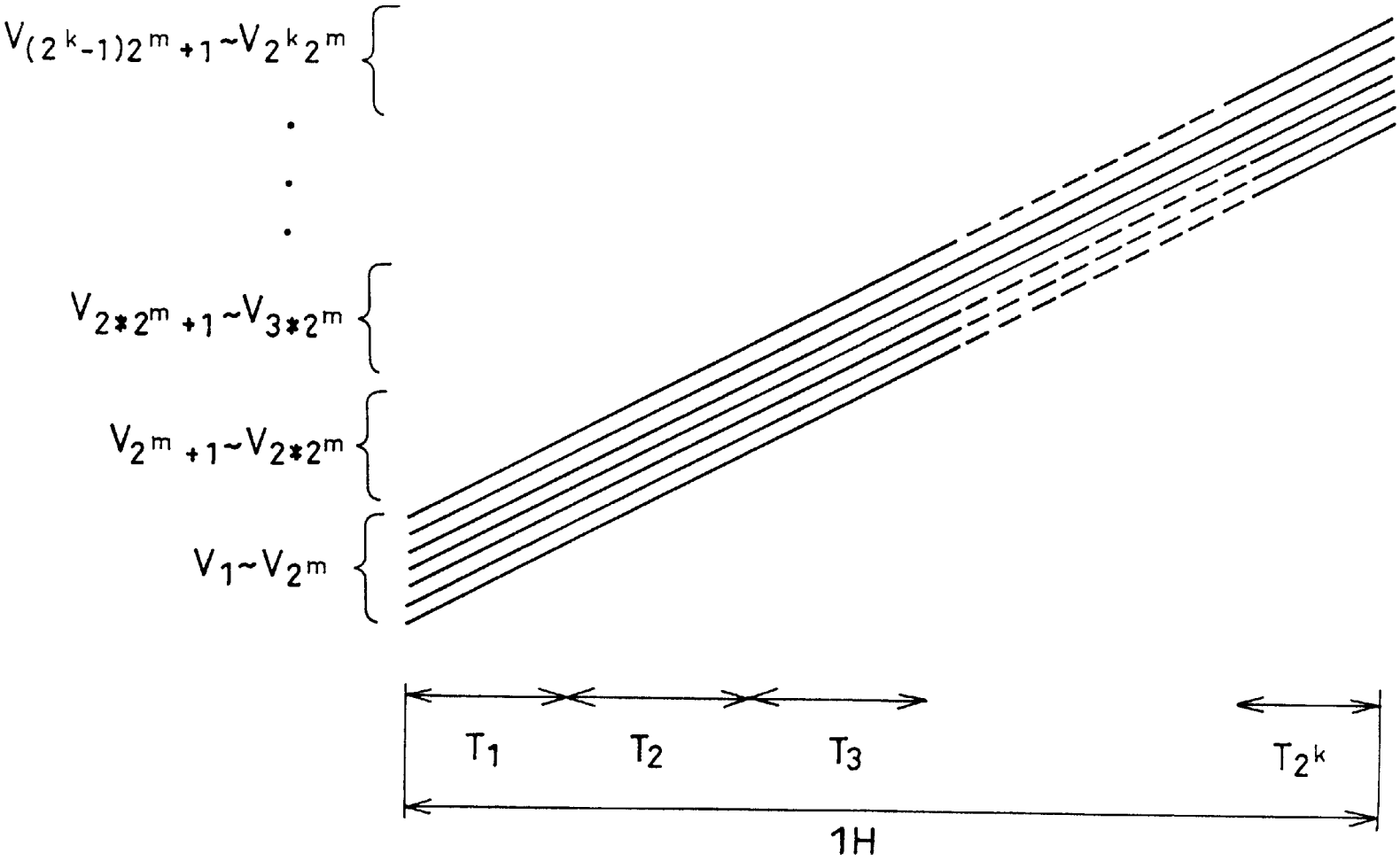
FIG. 11 is a waveform chart which shows waveforms of another linear gradation voltage to be applied to the first source driver.

In addition to the above voltages, voltages shown in FIGS. 9 through 11 may be applied as the gradation voltages.

The gradation voltage shown in FIG. 9 has a ramp waveform such that its level does not rise like staircase but rises linearly.

The voltage shown in FIG. 10 is generated simultaneously in the $2^m$ gradation power source lines PL for the same period, and its waveform is such that the level successively rises like staircase during the periods $T_1$ through $T_{2^k}$ with the intervals of the levels being kept constant. In this case, the gradation voltages of $V_1$, $V_{2^m+1}$, $V_{2*2^m+1}$, . . . , $V_{(2^k-1)2^m+l}$ are applied to the first gradation power source line PL, the gradation voltages of $V_2$, $V_{2+2}$, $V_{2*2^m+2}$, . . . , $V(_{2^k-1)2^m+2}$ are applied to the second gradation power source line PL, and the gradation voltages of $V_{2^m}$, $V_{2*2^m}$, $V_{3*2^m}$, . . . , $V_{2^k2^m}$ are applied to the m-th gradation power source line PL.

Similarly to the voltage shown in FIG. 10, the voltage shown in FIG. 11 is generated simultaneously in $2^m$ gradation power source lines PL for the same period, but its waveform is such that the level does not rise like staircase but rise linearly.

Such a gradation voltage may have not only the above-mentioned ramp waveform such that the level rises like staircase but also a ramp waveform that the level lowers like staircase. In addition, the gradation voltage with each level may be applied to the gradation power source lines PL for one of the periods $T_1$, $T_2$, $T_3$, . . . and $T_{2^K}$, and the voltage level may vary irregularly. Moreover, in the above example, the length of each period is $1/2^k$ of the horizontal scanning period, but the length is not necessarily limited to this, so the length may vary. Furthermore, in order to avoid mixing of a writing signal into a picture element other than that which is subject to writing, a certain constant period of the horizontal scanning period may not be used as a resetting period.

As shown in FIG. 1, the selecting output circuit 15 is composed of a selecting circuit 16, a logical circuit 17 and an output switch 18.

Figure 12:
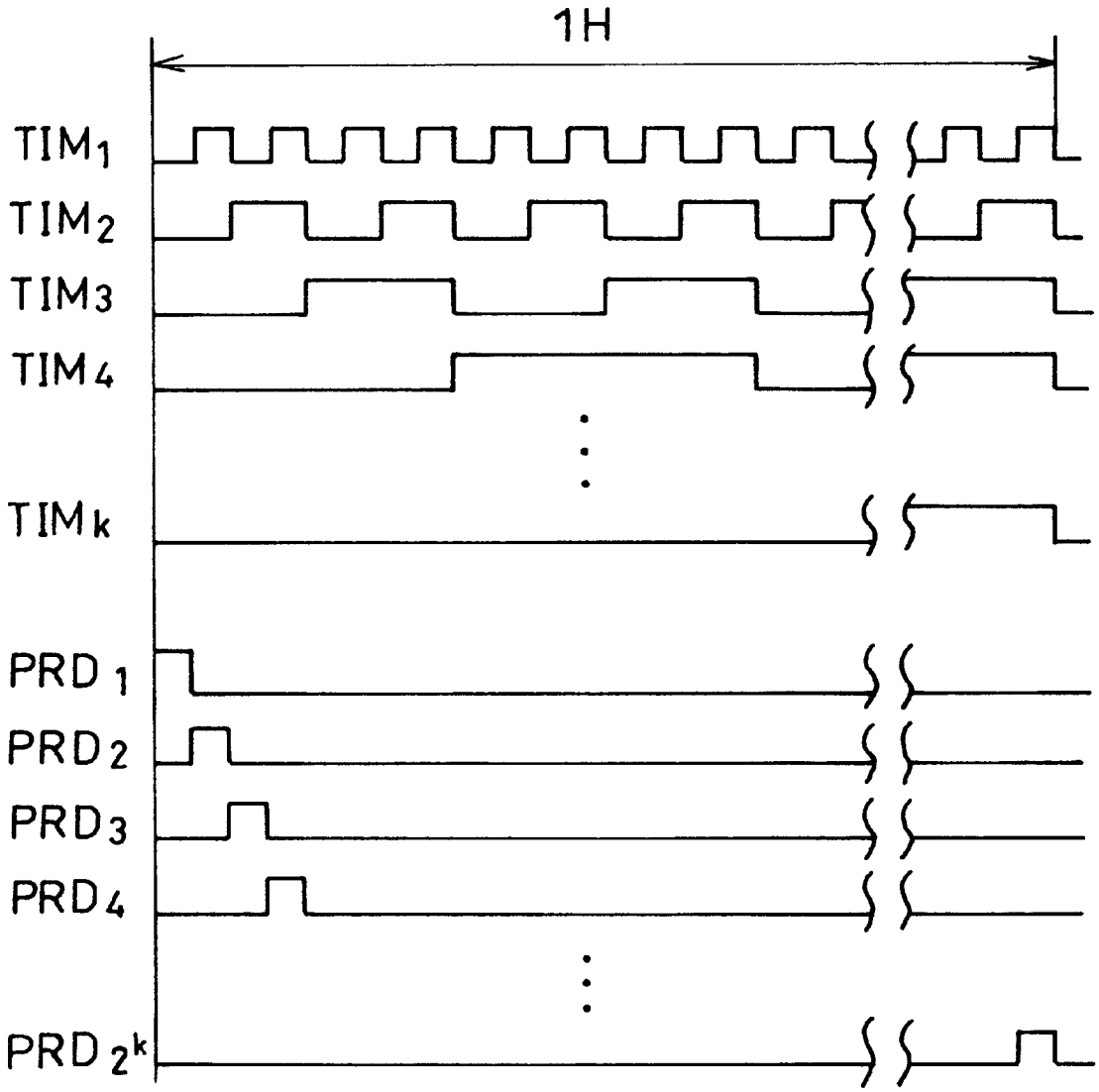
FIG. 12 is a waveform chart which shows waveforms of an input/output signal concerning a selecting circuit in the first source driver.
Figure 13:
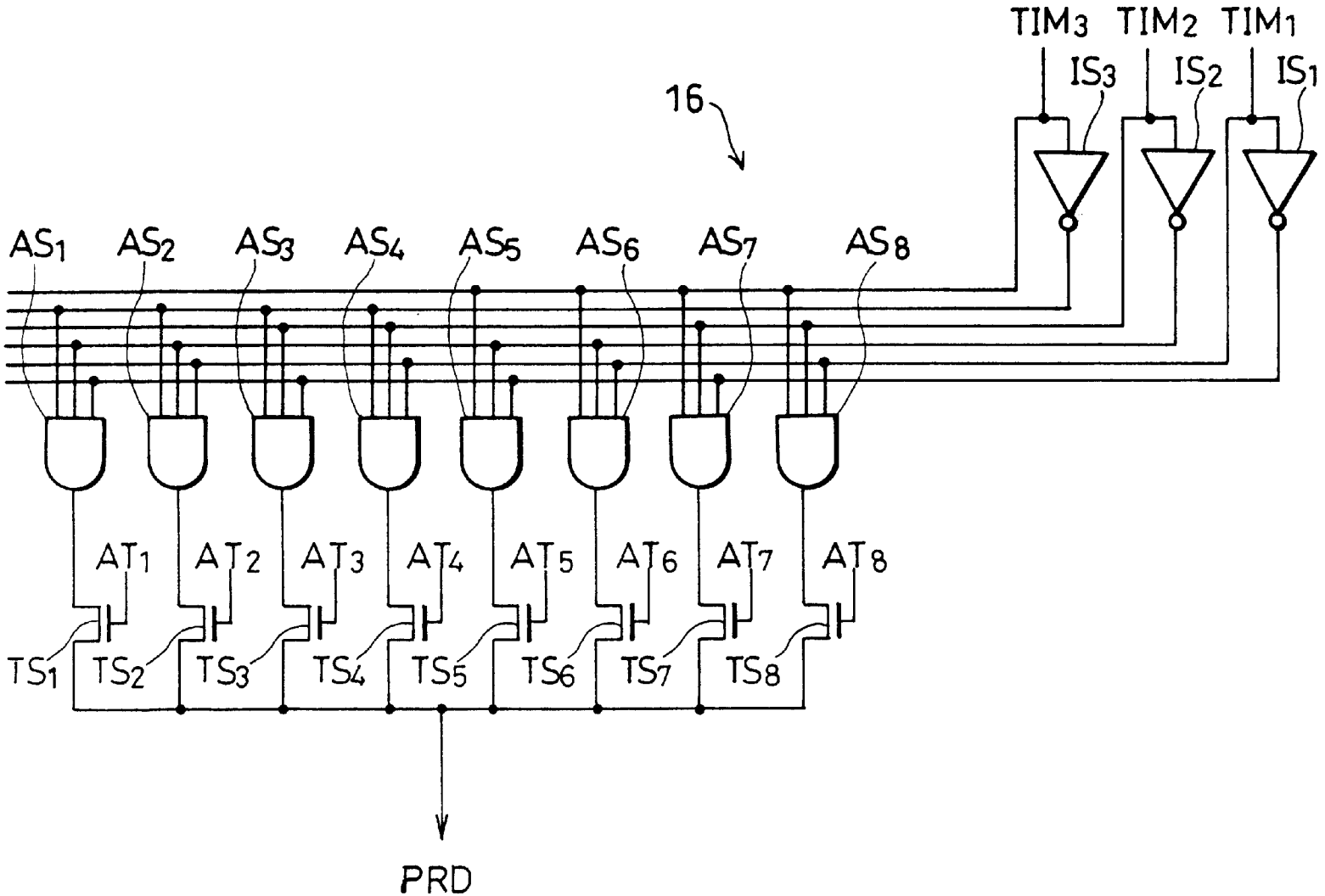
FIG. 13 is a circuit diagram which shows an arrangement of the selecting circuit.

The selecting circuit 16 as period selecting means selects one period from $2^k$ periods of the gradation voltage based on timing signals $TIM_1$ through $TIM_k$ shown in FIG. 12. As shown in FIG. 13, for example, the selecting circuit 16 has k-numbered inverters $IS_1$ through $IS_k$ for inverting the timing signals $TIM_1$ through $TIM_k$, AND circuits $AS_1$ through $AS_g$ ($g=2^k$) and transistors $TS_1$ through $TS_g$.

In the case of k=3, the AND circuits $AS_1$ through $AS_8$ obtains AND of three signals in different combinations of the timing signals $TIM_1$ through $TIM_3$ and timing signals $TIM_1$ through $TIM_3$ inverted by the inverters $IS_1$ through $IS_3$. The transistors $TS_1$ through $TS_8$ are turned on according to eight decoded signals $AT_1$ through $AT_8$ from one decoder (second decoder) 14 so as to output one of period selecting signals $PRD_1$ through $PRD_8$ for a period corresponding to the periods $T_1$ through $T_8$.

Figure 14:
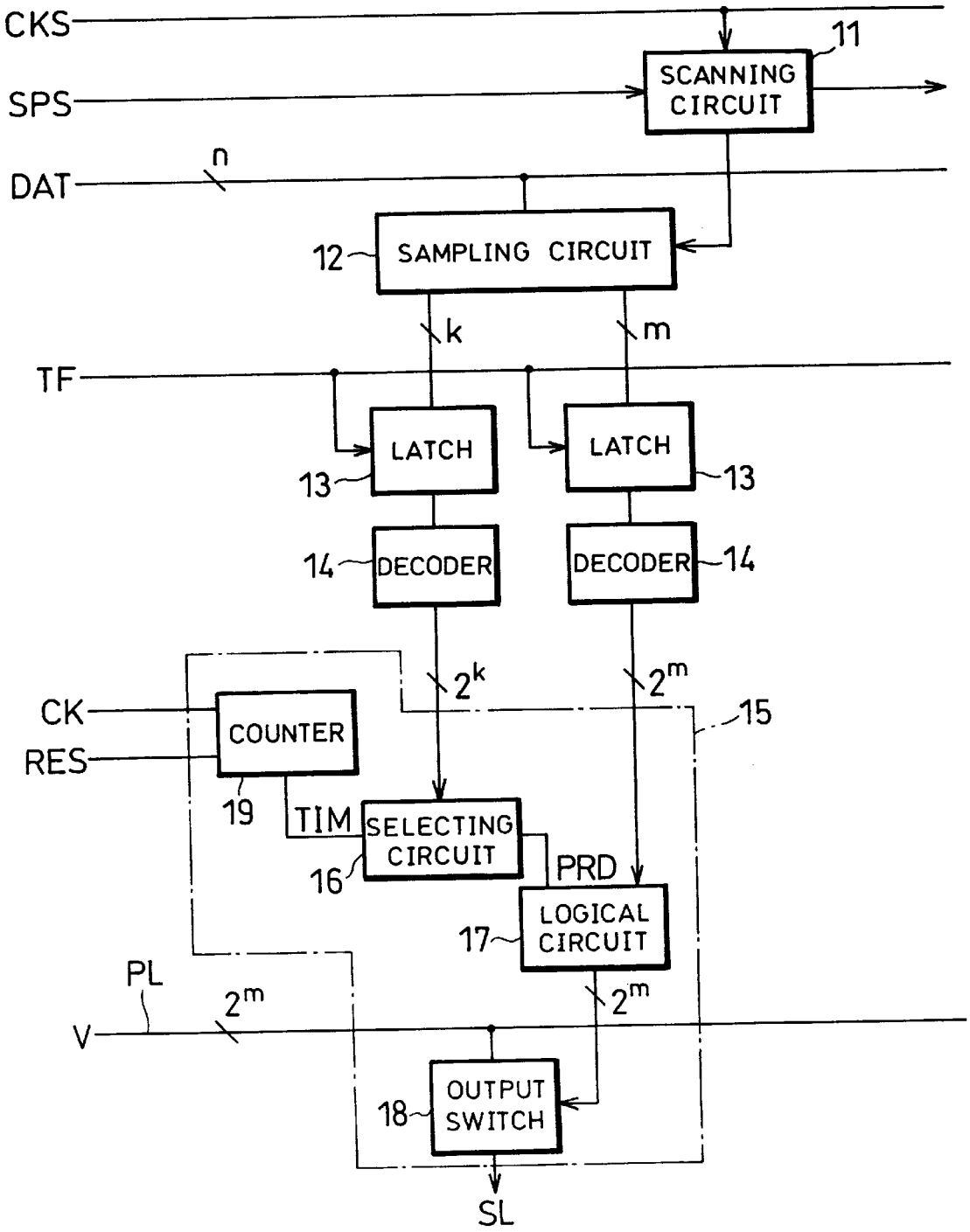
FIG. 14 is a block diagram which shows an arrangement that a counter is added to the first source driver.

Besides the above-mentioned arrangement, as shown in FIG. 14, the selecting circuit 16 may be arranged so as to have a counter 19 on a preceding stage of the selecting circuit 16. In this arrangement, the counter 19 generates the timing signals $TIM_1$ through $TIM_k$ based on the clock CK and the reset signal RES applied to the gradation power source 6 so as to be applied to the selecting circuit 16. Therefore, a signal line for the timing signals $TIM_1$ through $TIM_k$ which is wired to the source driver is not required.

Figure 15:
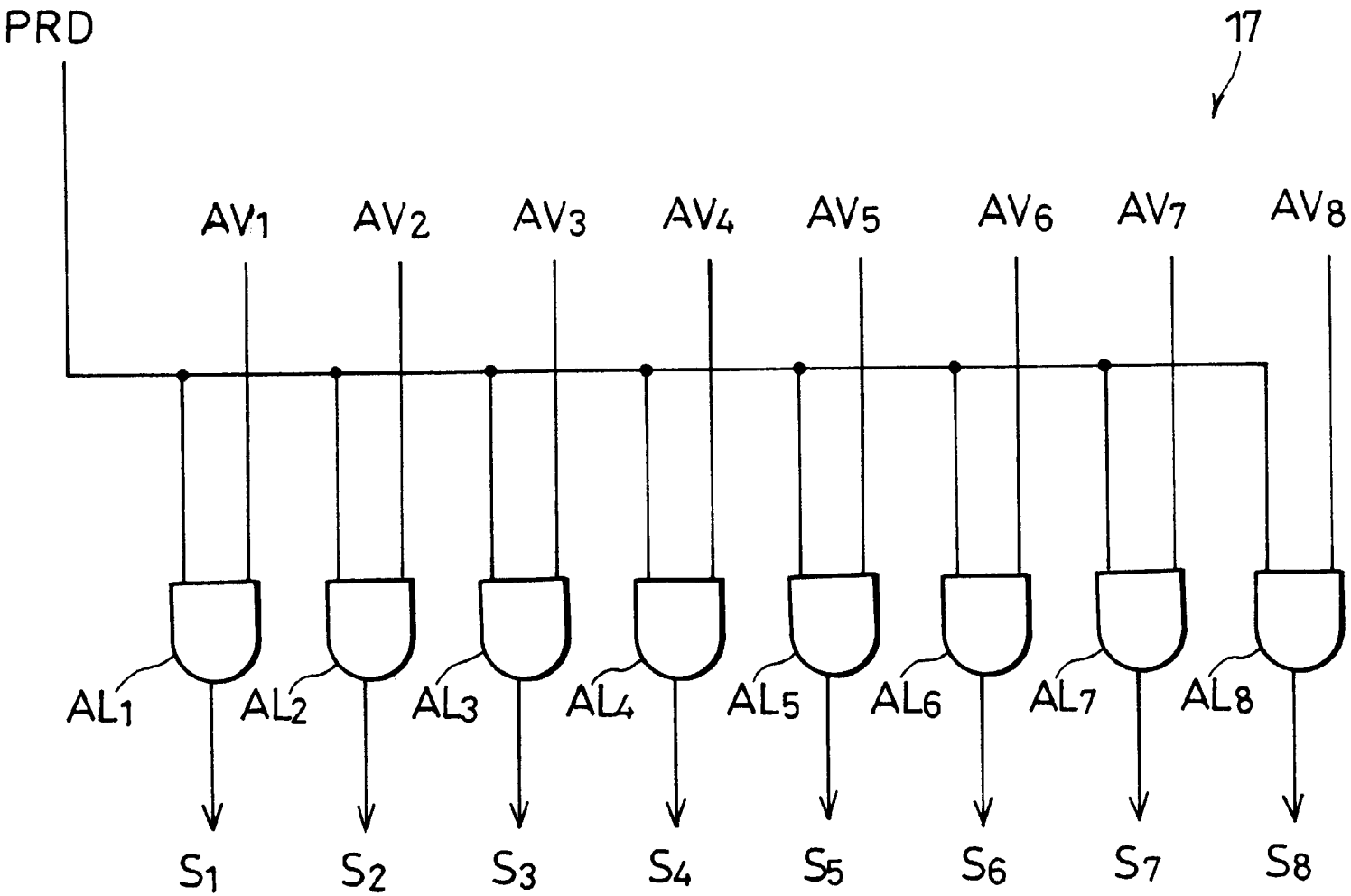
FIG. 15 is a circuit diagram which shows an arrangement of a logical circuit in the first source driver.

The logical circuit 17 as output control means selects one from the $2^m$ gradation power source lines PL based on the period selecting signal PRD. As shown in FIG. 15, for example, the logical circuit 17 is composed of AND circuits $AL_1$ through $AL_8$ which obtain an AND of the period selecting signal PRD and $2^m$(m=3) decoded signals $AV_1$ through $AV_8$ from the other decoder (first decoder) 14.

Figure 16:
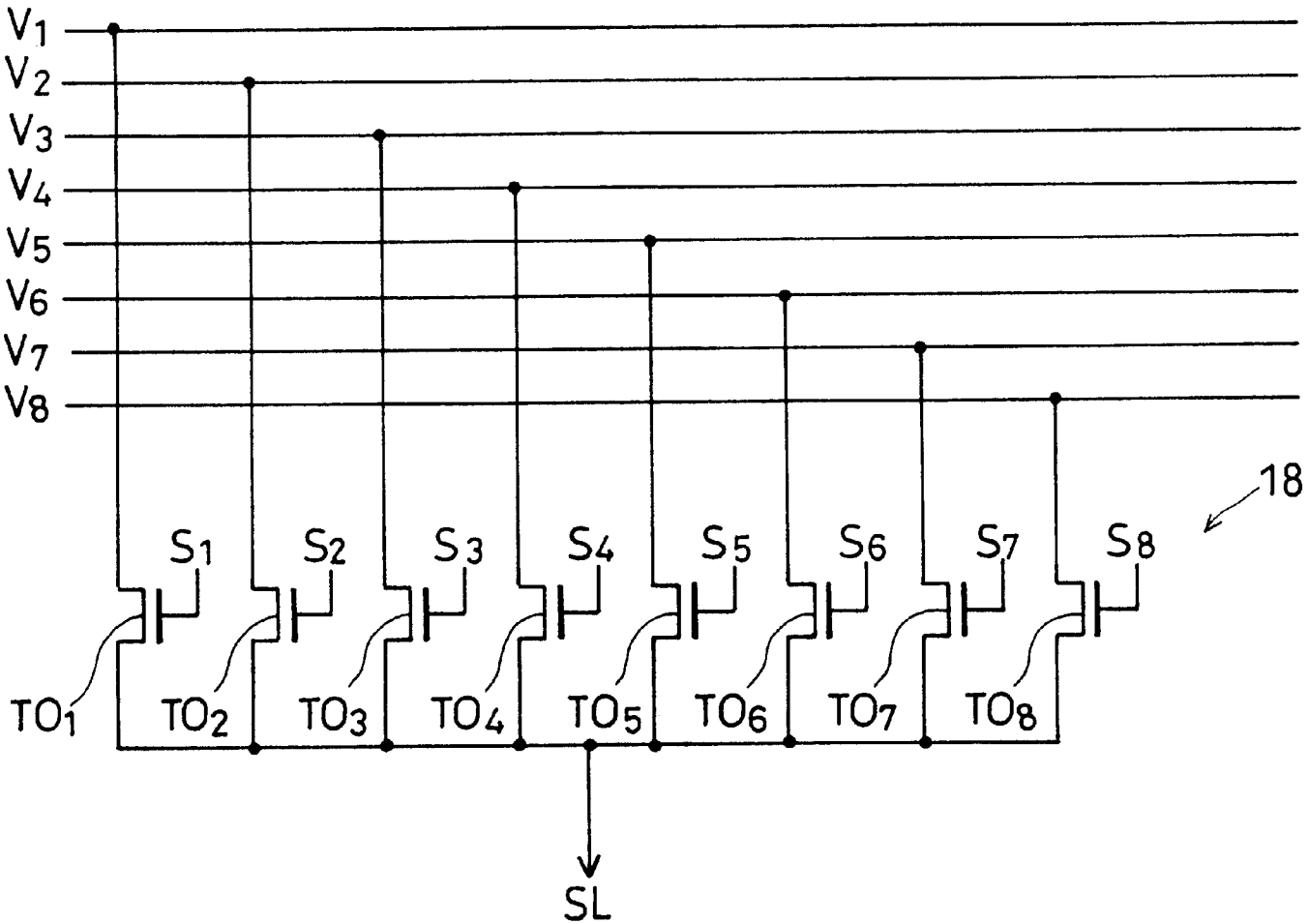
FIG. 16 is a circuit diagram which shows an arrangement of an output switch in the first source driver.

The output switch 18 is composed of a plurality of analog switches. As shown in FIG. 16, the output switch 18 is provided with transistors $TO_1$ through $TO_8$ which are turned on according to writing pulses $S_1$ through $S_8$ (m=3) from the AND circuits $AL_1$ through $AL_8$ of the logical circuit 17. One of the eight gradation voltages $V_1$ through $V_8$ is selected by turning on only one of the transistors $TO_1$ through $TO_8$ so as to be outputted to the source line SL.

Figure 17:
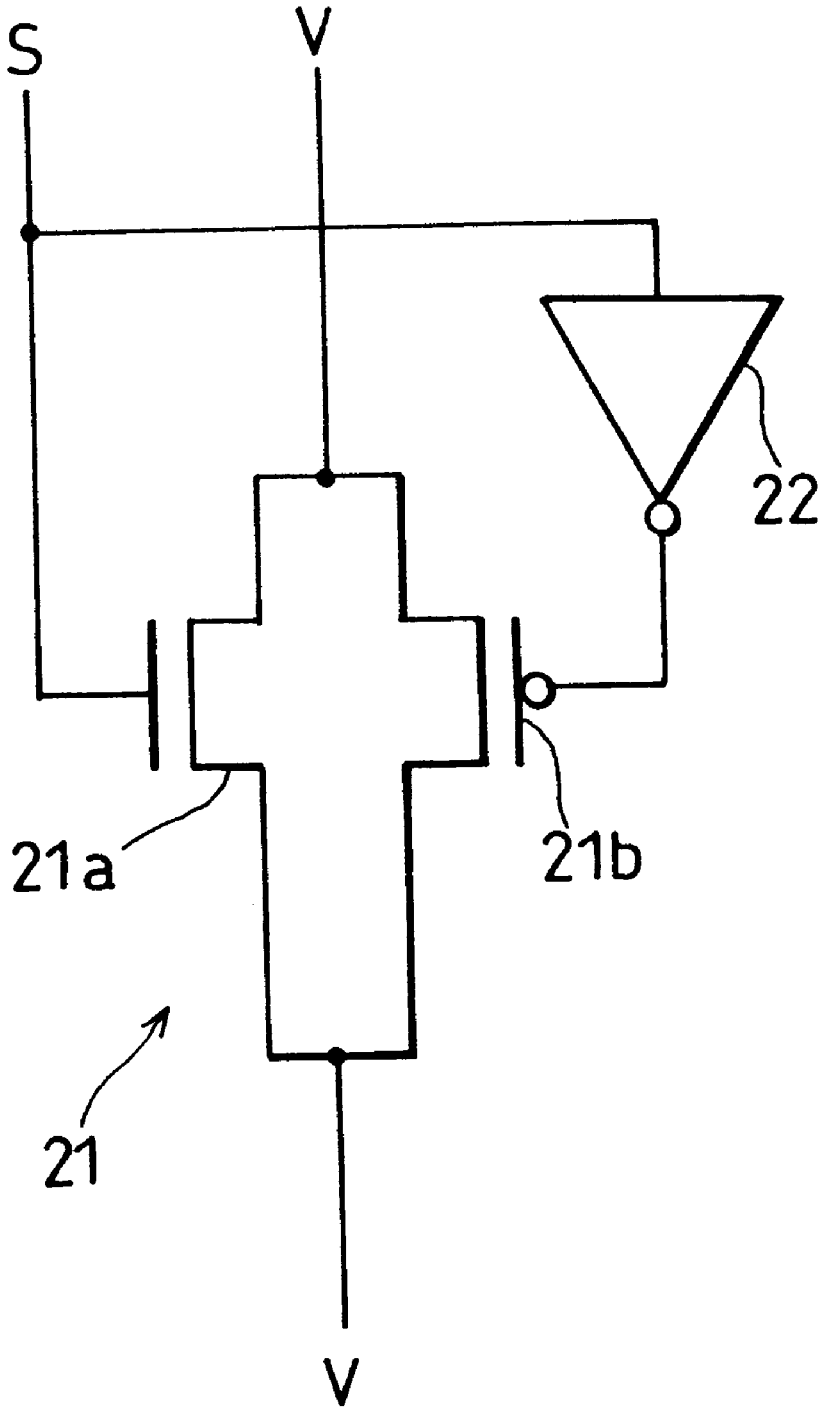
FIG. 17 is a circuit diagram which shows another arrangement of an analog switch composing the output switch.

Besides the above arrangement, the output switch 18 may be arranged so that the transistors $TO_1$ through $TO_8$ are respectively replaced by a transfer gate 21 shown in FIG. 17.

The transfer gate 21 has a CMOS arrangement that an n-channel-type transistor 21*a* is connected to a p-channel-type transistor 21*b* in parallel. In order to operate the transistor 21*b* and the transistor 21*a* at the same time, an inverter 22 for inverting the writing pulse S is required. Such an analog switch makes it possible to lower conduction resistance by using the transfer gate 21 compared with the case where the n-channel-type or p-channel-type transistor is individually used.

Next, the operation of the source driver having the above arrangement is explained.

First, a n-bit digital signal DAT is sampled by the sampling circuit 12 and is retained in synchronization with a sampling signal generated by the scanning circuit 11. The retained n-bit digital signal DAT is divided into m bit and k bit so as to be retained by the latches 13.

The m-bit data and the k-bit data are transferred to the decoders 14 in synchronization with a transfer signal TF during a next horizontal scanning period to a horizontal scanning period sampled by the sampling circuit 12, and they are decoded therein. $2^k$ decoded signals and $2^m$ decoded signals are outputted from the decoders 14 respectively so as to be applied to the selecting output circuit 15.

In the selecting circuit 16, $2^k$ period selecting signals PRD are generated from k-numbered timing signals TIM. Moreover, one of the $2^k$ period selecting signals PRD is selected according to $2^k$ decoded signals from the other latch 13.

Meanwhile, in the logical circuit 17, writing pulses S are generated by the AND of the period selecting signal PRD and the $2^m$-numbered decoded signals outputted from the other latch 13.

When one analog switch in the output switches 18 conducts according to the $2^m$ writing pulses S during a period where the period selecting signal PRD is ON, one of the $2^m$ gradation power source lines PL is selected. As a result, a desired gradation voltage V is outputted to the source line SL during one period of the $2^k$ periods.

At this time, as shown in FIG. 8, a gradation voltage, whose level changes like staircase during each period $T_1$ through $T_{2^k}$ obtained by dividing one horizontal scanning period into $2^k$ periods $T_1$ through $T_{2^k}$, is applied to the 2m gradation power source lines PL. For this reason, by applying an n-bit digital signal, one of the gradation voltages with a level of $2^{m+k}$ ($=2^n$) is outputted.

As mentioned above, since only the $2^m$ gradation power source lines PL and k-numbered timing signal lines are required for outputting a voltage with $2^n$ gradation, a number of external terminals is greatly decreased by using the source driver. Moreover, since the length of the period of writing a gradation voltage is about $1/2^k$ of a horizontal scanning period, graphic data can be sufficiently written, thereby obtaining gradation display with high accuracy.

For example, in the case where a 6-bit digital signal is divided into m=3 bits and k=3 bits, 64 ($=2^6$)-gradation display is possible by 8 (=23) gradation power source lines PL. Furthermore, about 1/8 ($=2^3$) of a horizontal scanning period can be secured as a period of writing a gradation voltage.

In addition, the gradation voltage from the gradation power source line PL is taken in through one transfer gate (analog switch) 21 by providing the transfer gates 21 as the output switches 18. As a result, a conductive resistance between the gradation power source lines PL and the output becomes low, and thus a sufficient writing characteristic can be obtained. As a result, insufficiency of the writing is eliminated, and a size of the analog switch (channel length) can be small. In particular, when the size of the analog switch becomes small, not only a size of circuits is reduced but also noises generated at the time of cutting off the analog switch (depends on a channel capacity) are decreased, thereby improving writing accuracy.

As shown in FIG. 8, in the above source driver, gradation voltages respectively in a range where they are not overlapped are applied to the gradation power source lines PL. A common voltage generating circuit can be used for voltages having approximately equal gradation by applying voltages having such a waveform.

Therefore, occurrence of inversion of voltages having approximately equal gradations among the voltage generating circuits due to an influence of a variation (offset voltage, etc.) of the voltage generating circuit provided to the gradation power source 6 can be prevented. Moreover, since the voltages applied to each gradation power source line PL is approximately the same and is successive during a horizontal scanning period, a charge and discharge current to the gradation power source lies PL can be suppressed, thereby making it possible to reduce power consumption.

Figure 18:
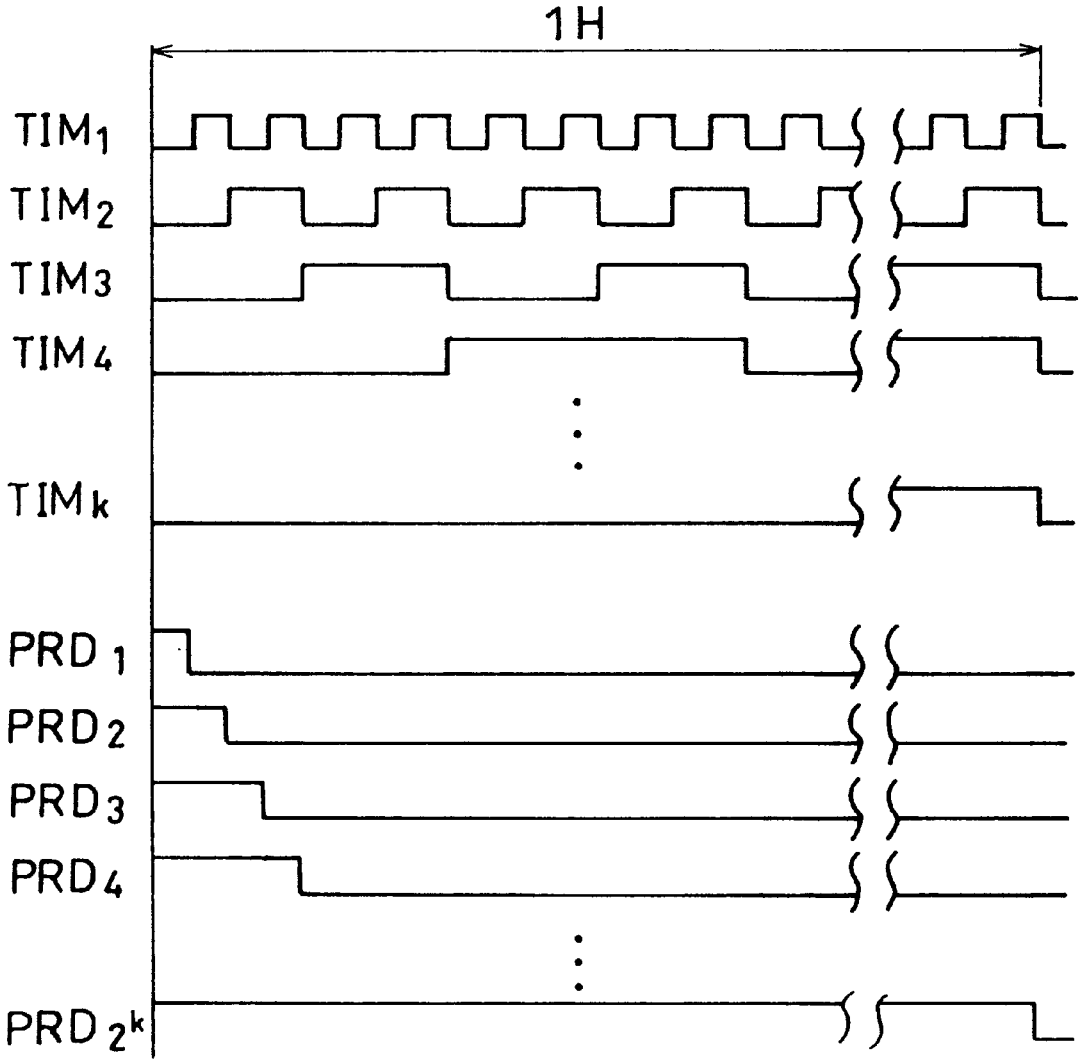
FIG. 18 is a waveform chart which shows waveforms of another input/output signal related to the selecting circuit in the first source driver.

In addition, as shown in FIG. 12, in the source driver, the period selecting signal PRD for controlling a period of writing gradation voltages is a pulse having a length for one period. However, this signal is not limited to this, so as shown in FIG. 18, for example, a control signal PRD having a length for a period from the beginning of the horizontal scanning period to a point in time when a gradation voltage corresponding to desired graphic data is applied may be used. At this time, when a gradation voltage with a higher level, which requires a longer writing time at the output switch 18, is applied later, the writing time is substantially prolonged. For this reason, there is no possibility of occurrence of insufficient graphic data writing, thereby making it possible to control a signal output accurately.

Figure 19:
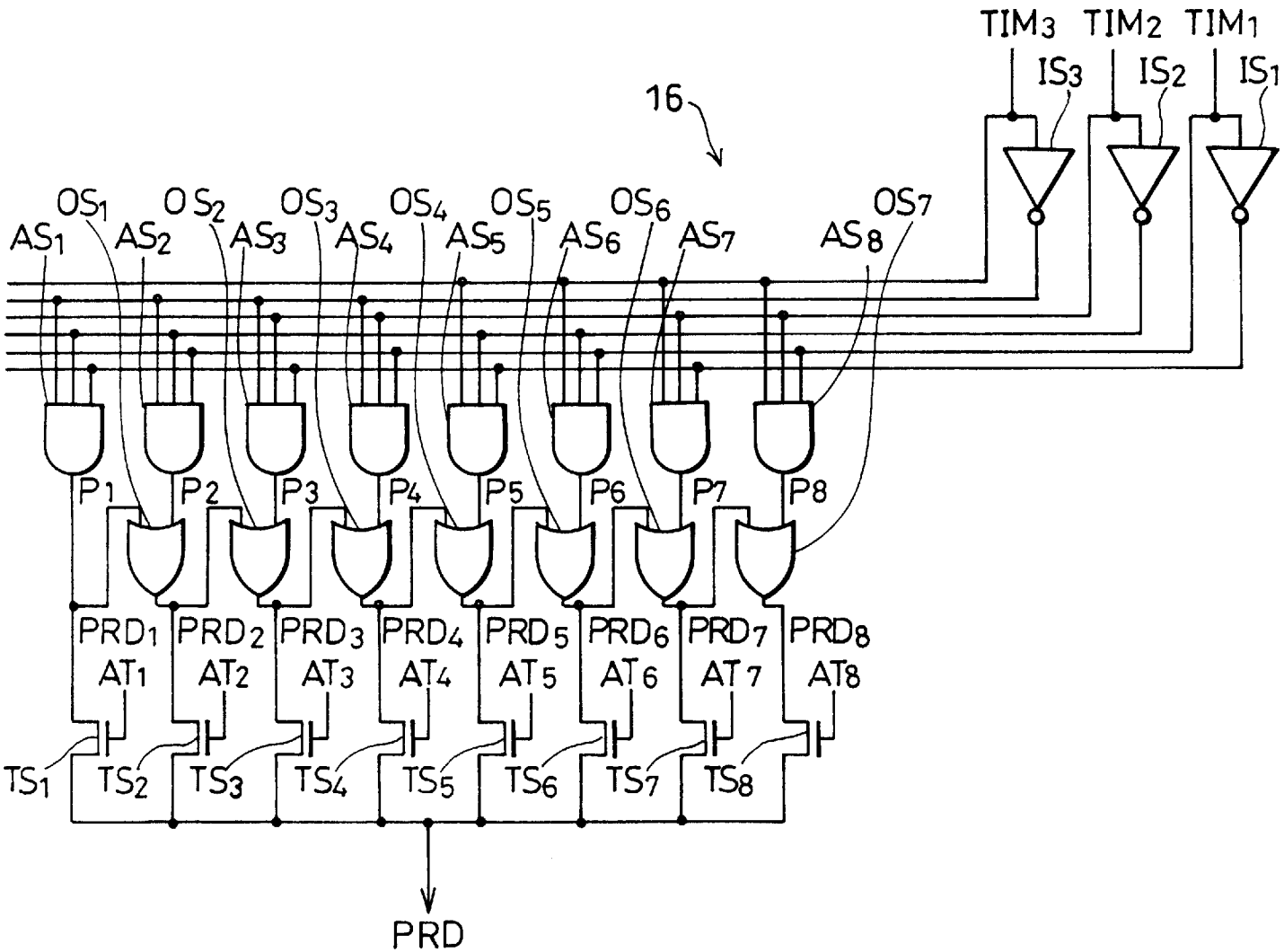
FIG. 19 is a circuit diagram which shows an arrangement of the selecting circuit for generating an output signal having waveforms shown in FIG. 18.
Figure 21:
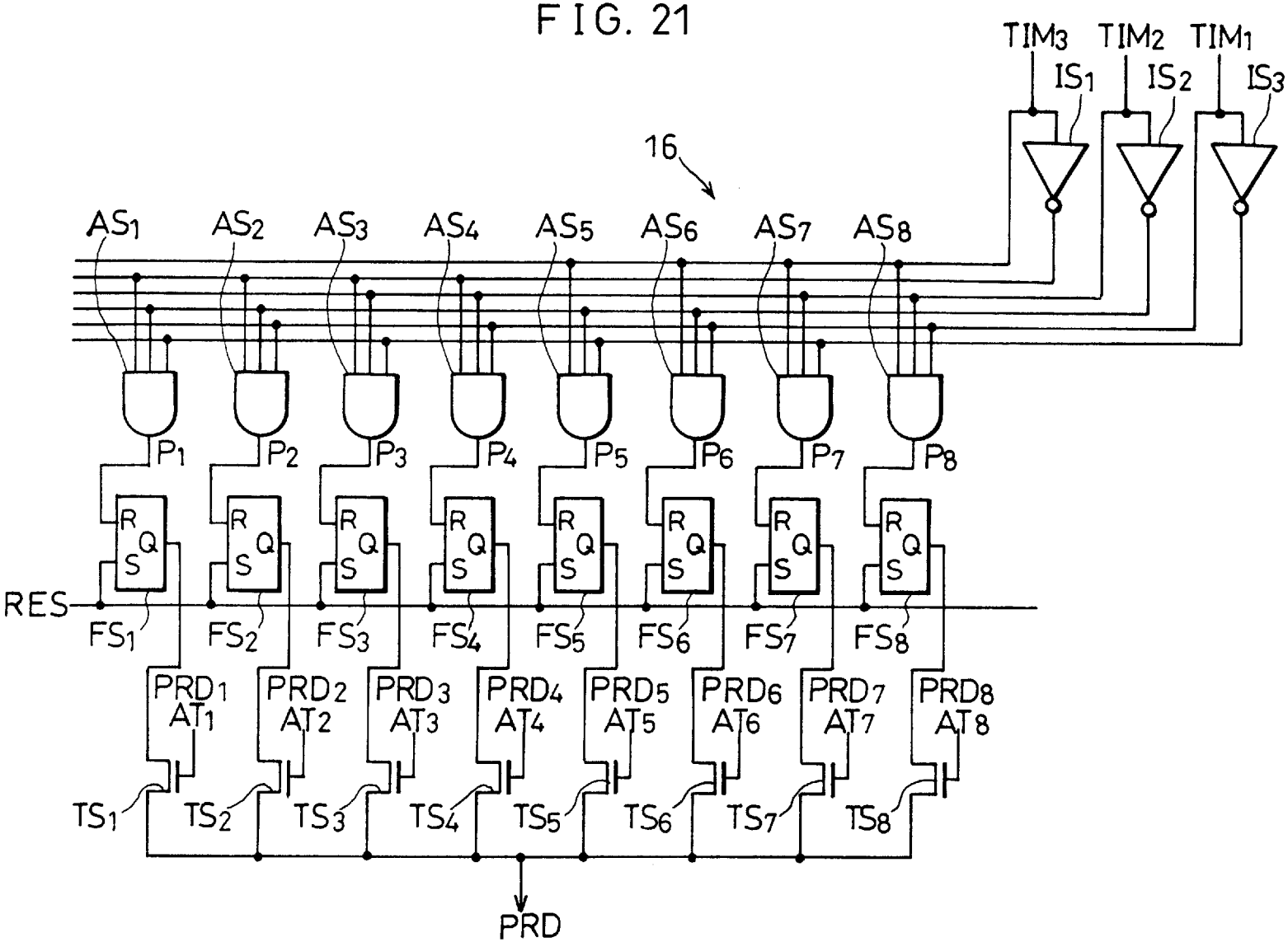
FIG. 21 is a circuit diagram which shows an arrangement of another selecting circuit for generating the output signal having the waveforms shown in FIG. 18.

The selecting circuit 16, for example, shown in FIGS. 19 or 21 is adopted in order to generate the above-mentioned period selecting signal PRD. The selecting circuit 16 described below has an arrangement in the case of k=3.

Similarly to the selecting circuit 16 shown in FIG. 13, the selecting circuit 16 shown in FIG. 19 is provided with inverters $IS_1$ through $IS_3$, AND circuits $AS_1$ through $AS_8$ and transistors $TS_1$ through $TS_8$. Moreover, the selecting circuit 16 shown in FIG. 19 is provided with OR circuits $OS_1$ through $OS_7$ between the AND circuits $AS_1$ through $AS_8$ and transistors $TS_1$ through $TS_8$. The OR circuits $OS_1$ through $OS_7$ obtain logical OR of an output signal from a corresponding AND circuit and an output signal from the adjacent AND circuit.

Figure 20:
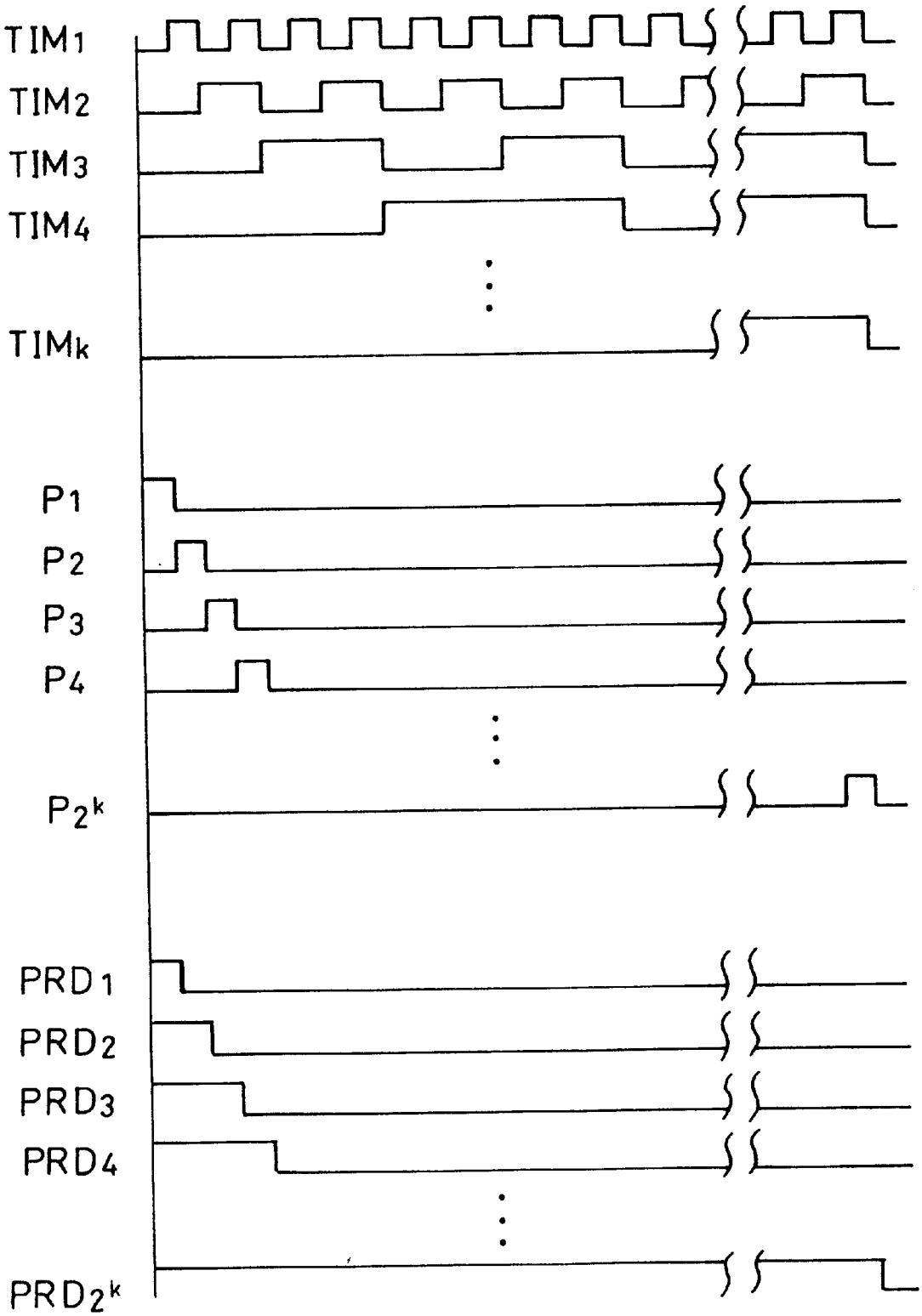
FIG. 20 is a timing chart which shows an operation of the selecting circuit in FIG. 19.

In such an arrangement, as shown in FIG. 20, signals $P_1$ through $P_8$ are outputted from AND circuits $AS_1$ through $AS_8$. The logical ORs of the signals $P_1$ through $P_7$ and the signals $P_2$ through $P_8$ are obtained by the OR circuits $OS_1$ through $OS_7$, and thus the period selecting signal PRD in which the period successively becomes longer is obtained.

Figure 22:
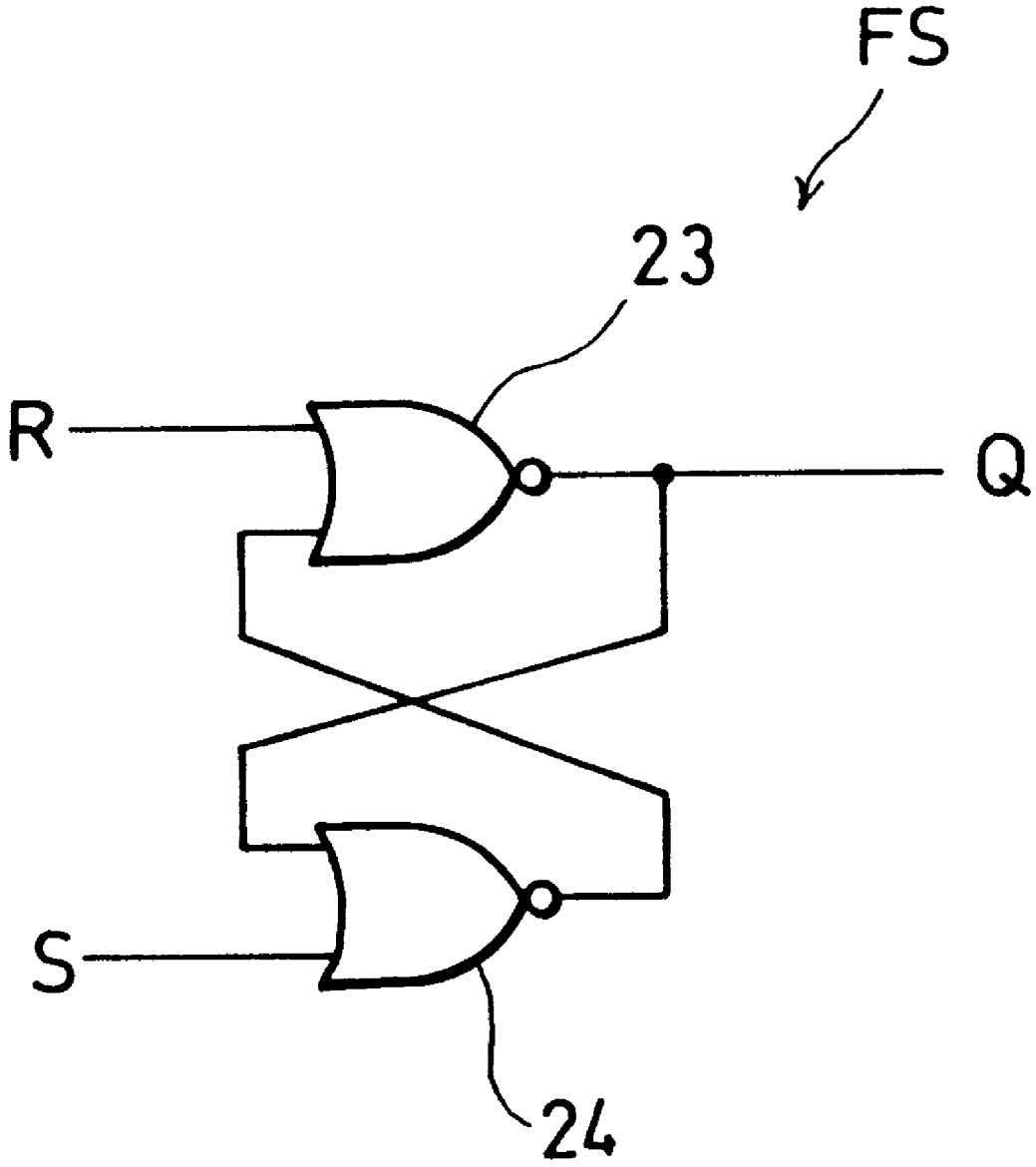
FIG. 22 is a circuit diagram which shows an arrangement of a flip flop in the selecting circuit shown in FIG. 21.

The selecting circuit 16 shown in FIG. 21 is provided with flip flops $FS_1$ through $FS_8$ which are respectively connected to the AND circuits $AS_1$ through $AS_8$, instead of the OR circuits $OS_1$ through $OS_7$ in the selecting circuit shown in FIG. 19. As shown in FIG. 22, the flip flop FS is an SR-type flip flop, and it is arranged so that NOR circuits 23 and 24 are cross-connected. Moreover, a reset signal RES is applied from the gradation power source 6 to an set input S in the flip flops $FS_1$ through $FS_8$.

Figure 23:
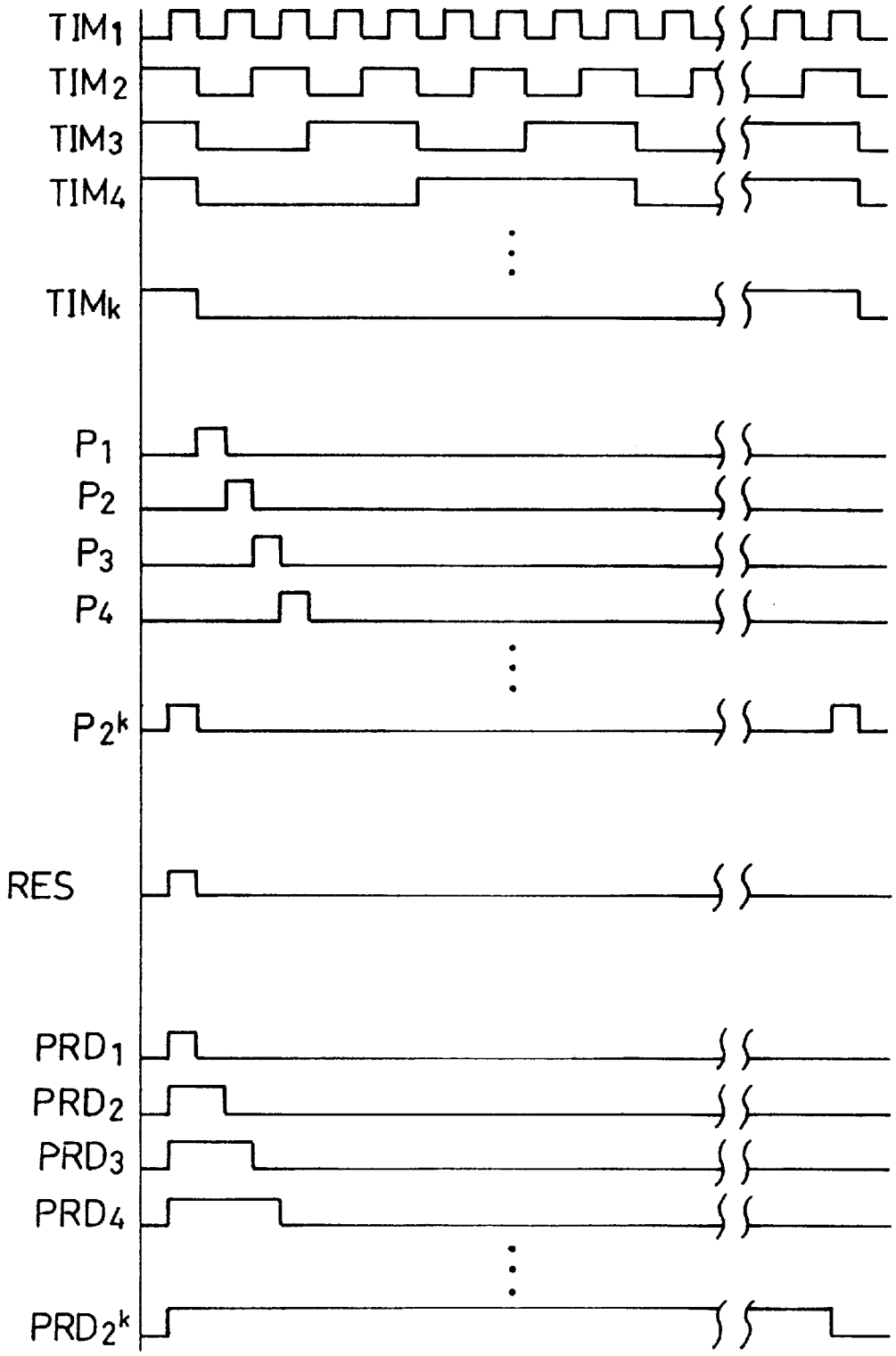
FIG. 23 is a timing chart which shows an operation of the selecting circuit shown in FIG. 21.

In such an arrangement, as shown in FIG. 23, signals $P_1$ through $P_8$ are outputted from the AND circuits $AS_1$ through $AS_8$ by using timing signals $TIM_1$ through $TIM_3$ which are different from the timing signals $TIM_1$ through $TIM_3$ shown in FIG. 20. The flip flops $FS_1$ through $FS_8$ outputs a period selecting signal PRD whose period successively becomes longer by applying the signals P1 through $P_8$ to a reset input R.

In the arrangement shown in FIG. 1, $2^k$ period selecting signals PRD are generated from k-numbered timing signals TIM by the logical operation, but period selecting signals PRD are not necessarily limited to the above ones, so $2^k$ period selecting signals PRD may be directly inputted from the outside. This arrangement has an advantage such that the circuit configuration in the source driver becomes simple even if a number of external input signal lines are increased.

In addition, on the contrary, by providing the counter 19 to the source driver as shown in FIG. 14, it is also possible to generate k-numbered timing signals TIM based upon a clock CK inputted to the gradation power source 6. In this case, a number of the external input signal lines is further decreased.

Furthermore, in the source driver, the digital signal as a video signal is taken in from n-numbered video signal lines in synchronization with a sampling signal outputted from the scanning circuit 11, but the digital signal may be scanned so as to taken in per one horizontal scanning period.

Figure 24:
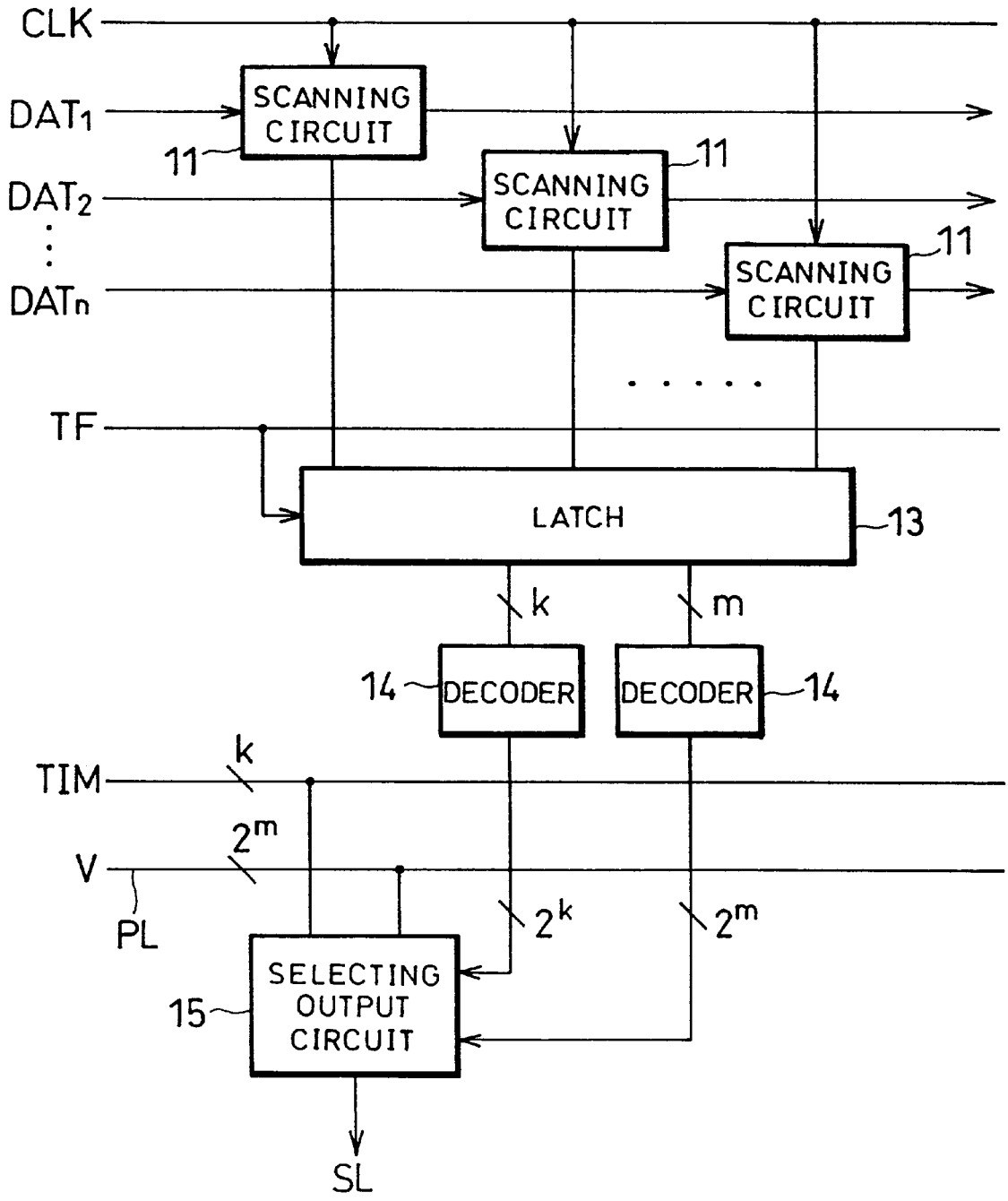
FIG. 24 is a block diagram which shows another arrangement of the first source driver.

In order to realize this, the arrangement shown in FIG. 24 is adopted. In this arrangement, n-numbered scanning circuits 11 are provided accordingly to the n-bit digital signal, and the respective scanning circuits 11 directly sample the bit signals $D_1$ through $D_n$ of a video signal. Therefore, in this source driver, the sampling circuit 12 in the source driver shown in FIG. 1 is not required.

In the above source driver, a number of the gradation power source lines and the period selecting signals PRD was the power of 2. This is efficient because the digital signal is represented by a binary number. However, according to a relationship between a function and a number of the external control circuit 4 which divides and expands a video signal, it is occasionally preferable that a number of the gradation power source lines is 3 or 5. Therefore, a number of the gradation power source lines and the period selecting signals PRD is not necessarily the square of 2, so any number is acceptable.

Figure 25:
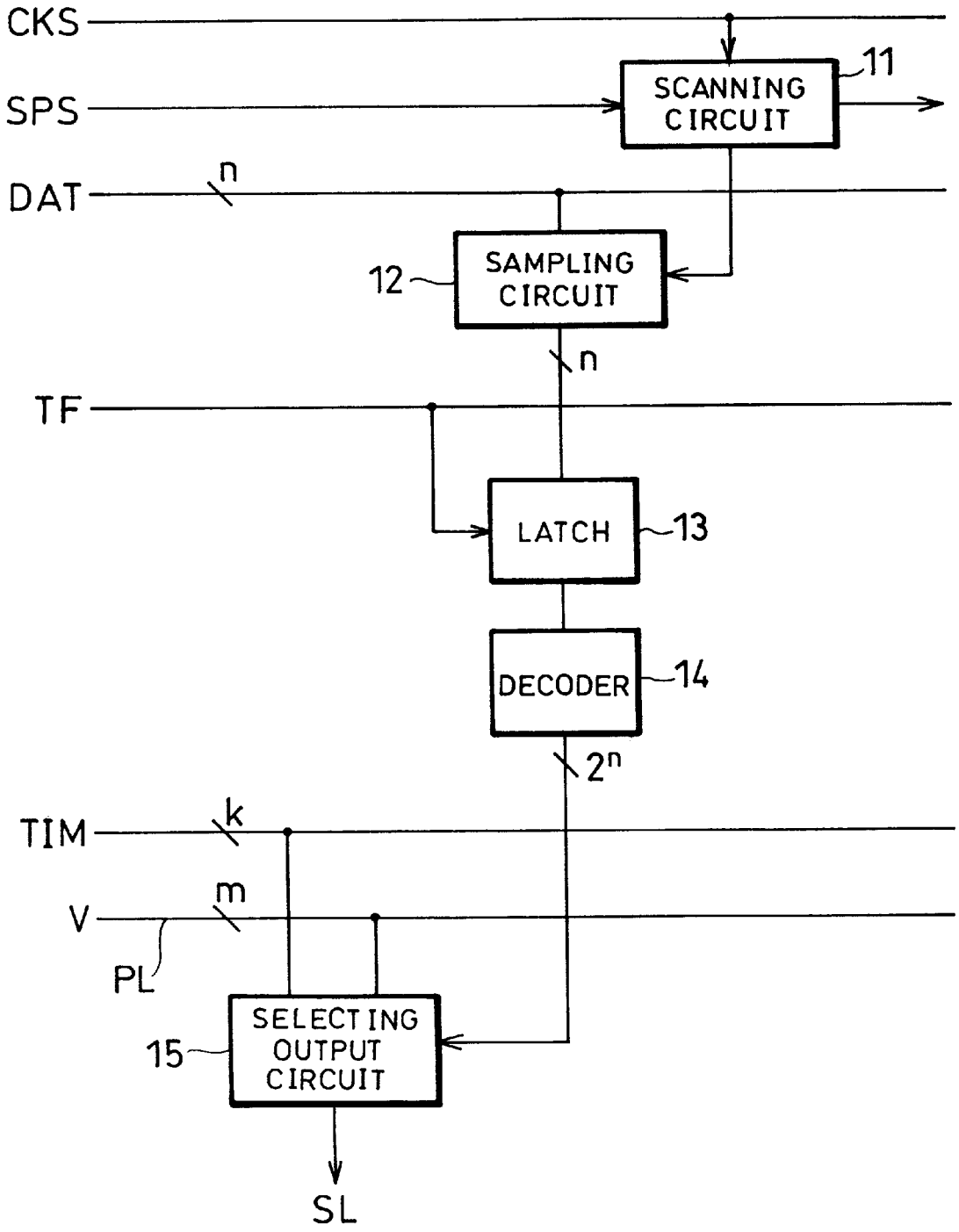
FIG. 25 is a block diagram which shows still another arrangement of the first source driver.
Figure 26:
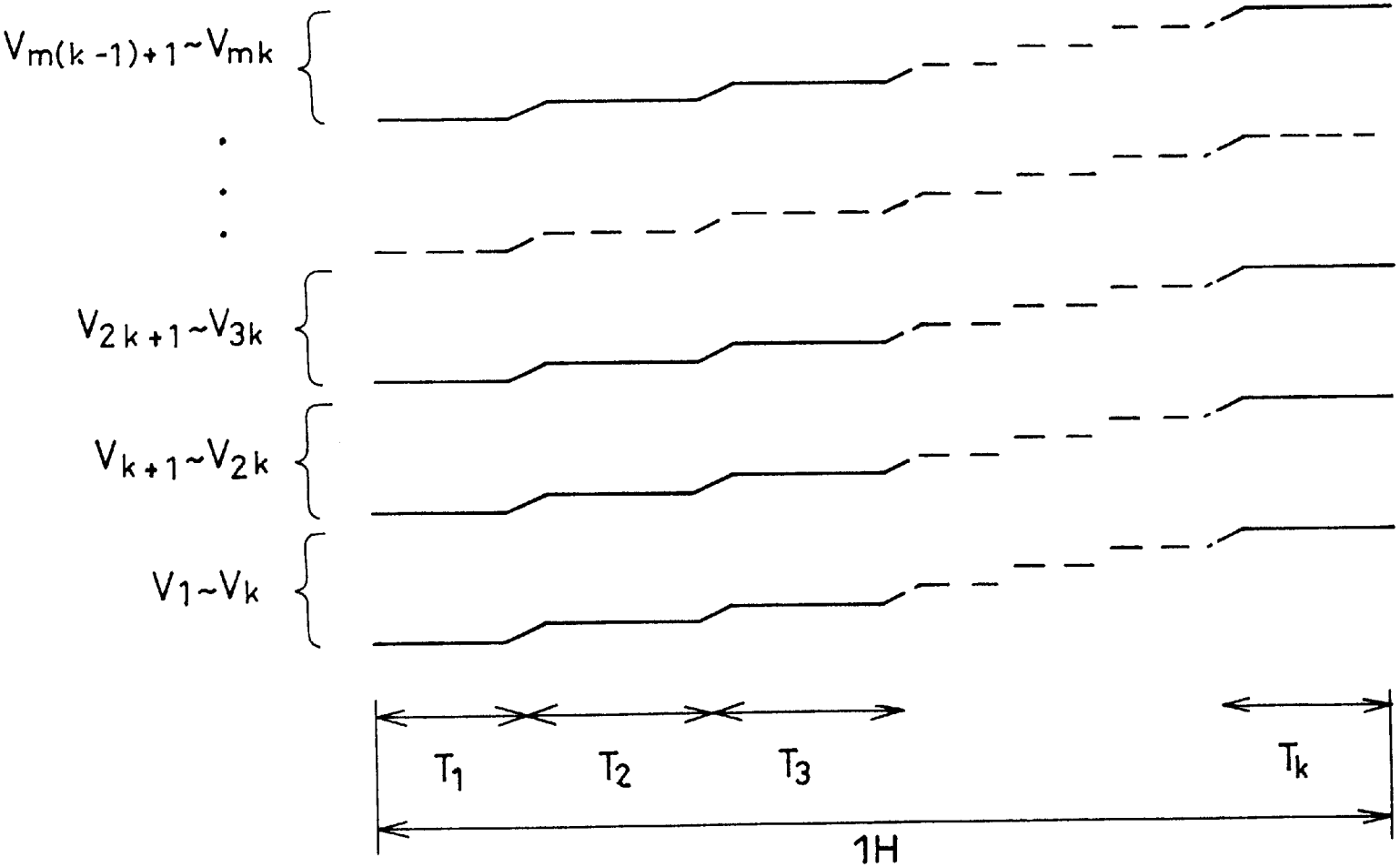
FIG. 26 is a waveform chart which shows waveforms of a staircase gradation voltage to be applied to the source driver shown in FIG. 25.

For example, the source driver shown in FIG. 25 is arranged so that r-numbered gradation power source lines PL and k-numbered timing signals TIM (=period selecting signals PRD) are provided to an n-bit digital signal, and k, m and n fulfill the relationship "$2^n \leqq m * k$". Moreover, the gradation voltage having a waveform shown in FIG. 26 is inputted to each of the gradation power source lines PL. This gradation voltage has such a waveform that the level successively rises like staircase during k-numbered periods $T_1$ through $T_k$ which obtained by uniformly dividing the horizontal scanning period as shown by $V_1$ through $V_k$ (first gradation power source line PL).

In this source driver, the n-bit digital signal sampled by the sampling circuit 12 is retained by the latch 13, and decoded by the decoder 14. Then, in the selecting output circuit 15, one gradation power source line PL and one period are selected based upon the $2^n$ decoded signals from the decoder 14 and the timing signals TIM. As a result, a selected voltage is outputted to the source line.

For example, in the case of n=5, m=5 and k=7, in the selecting output circuit 15, one of the period selecting signals $PRD_1$ through $PRD_7$ corresponding to the periods $T_1$ through $T_7$ is selected by using seven decoded signals in the 32 (=25) decoded signals by the selecting circuit 16. Then, by using 32 writing pulses S outputted from the logical circuit 17 based upon the seven decoded signals, a voltage is outputted only for one period from one of the five gradation power source lines PL by the output switch 18. As a result, the voltages with different 35 levels can be obtained. However, in the case of 32-gradation display, voltages for 3 scales is not used.

The above-mentioned modification in the source driver are not only applicable to the above source driver but also the following source drivers.

Figure 27:
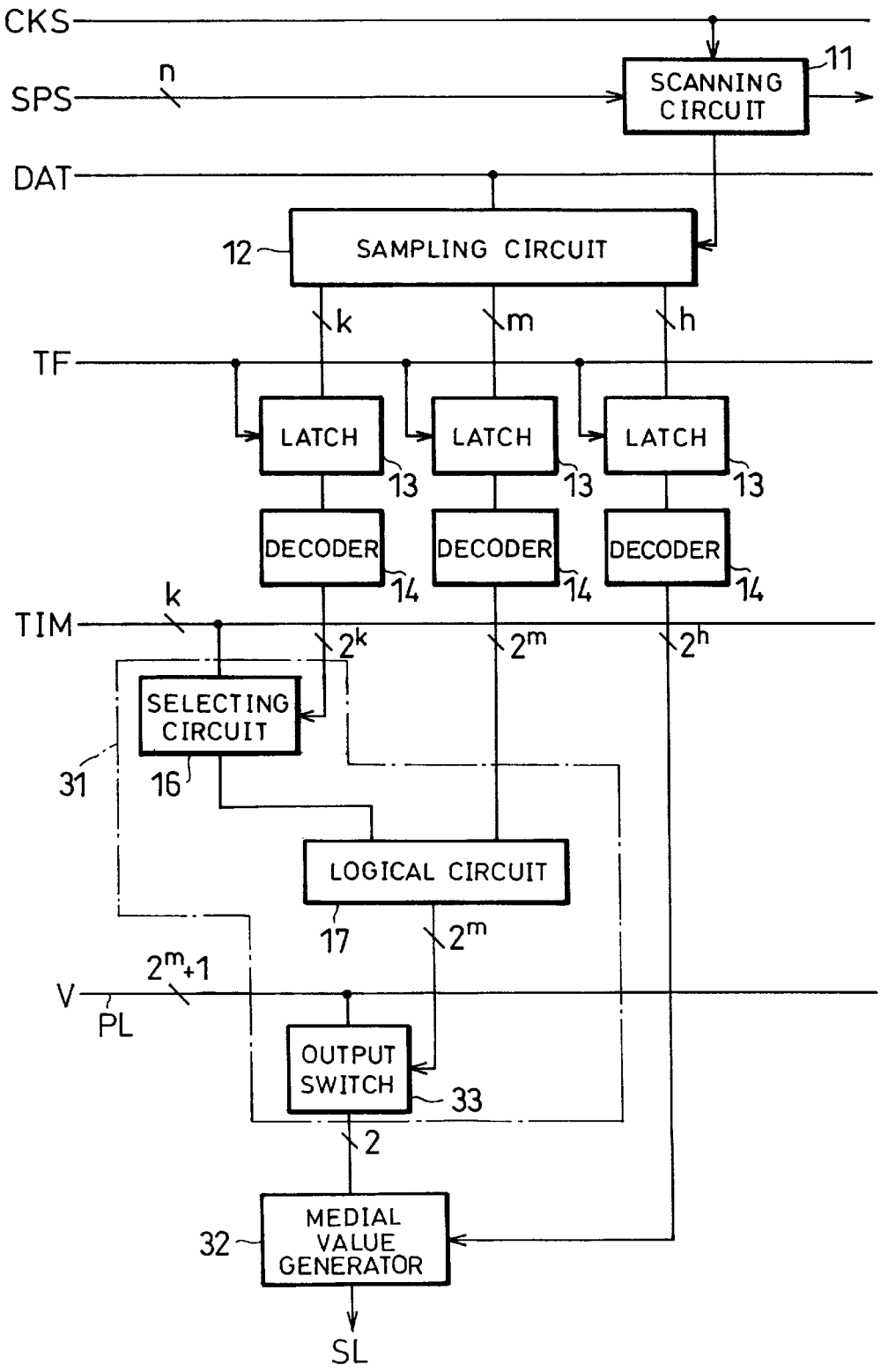
FIG. 27 is a block diagram which shows an arrangement of a second source driver in the liquid crystal display device.

As shown in FIG. 27, a second source driver includes a scanning circuit 11, a sampling circuit 12, latches 13, decoders 14, a selecting output circuit 31 and a medial value generator 32.

Here, those members of the source driver that have the same arrangement and functions as the first source driver are indicated by the same reference numerals and the description thereof is omitted.

In this source driver, n-bit digital signals DAT sampled by the sampling circuit 12 are divided into k-bit data, m-bit data and h-bit data so as to be processed. For this reason, the three latches 13 and three decoders 14 are provided.

The selecting output circuit 31 selects a level for one specified period in two gradation voltages of plural gradation voltages based upon decoded signals from the first and the second decoders 14.

Figure 28:
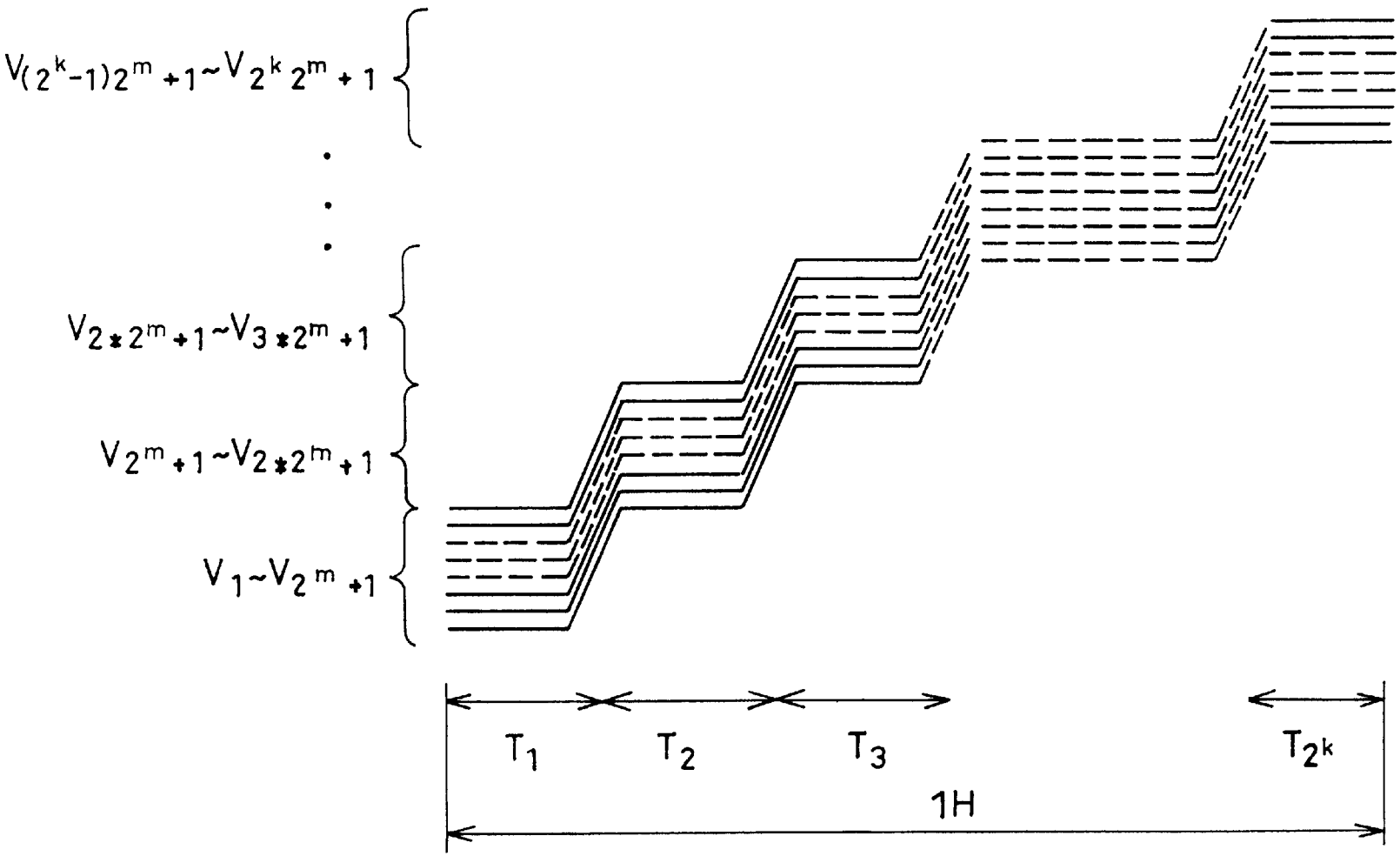
FIG. 28 is a waveform chart which shows waveforms of a staircase gradation voltage to be applied to the second source driver.

As shown in FIG. 28, the gradation voltages have waveforms which are similar to the gradation voltage shown in FIG. 10, but the gradation voltages shown in FIG. 28 are applied to $2^m+1$ gradation power source lines PL. Moreover, it is an different point from the gradation voltages shown in FIG. 10 that maximum voltages in each period and minimum voltages in next periods are set so as to have the same level.

The selecting output circuit 31 is composed of the selecting circuit 16, the logical circuit 17 and the output switch 33.

Figure 29:
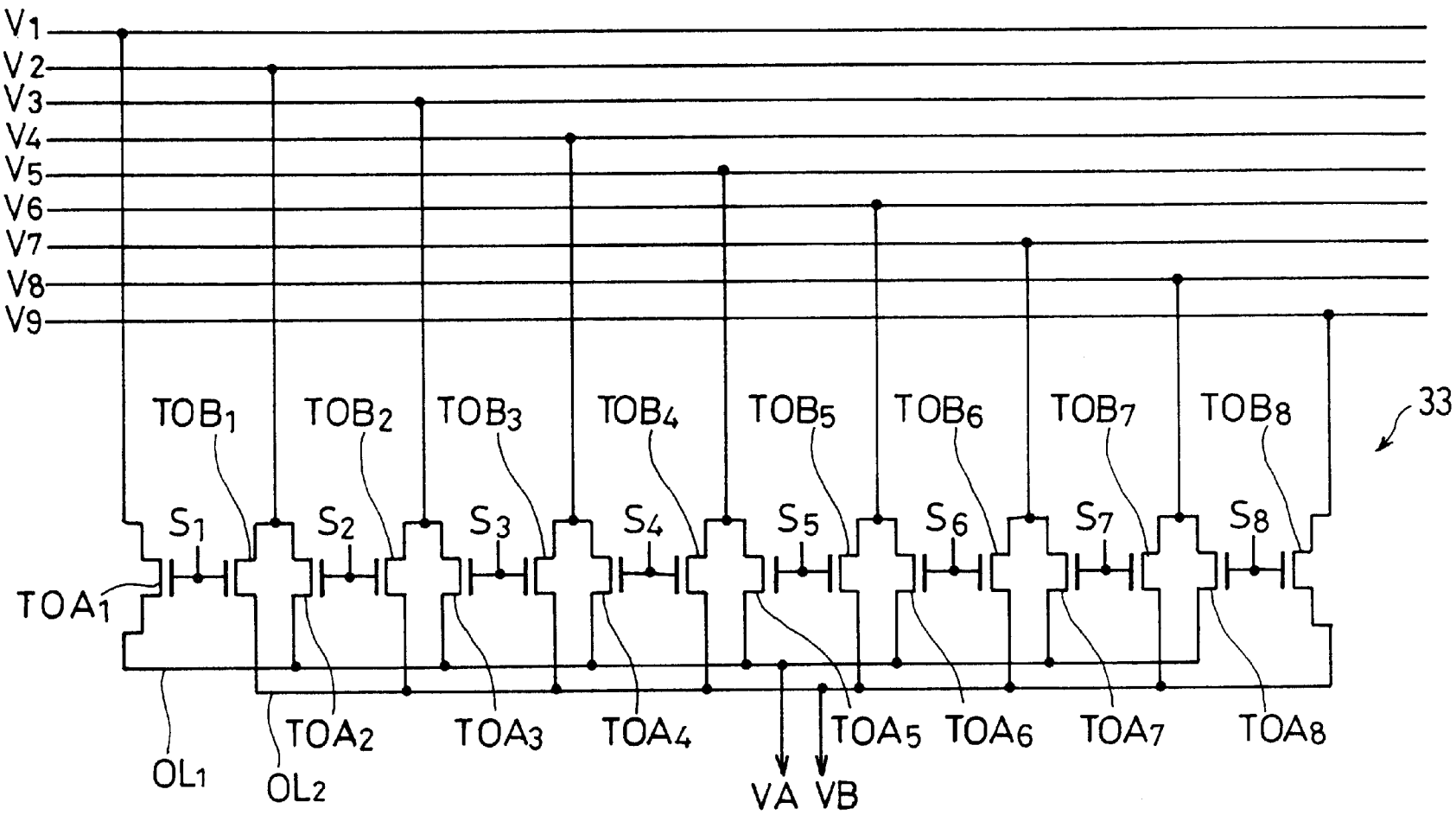
FIG. 29 is a circuit diagram which shows an arrangement of an output switch in the second source driver.
Figure 30:
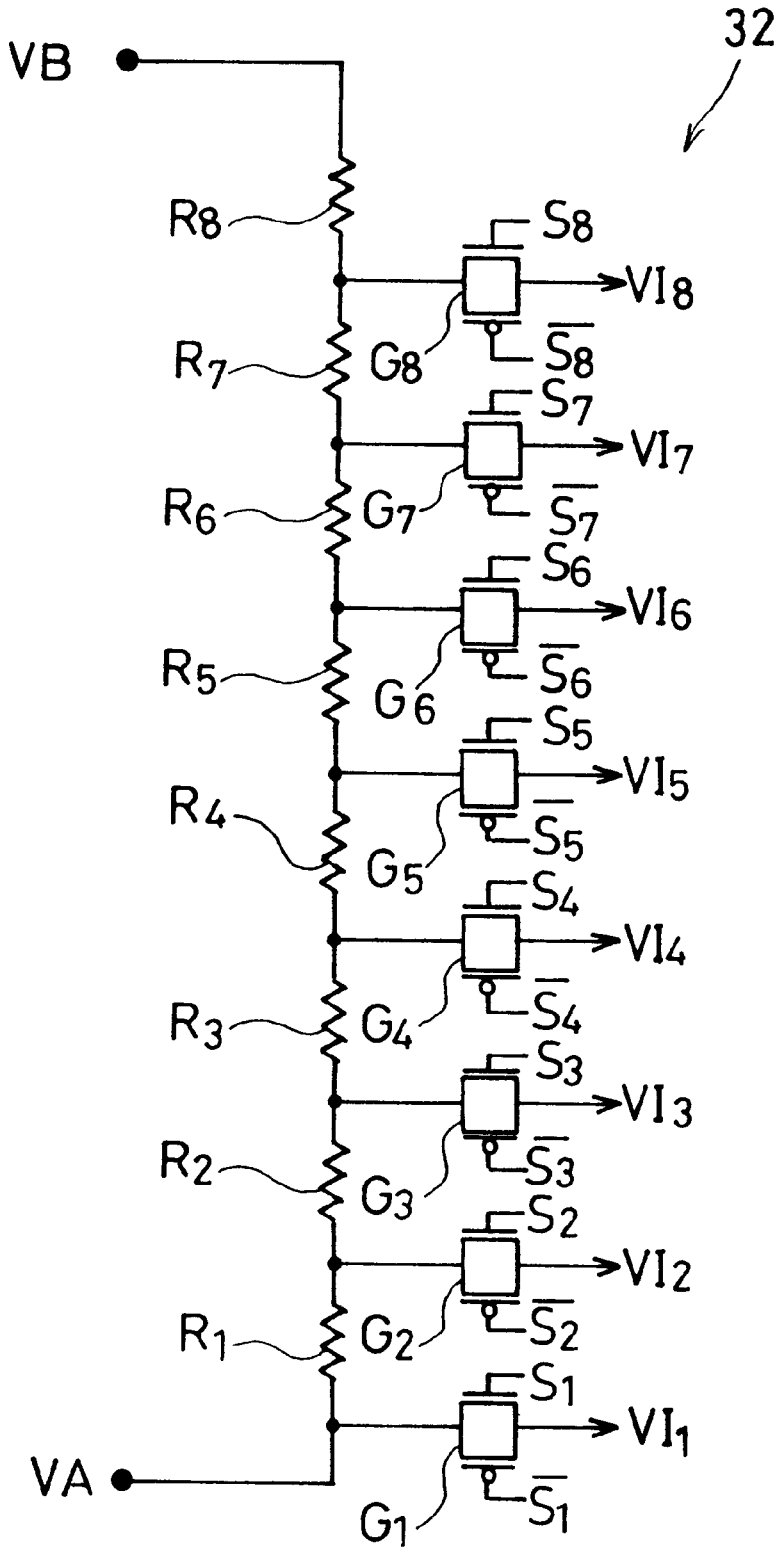
FIG. 30 is a circuit diagram which shows an arrangement of a medial value generator in the second source driver.
Figure 31:
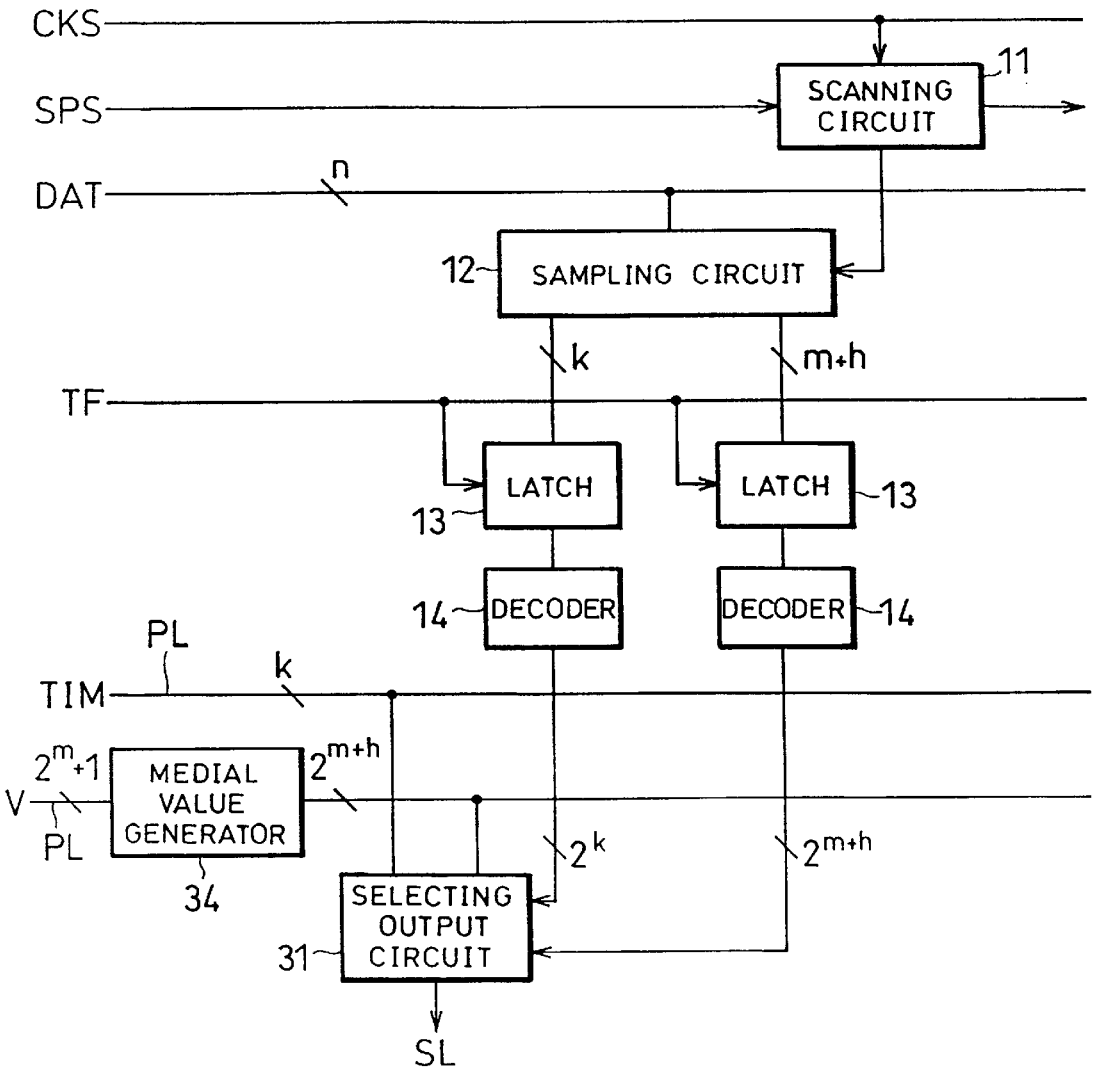
FIG. 31 is a block diagram which shows another arrangement of the second source driver.

As shown in FIG. 29, the output switch 33 includes transistors $TOA_1$ through $TOA_8$ and transistors $TOB_1$ through $TOB_8$, and it outputs two voltages VA and VB based upon $2^m$ writing pulses S from the logical circuit 17. Moreover, the output switch 33 may have an arrangement that the transistors $TOA_1$ through $TOA_8$ and the transistors $TOB_1$ through $TOB_8$ shown in FIG. 29 are replaced by transfer gates 21 shown in FIG. 17.

The transistors $TOA_1$ through $TOA_8$ are connected to a common output line $OL_1$, and the transistors $TOB_1$ through $TOB_8$ are connected to a common output line $OL_2$ which is different from the common output line $OL_1$ for the transistors $TOA_1$ through $TOA_8$. Moreover, transistors $TOA_1$ and $TOB_1$ through the transistors $TOA_8$ and $TOB_8$ are respectively make a pair, and the same writing pulses S ($S_1$ through $S_8$) are inputted to each paired gates. Furthermore, the gradation power source lines PL which are adjacent one another are connected to the paired transistors $TOA_1$ and $TOB_1$ through $TOA_8$ and $TOB_8$ respectively.

The medial value generator 32 is a circuit which outputs a plurality of medial values between the voltages VA and VB by using $2^h$ decoded signals from the third decoder 14. The medial value generator 32 shown in FIG. 30 has an arrangement in the case of h=3, and it is composed of resistors $R_1$ through $R_8$ connected in series and transfer gates $G_1$ through $G_8$.

In the transfer gates $G_1$ through $G_8$, the writing pulses $S_1$ through $S_8$ from the logical circuit 17 are applied to the n-channel type transistor, and inverted pulses of the writing pulses $S_1$ through $S_8$ are applied to the p-channel type transistor. Moreover, the transfer gate $G_1$ is connected to one end of the resistor $R_1$, and the transfer gates $G_2$ through $G_8$ are respectively connected to nodes of the transistors $R_1$ through $R_8$.

The medial value generator 32 may be arranged by another circuit as long as it can output voltages corresponding to plural medial values from the voltages VA and VB.

The following explains the operation of the source driver having the above arrangement.

First, in the sampling circuit 12, n-bit digital signal DAT which is video information is sampled and retained in synchronization with a sampling signal generated by the scanning circuit 11. The retained n-bit digital signal DAT is divided into m-bit data, k-bit data and h-bit data, and they are retained by the three latches 13.

The m-bit data and the k-bit data are transferred to the two decoders 14 in synchronization with the transfer signal TF for a horizontal scanning period next to the horizontal scanning period of sampling in the sampling circuit 12, and they are decoded by the decoders 14. $2^m$ decoded signals and $2^k$ decoded signals are outputted respectively from the first and second decoders 14 so as to be supplied to the selecting output circuit 31.

The operations of the selecting circuit 16 and the logical circuit 17 in the selecting output circuit 31 are the same as in the first source driver. Namely, one of the $2^k$ period selecting signals PRD is selected by the selecting circuit 16, whereas in the logical circuit 17, writing pulses S is created from the period selecting signals PRD and that $2^m$ decoded signals.

When the two transistors of the output switch 33 is conducting only for an ON period of the period selecting signal PRD by using the $2^m$ writing pulses S, two of the $2^m$+1 gradation power source lines PL are selected.

At this time, gradation voltages, which are generated simultaneously for the periods obtained by dividing one horizontal scanning period into $2^k$ periods $T_1$ through $T_{2^k}$, as shown in FIG. 28, and are changed like staircase for each period $T_1$ through $T_{2^k}$, are applied to the $2^m$+1 gradation power source lines PL. Therefore, by applying an n-bit digital signal, two voltages VA and VB with 2 levels which are adjacent to each other of $2^{m+k}$ levels are outputted.

In addition, $2^h$ decoded signals, which are obtained by further decoding h-bit digital signals by a third decoder 14, are applied to the medial value generator 32. In the medial value generator 32, when one of the transfer gates $G_1$ through $G_8$ is turned on by the decoded signals, an arbitrary medial value between the two voltages VA and VB is selected so as to be outputted as a desired gradation signal to the source line SL through the transfer gate G.

As mentioned above, with the above source driver, since the $2^m$+1 gradation power source lines PL and the k-numbered timing signal lines are required in order to output a voltage with $2^n$ gradation, a number of external terminals is greatly decreased. Moreover, since the period of writing the gradation voltage is about $1/2^k$ of the horizontal scanning period, video data can be sufficiently written, and the gradation display with high accuracy can be obtained.

Furthermore, since the maximum voltage of the gradation voltages in each period and the minimum voltages in the next periods are set so as to have the same level, a medial value, which is obtained by dividing a potential difference between the voltages VA and VB at an equal interval, can be obtained. Therefore, compared with the above-mentioned first source driver, a signal voltage with further multi-gradation ($2^h$ times) can be outputted also by the approximately same number of external inputted signals. For example, if the digital signal is 6 bits and the relationship: "m=k=h=2" is fulfilled, 64 (=$2^6$) gradation display becomes possible by the five gradation power source lines PL. Moreover, when m=3, k=3 and h=2, 256-gradation display becomes possible by nine gradation power source lines PL.

Figure 32:
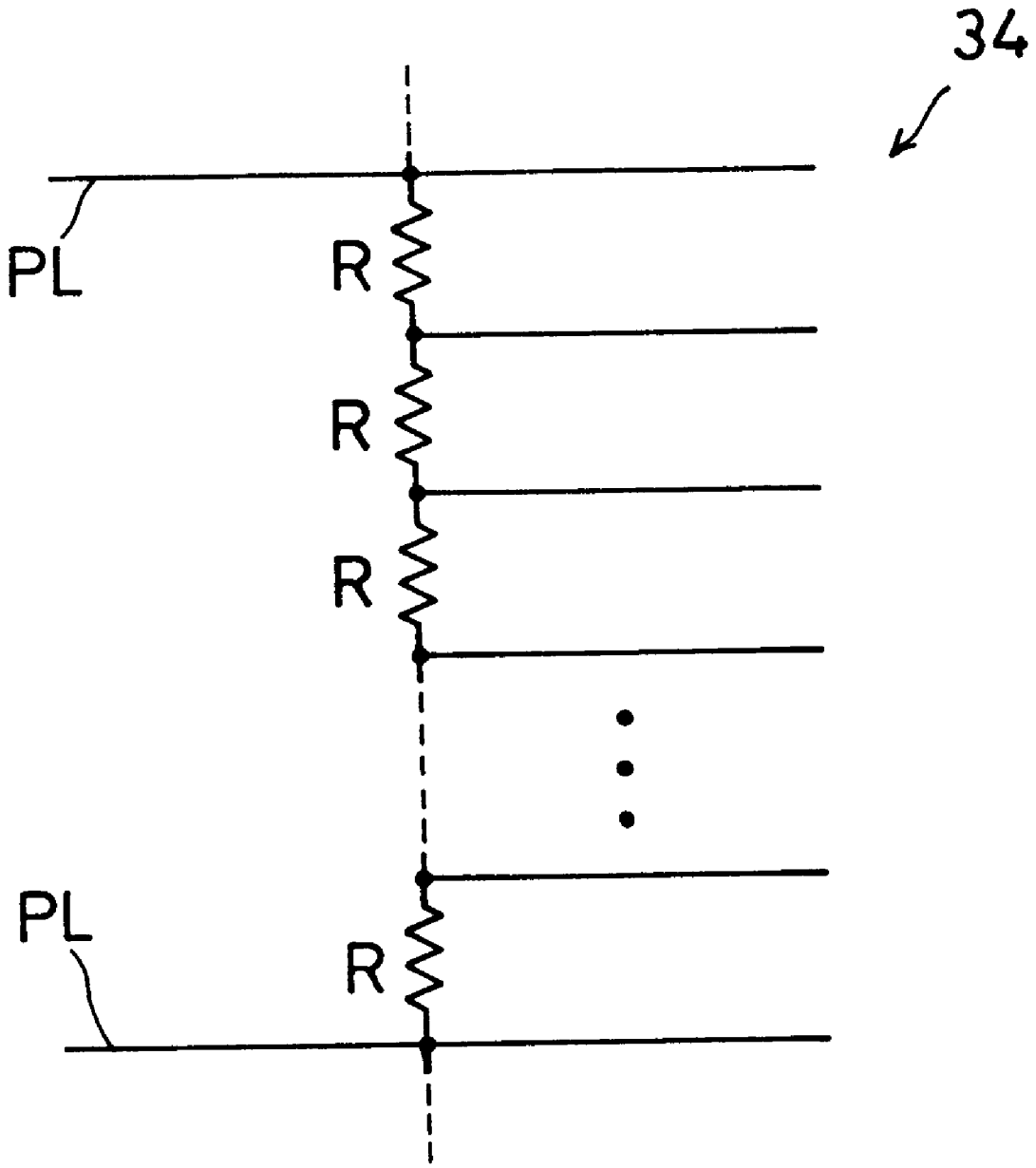
FIG. 32 is a circuit diagram which shows an arrangement of a medial value generator in the source driver shown in FIG. 31.

In this source driver, the medial value generator 32 is provided to each stage of the source lines SL, but another arrangement is acceptable. For example, in the arrangement shown in FIG. 31, the medial value generator 34 which is common to all the stages is provided in the gradation power source line PL. The medial value generator 34 is a circuit in which two adjacent gradation power source lines PL are connected through a resistor dividing circuit composed of $2^h$ resistors R connected in series as shown in FIG. 32.

Therefore, since a voltage is outputted from not only the gradation power source lines PL but also the node of the adjacent two resistors R, subsequently to the medial value generator 34, the gradation power source line is increased to $2^{m+h}$. For this reason, in the selecting output circuit 31, one voltage is outputted from the logical circuit 17 based upon $2^{m+h}$ decoded signals obtained by the latch 13 and the decoder 14.

Similarly to the source driver shown in FIG. 27, $2^n$-gradation display can be performed by the medial value generator 34. Moreover, since the medial value generator 34 is common to each stage of the source line SL, each stage does not require one medial value generator unlike the medial value generator 32. Therefore, the arrangement of the source driver can be simplified.

In addition, in the source driver, since a number of gradations can be secured by the $2^m$+1 gradation power source lines PL and the k-numbered timing signal lines, a number of resistors of the medial value generator 32 and 34 is decreased, thereby suppressing an influence of dispersion of a resistance value. Therefore, a number of gradations is increased, and satisfactory gradation display can be maintained. For example, when the upper limit of a practical number of resistor dividers is 4 (h=2), in this source driver, such multi-gradation as 64 gradation and 256 gradations can be obtained as mentioned above. Therefore, compared with the conventional driver using a resistance divider, a number of gradation can be greatly increased.

By providing the first and second source drivers to a liquid crystal display device, even if a number of signals to be applied to the liquid crystal panel 9 becomes smaller, an image signal with multi-gradation can be outputted. For this reason, even a liquid crystal display device, which has a small number of external terminals to be provided to the liquid crystal panel 9, can realize multi-gradation display.

In particular, in the case where the switching element SW composing the picture element 10 is a polycrystal silicon thin film transistor with small driving force, writing of the image data to a picture element capacity $C_P$ is speeded up. Therefore, also in the case where of a large-sized liquid crystal display device, namely where a load of the source driver is big, image data can be written sufficiently within a prescribed time ($1/2^k$ of one horizontal period), and image display with excellent quality becomes possible. This is also applicable to the case of a liquid crystal display device with high definition (the case of short horizontal scanning period). Moreover, since a number of divisions of a writing period can be larger when the loads are equal, further multi-gradation image can be displayed.

In addition, in the case where an active element composing the source driver is a polycrystal silicon thin film transistor, the active element can be manufactured in the same process as the switching element SW. For this reason, prices of manufactured liquid crystal display devices can be lowered.

In addition, when polarity of a voltage to be applied to the gradation power source line PL is switched per horizontal scanning period or vertical scanning period, a flicker of a display image can be suppressed, thereby improving display quality of the liquid crystal display device. The former case adopts a gate line inversion driving method. The latter case adopts a frame inversion driving method, but can adopt a source line inversion driving method providing more excellent display quality by applying a dual-circuit power system to the source driver (see SID '93 DIGEST p.15–18). At this time, since switching times of output polarity of the gradation power source 6 is changed is decreased, lower power consumption can be tried.

In addition, in the case where an image signal to be inputted to the liquid crystal display device is created by a pseudo gradation display method, an image with further multi-gradation can be displayed effectively. In particular, in the present invention, since a digital signal is used as an input signal, the result of a calculating process for pseudo gradation display can be directly used. Accordingly, an increase in the scale of the circuit is small.

Here, the pseudo gradation display method is a gradation display method utilizing a characteristic of human eyes, and its examples are a dither method, an error diffusion method, etc., but any other methods may be used. Moreover, a dot matrix method is also included in the pseudo gradation display method in the wide sense.

Figure 33:
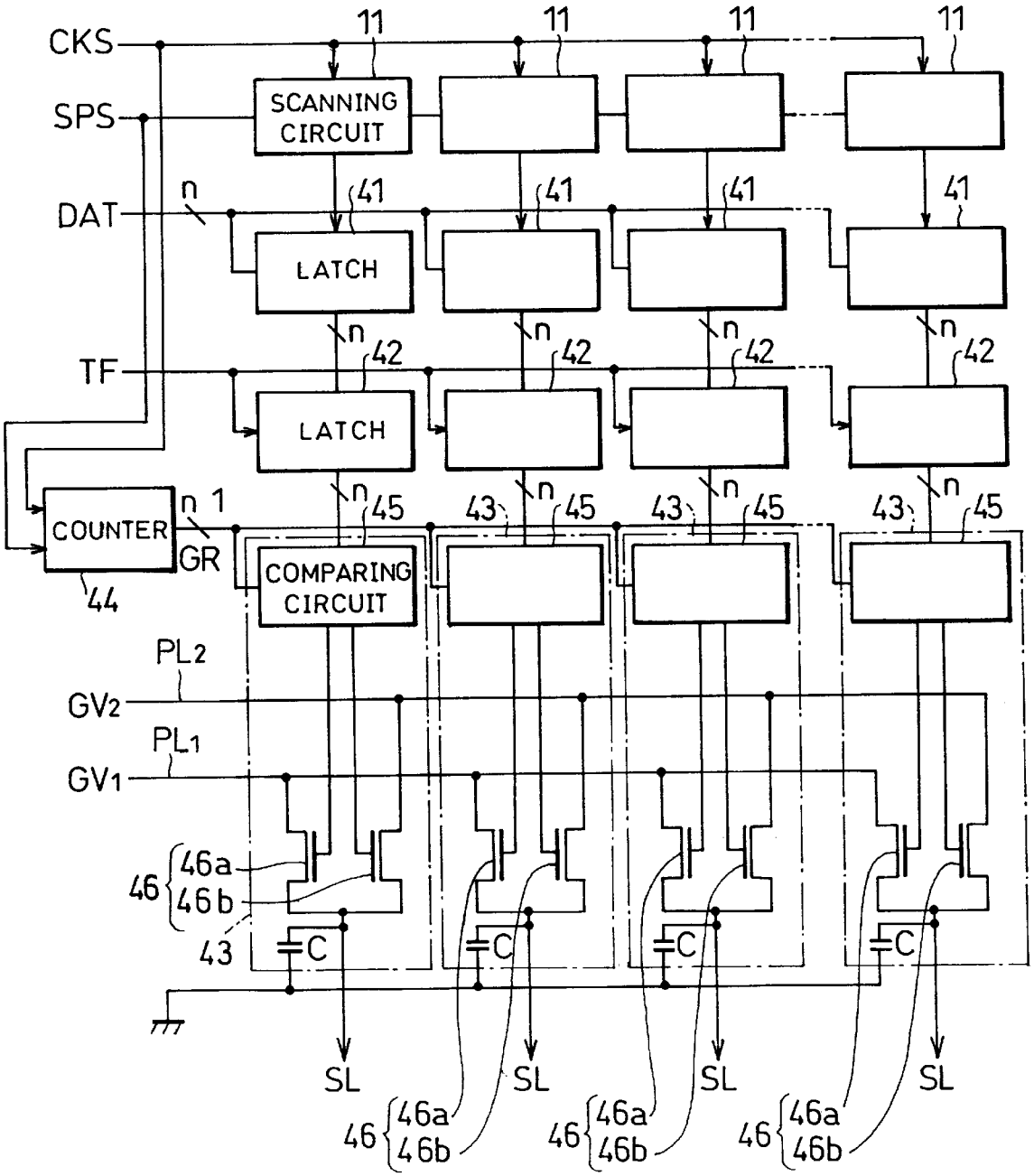
FIG. 33 is a block diagram which shows another arrangement of a third source driver in the liquid crystal display device.
Figure 34:
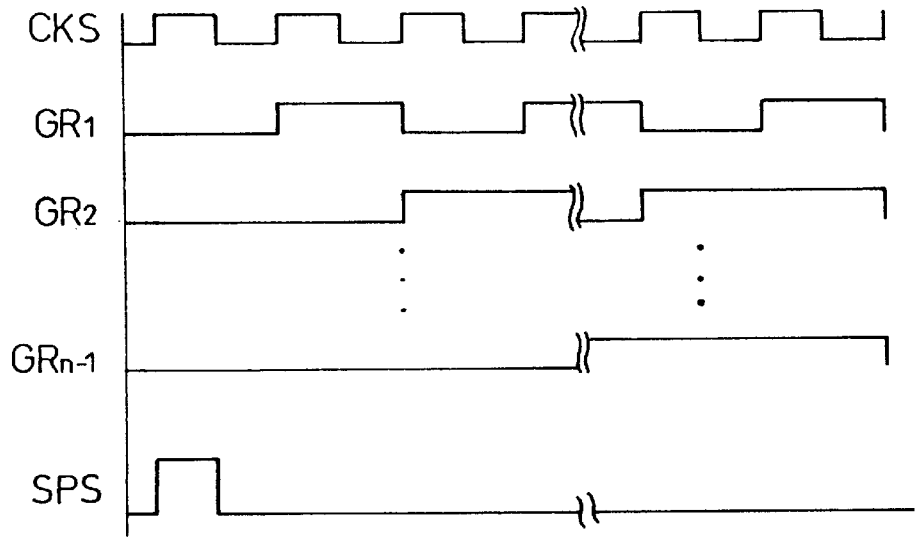
FIG. 34 is a timing chart which shows an operation of a counter in the third source driver.

As shown in FIG. 33, a third source driver is provided with the same number of the scanning circuits 11, latches 41, latches 42, and output selecting circuits 43 as the data signal lines SL. The third source driver further includes a counter 44.

Those members of this source driver that have the same functions as the first source driver are indicated by the same reference numerals and the description thereof is omitted.

The latches 41 retains n-bit digital signals DAT, which are inputted in synchronization with sampling signals from the scanning circuits 11. The latches 42 retain the data retained by the latches 41 in synchronization with a transfer signal TF.

The counter 44 is reset by a start pulse SPS and counts a clock CKS so as to output a gradation reference signal GR. The gradation reference signal GR is represented as an n−1-bit digital signal shown in FIG. 34 composed of signals $GR_1$ through $GR_{n-1}$ which change periodically so as to correspond to from off level to on level of liquid crystal which is a display medium.

The output selecting circuit 43 is composed of a comparing circuit 45, an output switch 46 and a hold capacitor C.

The comparing circuits 45 compares the latch data from the latches 42 with the gradation reference signal GR, and when the latch data coincide with the gradation reference signal, the comparing circuit 45 outputs a selecting signal for selecting one of gradation voltages $GV_1$ and $GV_2$.

Figure 35:
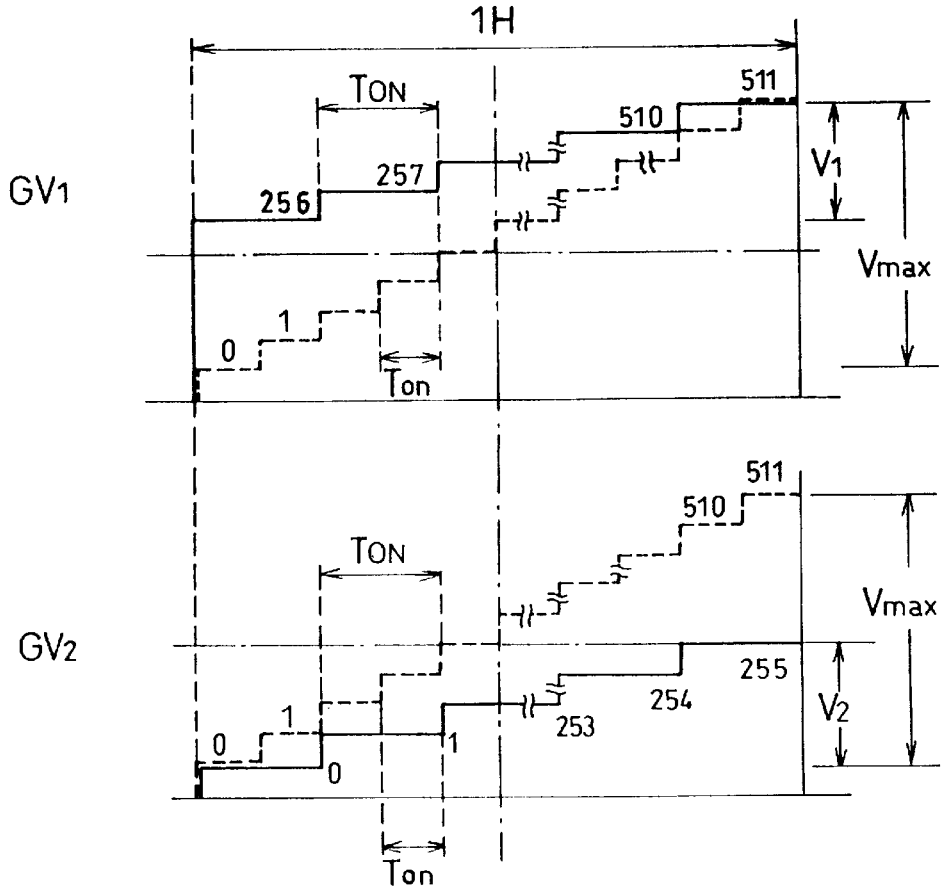
FIG. 35 is a waveform chart which shows waveforms of a gradation voltage to be applied to the third source driver.

As indicated by solid lines in FIG. 35, the gradation voltages $GV_1$ and $GV_2$ are such voltages that their amplitude levels change like staircase in two voltage ranges $V_1$ and $V_2$ which are not overlapped each other. The voltage ranges $V_1$ and $V_2$ are specified by dividing a voltage range $V_{max}$ where a signal to be outputted to the data signal line SL changes into two. The gradation voltages $GV_1$ and $GV_2$ are applied respectively through gradation power source line $PL_1$ and $PL_2$, and they are generated in the aforementioned gradation power source 6, for example.

The gradation voltages $GV_1$ and $GV_2$ are voltages which represent 256 gradations to be changed from a prescribed minimum value to a prescribed maximum value for one horizontal scanning period (1H) which is a prescribed period. Therefore, the gradation voltages $GV_1$ and $GV_2$ can represent 512 ($=2^9$) gradations in the case of n=9.

In the gradation voltage $GV_1$, the minimum value corresponds to the level of the digital signal DAT "256" (100000000), and the maximum value corresponds to the level of the digital signal DAT "511" (111111111). Moreover, in the gradation voltage $GV_2$, the minimum value corresponds to the level of the digital signal DAT "0" (000000000), and the maximum value corresponds to the level "255" (011111111).

Figure 58:
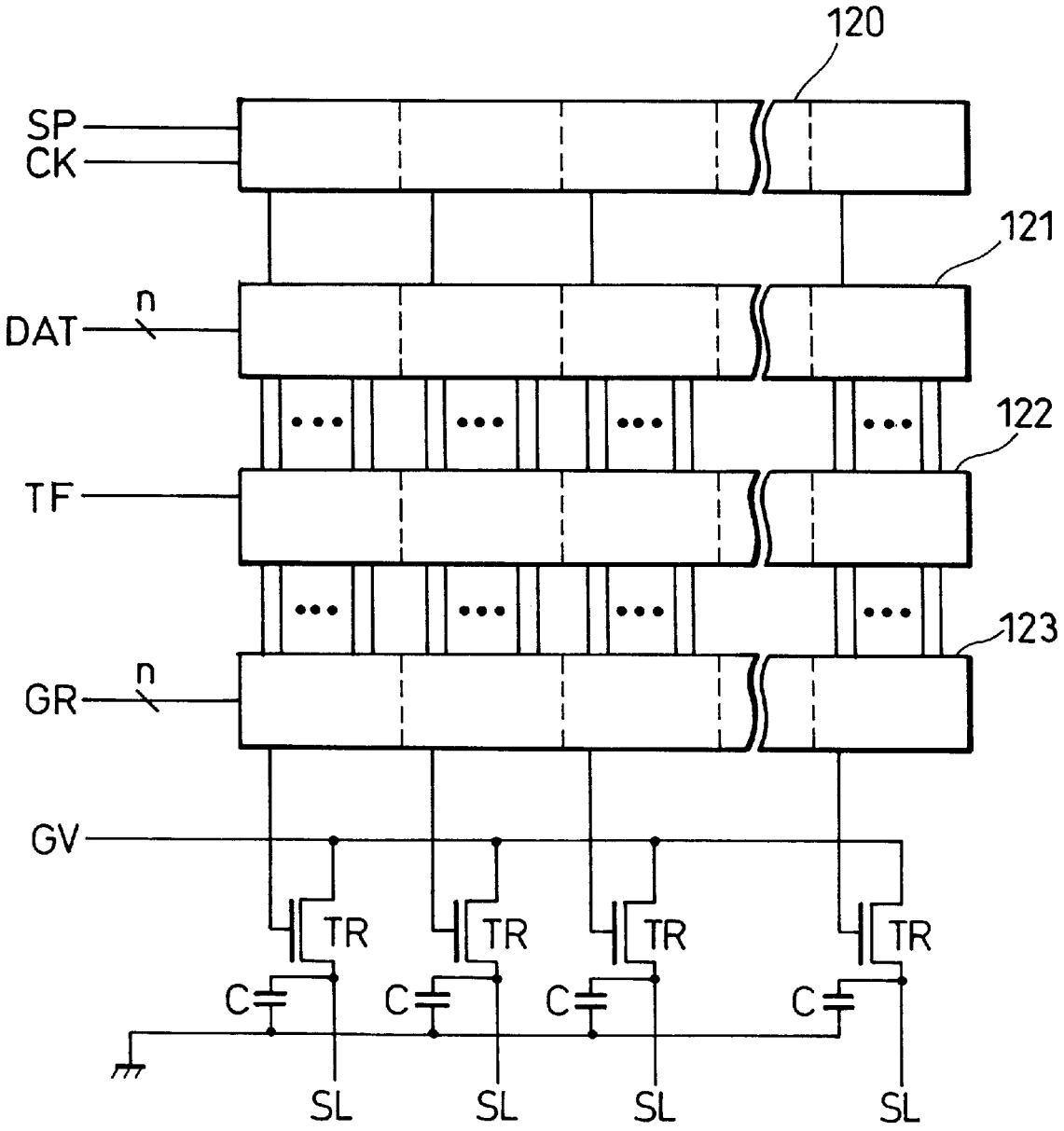
FIG. 58 PRIOR ART
FIG. 58 is a block diagram which shows an arrangement of the data signal line driving circuit which is actuated based upon the waveform shown in FIG. 57.
Figure 59:
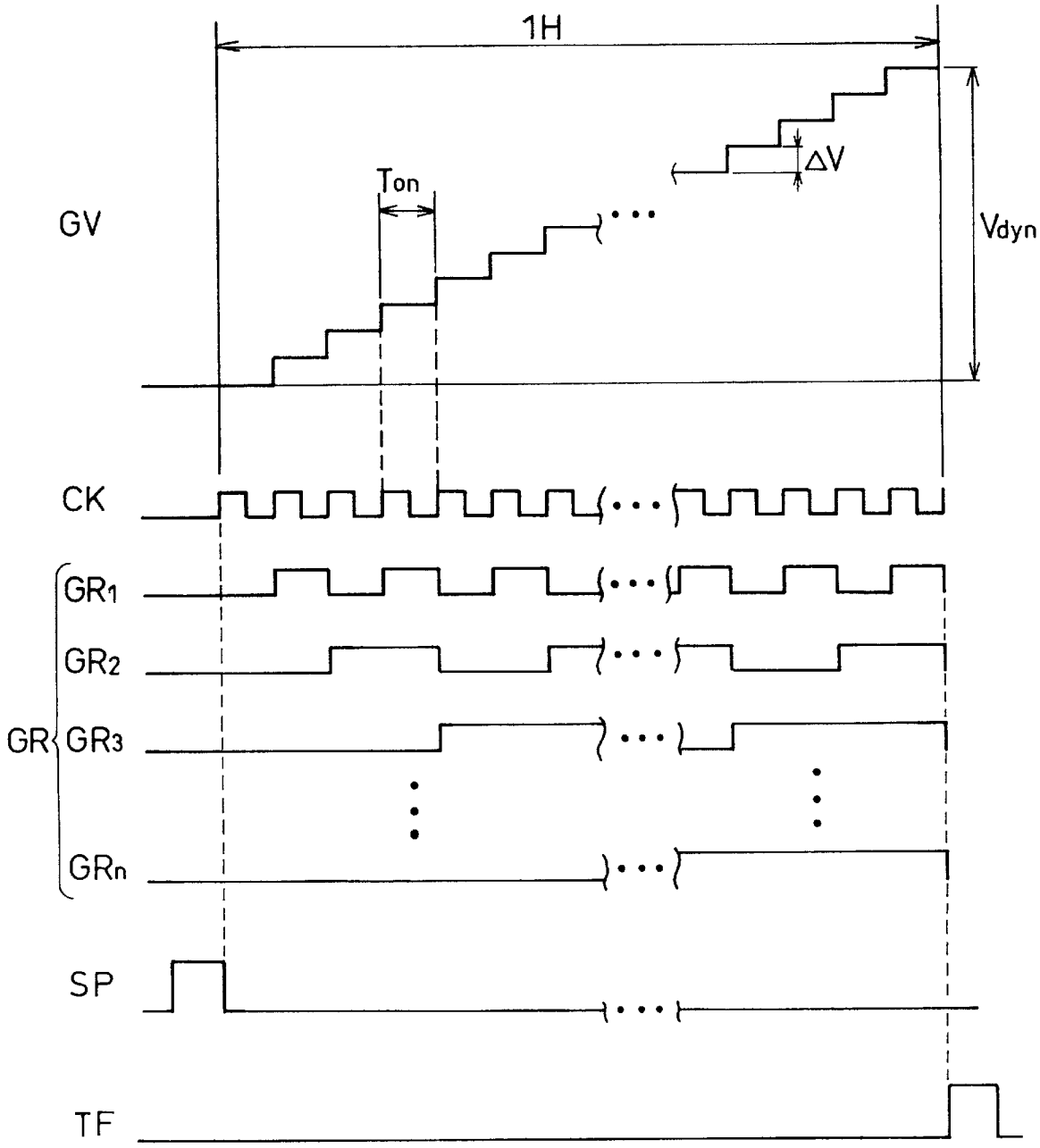
FIG. 59 PRIOR ART
FIG. 59 is a waveform chart which shows waveforms of a gradation voltage to be applied to the data signal line driving circuit shown in FIG. 58 and of a gradation reference voltage, etc. which is required for selecting the gradation voltage.
Figure 60:
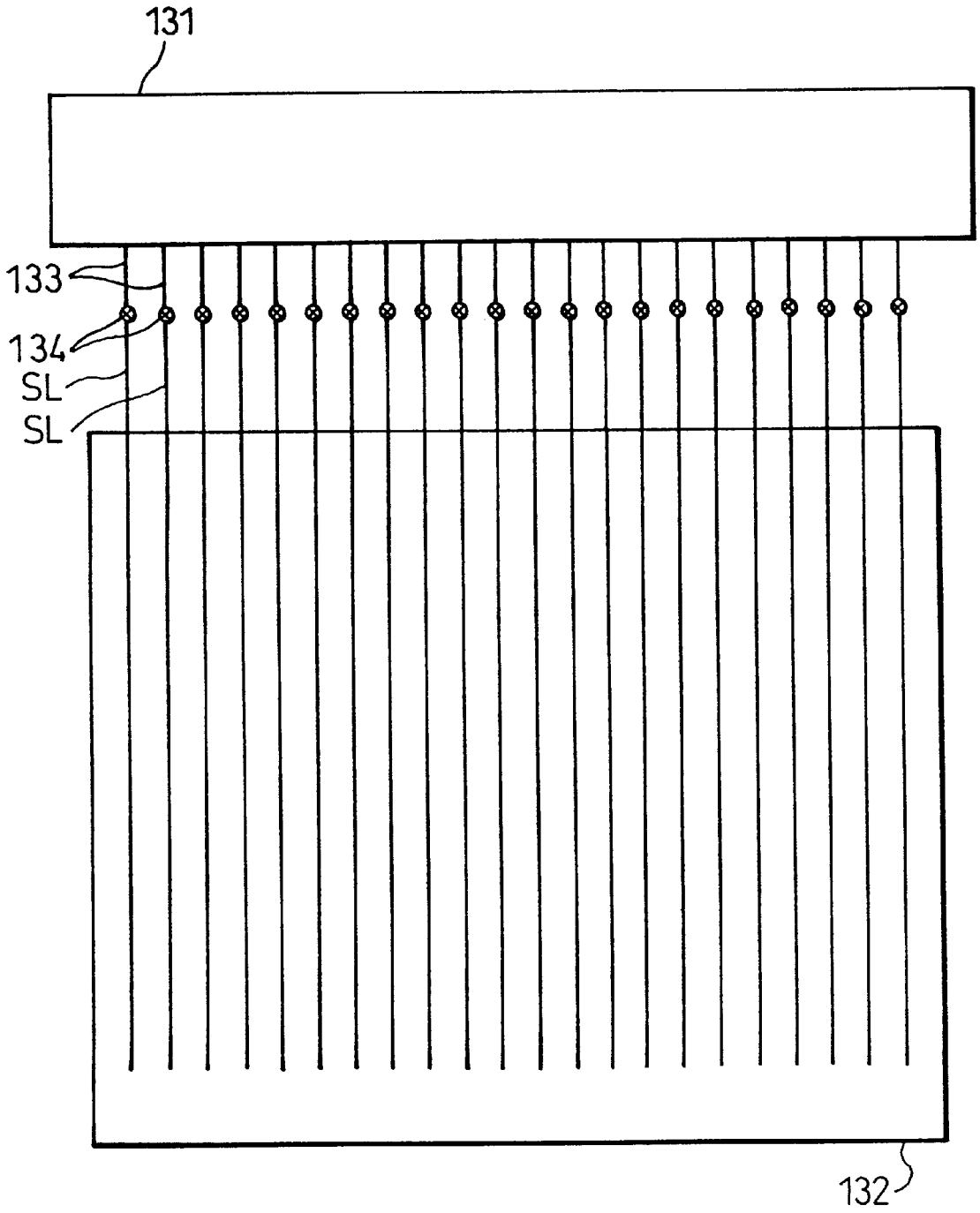
FIG. 60 PRIOR ART
FIG. 60 is a plan view which shows a structure that a data signal line driving circuit which is formed as a independent integrated circuit is mounted.
Figure 61:
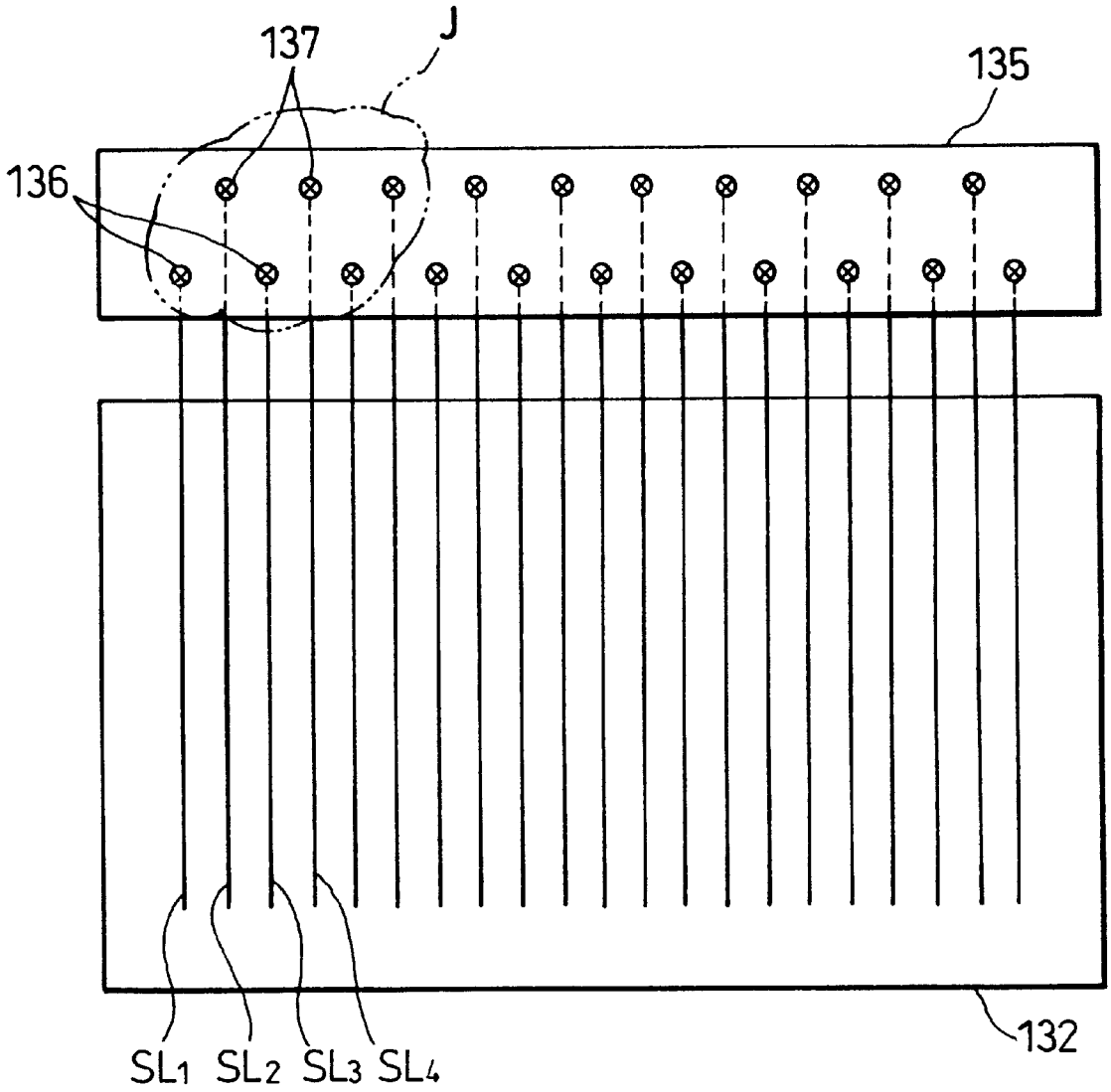
FIG. 61 PRIOR ART
FIG. 61 is a plan view which shows another mounting structure which is formed in order to remove defectiveness of the mounting structure in FIG. 60.
Figure 62:
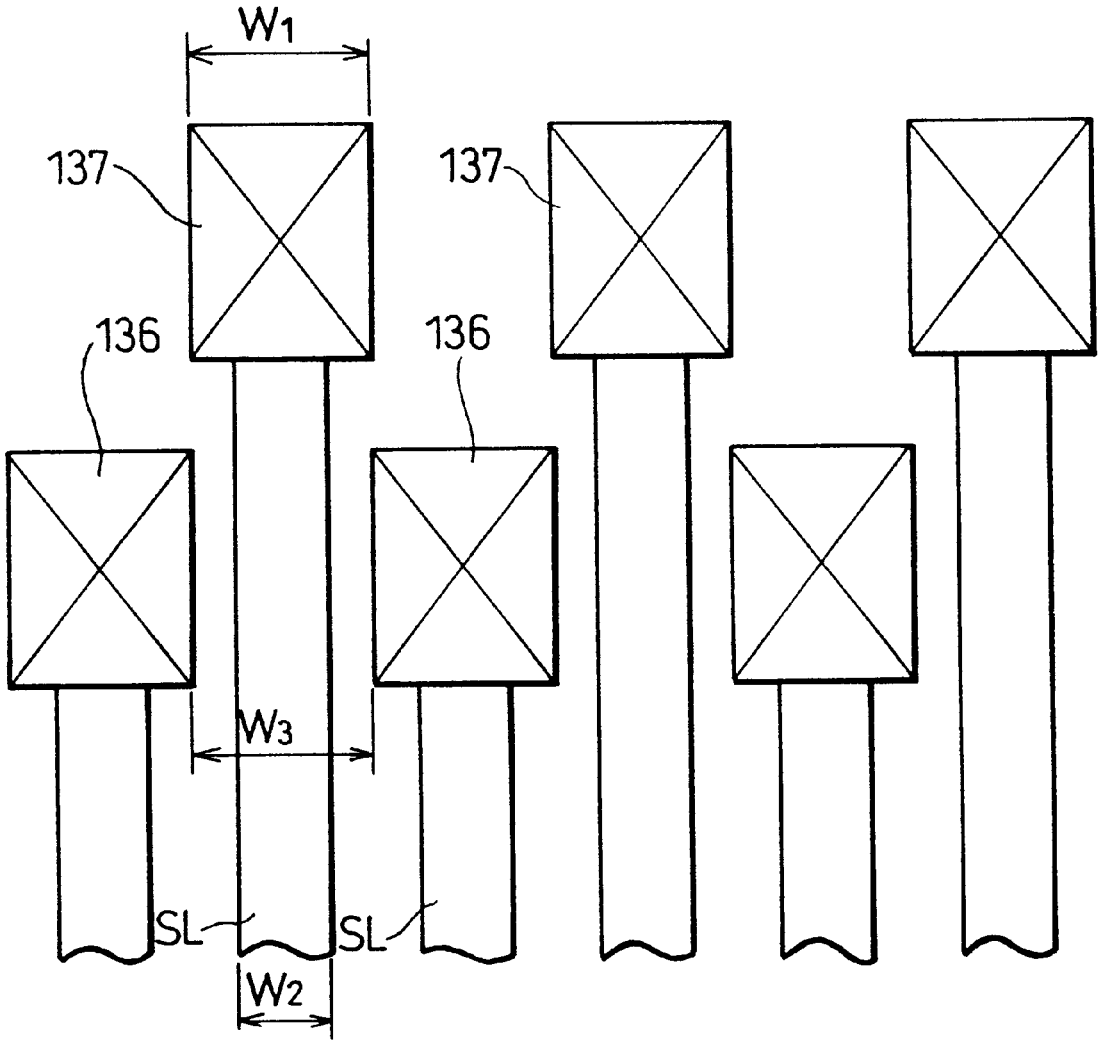
FIG. 62 PRIOR ART
FIG. 62 is a front view which shows an enlarged portion of the mounting structure in FIG. 61.

Here, the voltages shown by broken lines in FIG. 35 represent gradation voltages generated in the case where 512-gradation display is performed in the conventional data signal line driving circuit (source driver) shown in FIG. 58.

As shown in FIG. 33, the output switch 46 is composed of transistors 46*a* and 46*b* which are two analog switches. The gradation voltage $GV_1$ is inputted to a source of the transistor 46*a*, and the gradation voltage $GV_2$ is inputted to a source of the transistor 46*b*. Moreover, two selecting signals from the comparing circuit 45 are inputted respectively to gates of the transistors 46*a* and 46*b*. Further, drains of the transistors 46*a* and 46*b* are connected each other, and they are also connected to the data signal line SL.

The hold capacitors C and the output switches 46 respectively make a pair, and each one terminal of the hold capacitors C is connected to each one output terminal of the output switch 46. Moreover, the other terminals of the hold capacitor C are grounded.

Figure 36:
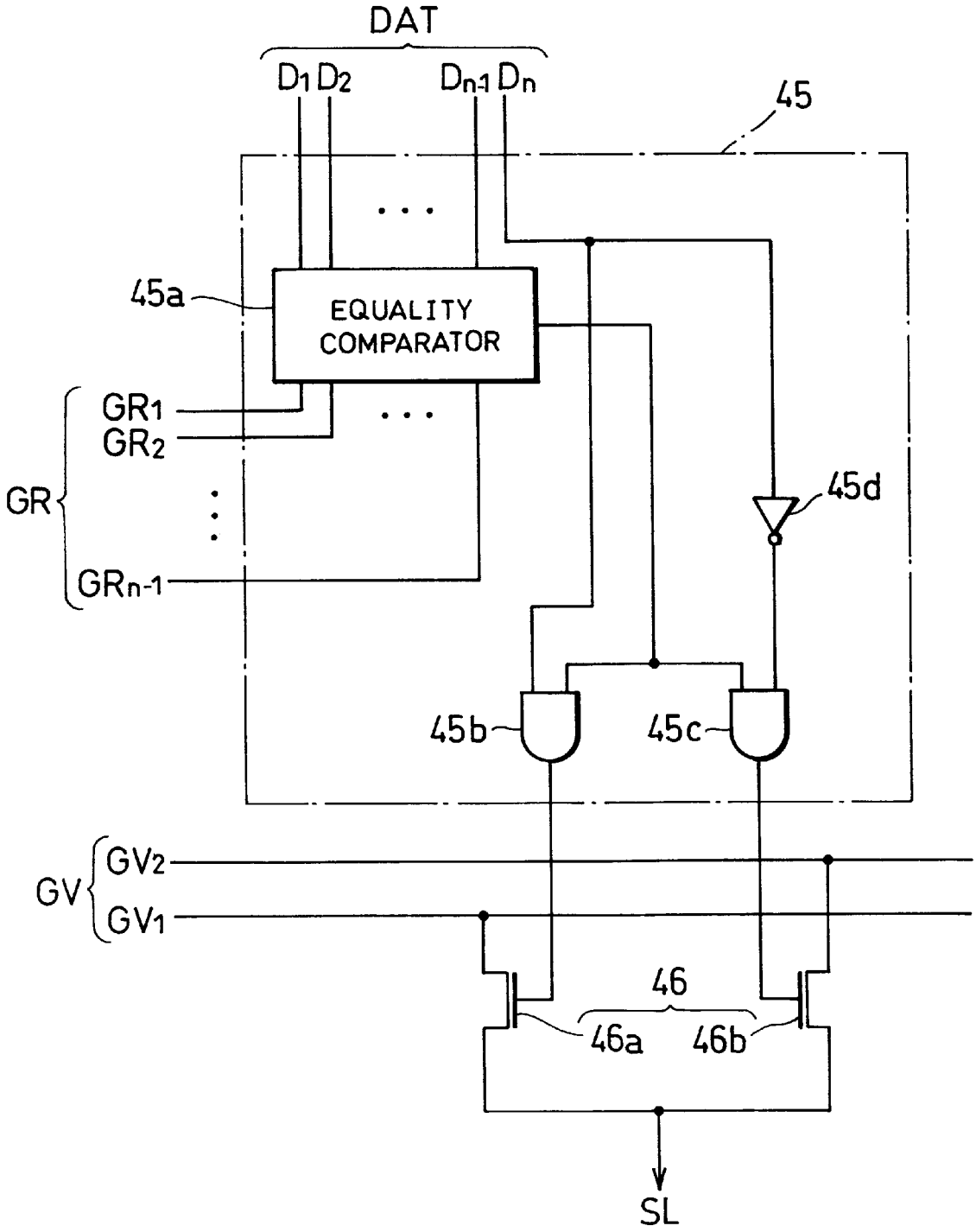
FIG. 36 is a circuit diagram which shows an arrangement of a comparing circuit in the third source driver.

As shown in FIG. 36, the comparing circuit 45 is composed of an equality comparator 45*a*, AND gates 45*b* and 45*c* and an inverter 45*d*.

The equality comparator 45*a* compares two data to be inputted, namely, compares bit signals $D_1$ through $D_{n-1}$ of the digital signal DAT retained by the latches 42 with signals $GR_1$ through $GR_{n-1}$ of the gradation reference signal GR, and when both the signals coincide with each other, the equality comparator 44*a* outputs an equality signal having a high level.

The AND gate 45*b* is a circuit which takes the AND of an output signal from the equality comparator 45*a* and the bit signal $D_n$ of the digital signal DAT. The AND gate 45*c* is a circuit which takes the AND of an output signal from the equality comparator 45*a* and a signal, which is obtained by inventing the bit signal $D_n$ (representing most significant bit) by the inverter 45*d*.

In the source driver having the above arrangement, the inputted digital signals DAT are successively sampled by the latches 41 and are retained so as to be subject to horizontal scanning. The bit signals of the digital signals DAT retained by the latches 41 are simultaneously latched by the latches 42 in synchronization with a transfer signal TF, and they are retained until next transfer signal TF is inputted.

In the comparing circuit 45, a selecting signal is generated based upon a bit signal retained by the latch 42 and a gradation reference signal GR. More specifically, two data to be inputted to the equality comparator 45*a* are compared, and when both the data coincide with each other, an equality signal having high level is outputted. Therefore, during a period that the bit signal $D_n$ is "1", namely, is at a high level, a selecting signal with high level is outputted from the AND circuit 45*b*, and during the bit signal $D_n$ is "0", namely, is at a low level, a selecting signal with low level is outputted from the AND circuit 45*b*.

In the output switch 46, one of the transistors 46*a* and 46*b* conducts based upon a selecting signal with high level. As a result, one of gradation voltages $GV_1$ and $GV_2$ is selected. Therefore, the gradation voltages outputted from the output switches 46 are outputted to the data signal lines SL through the hold capacitors C.

As mentioned above, with the above-mentioned source driver, as shown in FIG. 35, a time $T_{ON}$ while the transistor 46*a* or 46*b* is conducting can be made twice as longer as a time $T_{ON}$ while a transistor is conducting in the conventional data signal driving circuit by using two gradation voltages $GV_1$ and $GV_2$ which change in different voltage ranges $V_1$ and $V_2$. Therefore, a time for sufficiently charging the hold capacitors C so that they have the same level as a gradation voltage to be outputted can be secured, and in the case where such a multi-gradation display as 512 gradations is performed, the gradation voltage can be written accurately to the picture element capacity $C_P$.

For this reason, the gradation voltages can be outputted to the plural data signal lines SL by adding one gradation power source line for applying a gradation voltage to the source driver shown in FIG. 58, thereby improving resolution greatly.

In addition, in general, in the case where a driving circuit is formed on an insulating substrate by using polycrystal silicon, its operation speed and driving capacity are further lowered compared with the case where a driving circuit is formed on a monocrystal silicon substrate. For this reason, it is difficult to form a driving circuit as well as a picture element on an insulating substrate monolithically. However, even if the operation speed and driving capacity are low, the time for writing a gradation voltage can be sufficiently secured by using the third source driver. Therefore, it is possible to form the third source driver and the picture element array on the substrate monolithically.

The third source driver is provided with the two gradation power source lines $PL_1$ and $PL_2$, but the arrangement is not limited to this. For example, gradation power source lines may be provided so that their number makes it possible to obtain a desired time as conducting time of the output switch 46. With this arrangement, if a number of gradation power source lines is m, conducting time $T_{ON}$ becomes m times.

In addition, number of gradations is not limited to 512 in the case of n=9, so it may be set to any value. In this case, if a number of gradations is m, m-numbered analog switches are provided per data signal line SL. Then, one analog switch is selected by the comparing circuit 45 based upon a plurality of bit signals from the most significant bit side of the digital signal DAT. For example, in the case of m=4, one of four analog switches is selected based on two bit signals on the most significant side.

The following describes a modified example of the liquid crystal display device using the third source driver.

Figure 37:
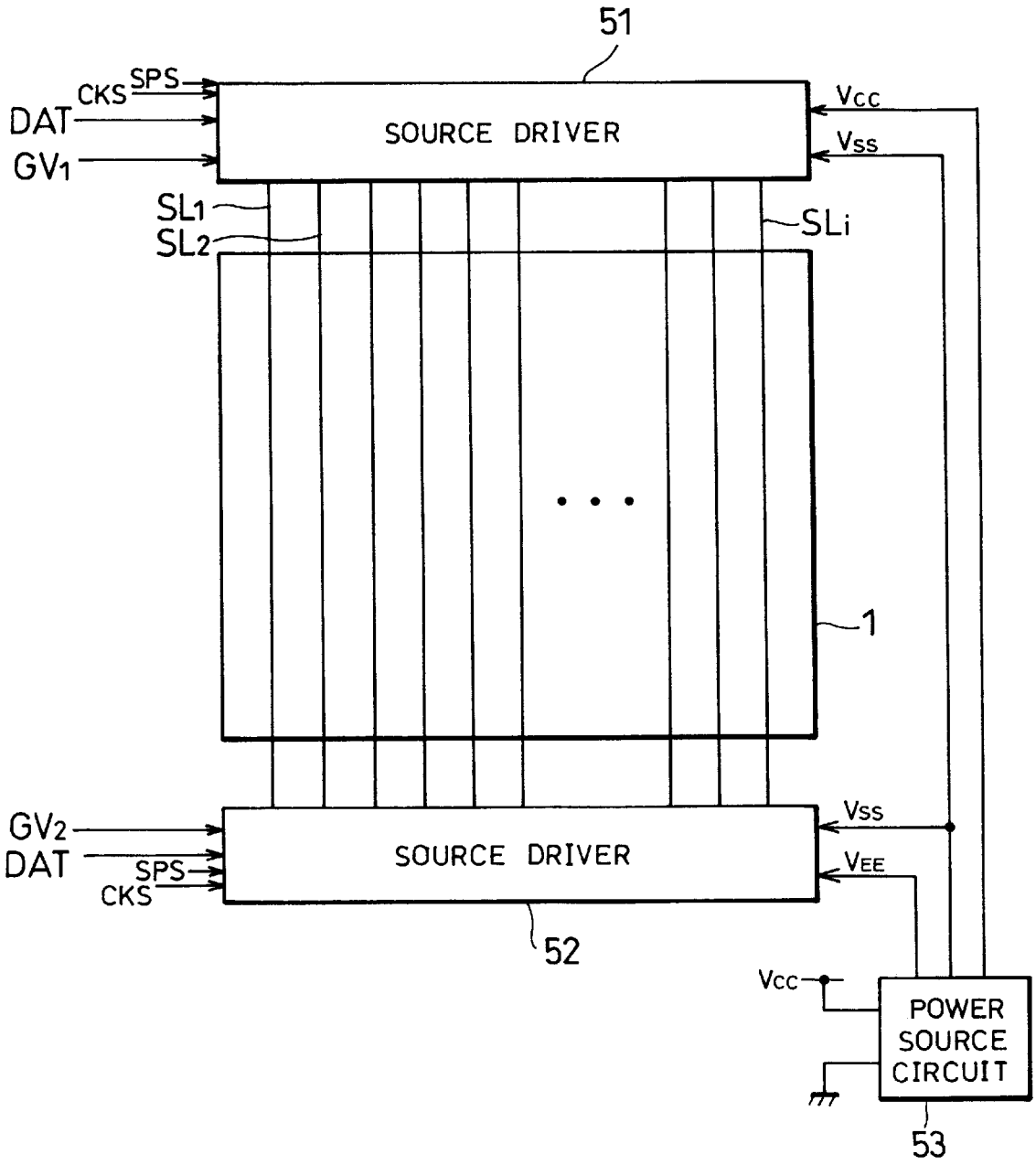
FIG. 37 is a block diagram which shows an arrangement of a main section of a liquid crystal display device according to a modified example to which the third source driver is applied.

As shown in FIG. 37, the liquid crystal display device is provided with source drivers 51 and 52 as the third source driver. The source drivers 51 and 52 face each other across the picture element array 1. A plurality of output lines included in the source drivers 51 and 52 are connected to the common data signal lines SL ($SL_1$, $SL_2$, . . . ) correspondingly.

Not shown in FIG. 37, the source drivers 51 and 52 respectively have the aforementioned transistor 46*a* and 46*b*. The gradation voltages $GV_1$ and $GV_2$ are applied to the transistors 46*a* and 46*b* respectively. Moreover, the scanning circuits 11, the latches 41, the latches 42, etc. are provided commonly to the source drivers 51 and 52. However, it is enough that the comparing circuit 45 in the source driver 51 has a function in selecting the transistor 46*a*. Moreover, it is enough that the comparing circuit 45 in the source driver 52 has a function in selecting the transistor 46*b*.

In addition, power source voltages $V_{SS}$ and $V_{CC}$ with high level are applied to the source driver 51 by a power source circuit 53. Power source voltages $V_{EE}$ and $V_{SS}$ with low level are applied to the source driver 52 by the power source voltage 53. The power source circuit 53 generates the power source voltages $V_{SS}$, $V_{CC}$ and $V_{EE}$ based upon the voltage $V_{CC}$, and it has the same functions as the aforementioned power source circuit 5 (see FIG. 2) except for the function in generating power source voltages $V_{SH}$ and $V_{SL}$. Moreover, the gradation voltage $GV_1$ changes in the range of $V_{SS}$ to $V_{CC}$, and the gradation voltage $GV_2$ changes in the range of $V_{EE}$ to $V_{SS}$.

In general, in the liquid crystal display device, in order to keep reliability of liquid crystal, a liquid crystal capacity should be switch-driving by using a voltage which changes between positive polarity and negative polarity. Therefore, in the liquid crystal display device of the present invention, when the power source voltage $V_{SS}$ is set to 0V, namely, a grounding level, and the power source voltage $V_{CC}$ is a voltage with positive polarity and the power source voltage $V_{EE}$ is a voltage with negative polarity, such an alternate-driving can be performed.

In addition, the power source voltage can be reduced to ½ of the conventional one, and thus the power consumption can be reduced. Moreover, as the power source voltage reduced lower, withstand voltages of circuits composing the source drivers 51 and 52 can be lowered, thereby reducing areas of the circuits.

Figure 38:
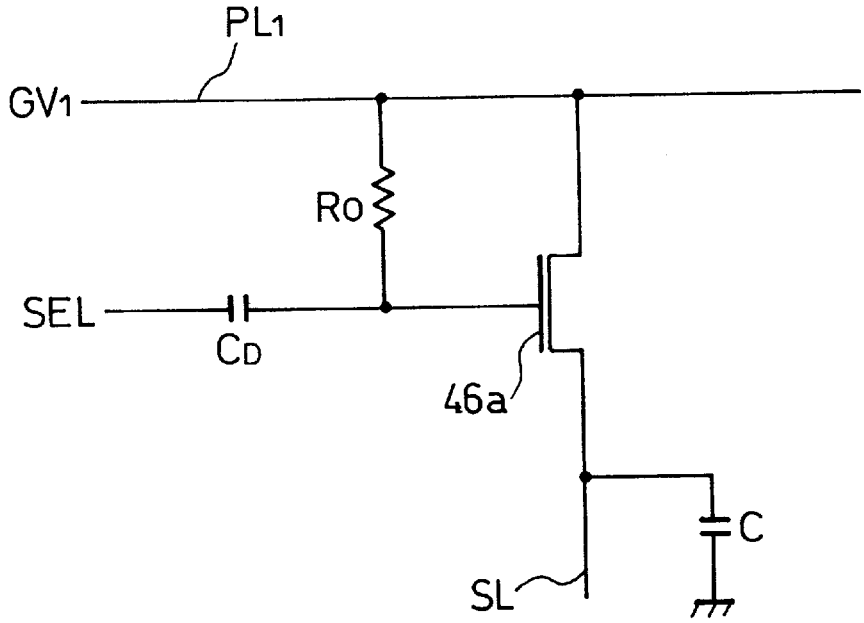
FIG. 38 is a circuit diagram which partially shows an arrangement of an output section in the third source driver.

The following explains suitable details for the output section of the third source driver on reference to FIG. 38. FIG. 38 does not show the transistor 46*b* of the aforementioned output switch 46, but the transistor 46*b* has also the same arrangement as the transistor 46*a*.

In the above-mentioned output section, a selecting signal SEL is inputted from the AND circuit 45*b* through a series capacitor $C_D$ to the gate of the transistor 46*a*, and a resistor $R_O$ is connected across the source electrode and the gate electrode of the transistor 46*a*. When the transistor 46*a* is turned on, the level of the selecting signal SEL becomes high, and when turned off, becomes low.

An electric potential $V_g$ of the gate electrode of the transistor 46*a* is kept nearly equal to an electric potential $V_s$ of the source electrode by a resistor $R_o$. For this reason, during the level of the selecting signal SEL is low, the series capacitor $C_D$ is charged by the potential $V_s$, namely, the gradation voltage $GV_1$.

Figure 39:
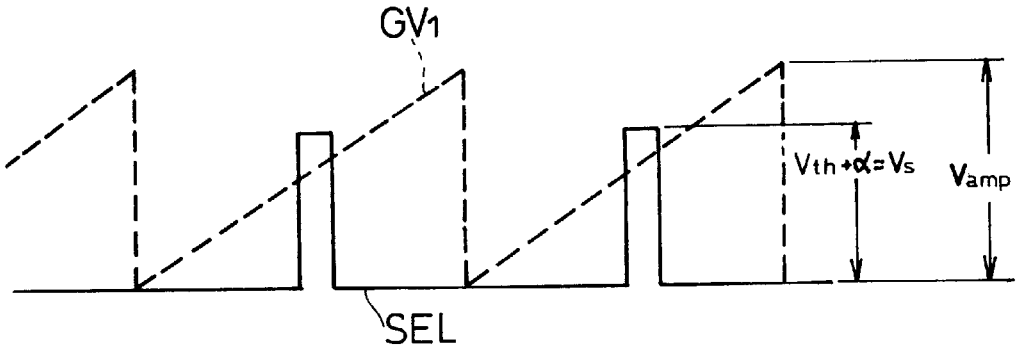
FIG. 39 is a waveform chart which shows an operation of the output section.

Here, the electric potential at high level of the selecting signal SEL is $V_{th}+\alpha$ (see FIG. 63) which is a value for triggering the transistor 46*a* into conduction, and as shown in FIG. 39, a value of an amplitude of the gradation voltage $GV_1$ is $V_{amp}$. As a result, when the level of the selecting signal SEL becomes high, the transistor 46*a* conducts by applying the $V_{th}+\alpha+V_{amp}$ to the gate electrode.

As a result, since a gate-source voltage $V_{gs}$ is maintained so as to be $V_{th}+\alpha$ regardless of the value of the amplitude $V_{amp}$ of the gradation voltage $GV_1$, even if the amplitude of the selecting signal SEL is not larger than the maximum value of the amplitude $V_{amp}$, the transistor 46*a* conducts. Therefore, the driving voltage of the circuits including the comparing circuit 45 for generating the selecting signal SEL is lowered, and thus the power consumption of the source driver can be reduced.

The aforementioned first through third source drivers are mounted as follows in the case where they are formed as IC chips.

Figure 40:
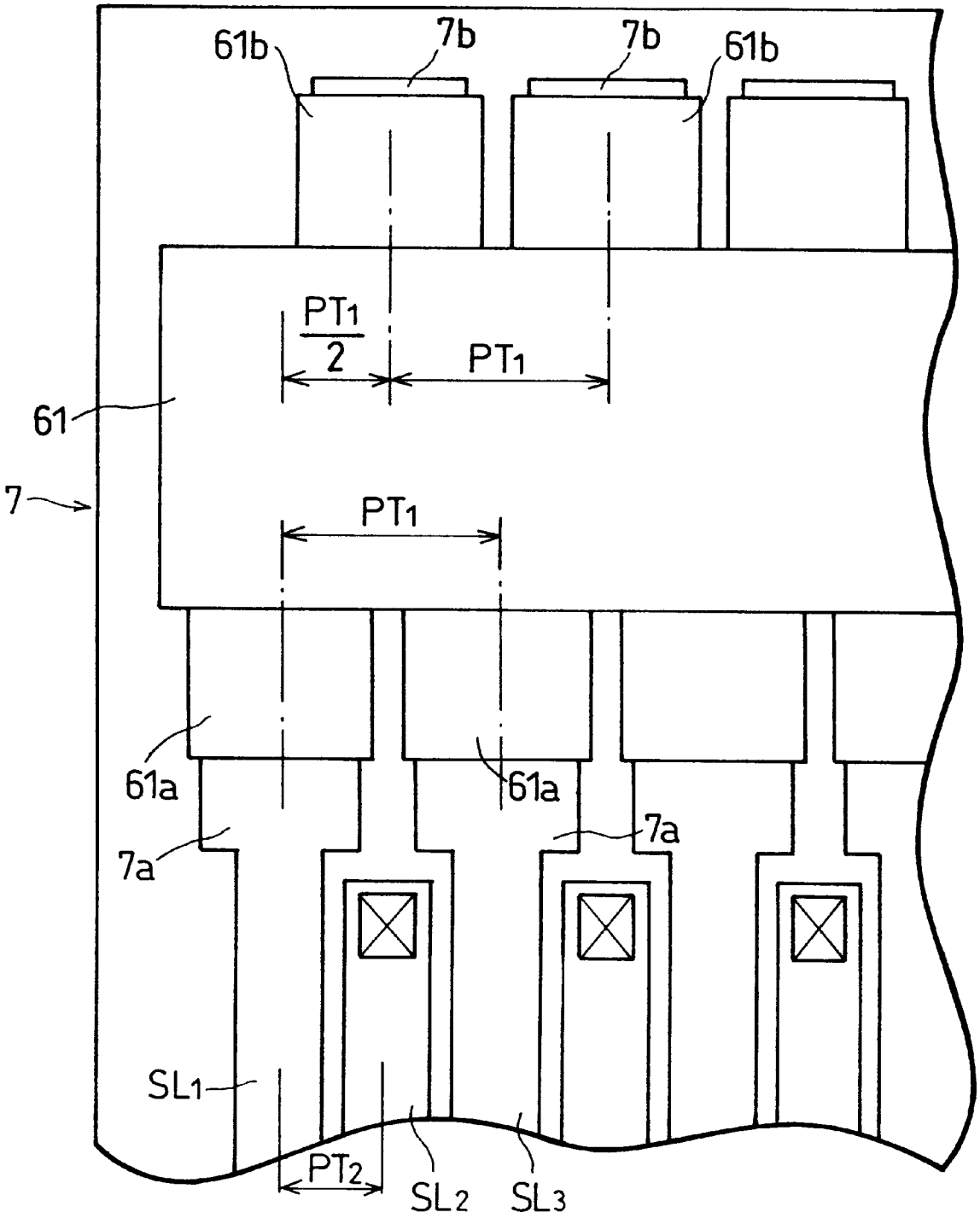
FIG. 40 is a plan view which shows a structure that the third source driver is mounted to a liquid crystal panel.

As shown in FIG. 40, a driver IC 61 in which the third source driver is integrated as an IC chip is mounted on the substrate 7.

The driver IC 61 is provided with output terminals 61*a* and output terminals 61*b* on its both sides. The output terminals 61*a* are arranged on the picture element array side, not shown, and are connected to the data signal lines $SL_1$, $SL_2$, . . . . The output terminals 61*a* and the output terminals 61*b* are arranged at an arrangement pitch $PT_1$. Moreover, the output terminals 61*a* and the output terminals 61*b* are arranged so as to be displaced by $PT_2/2$ each other.

On the other hand, contact pads 7*a* are formed on the substrate 7 so as to coincide with the arrangement positions of the output terminals 61*a*, and the contact pads 7*b* are formed so as to coincide with the arrangement positions of the output terminals 61*b*.

Figure 41:
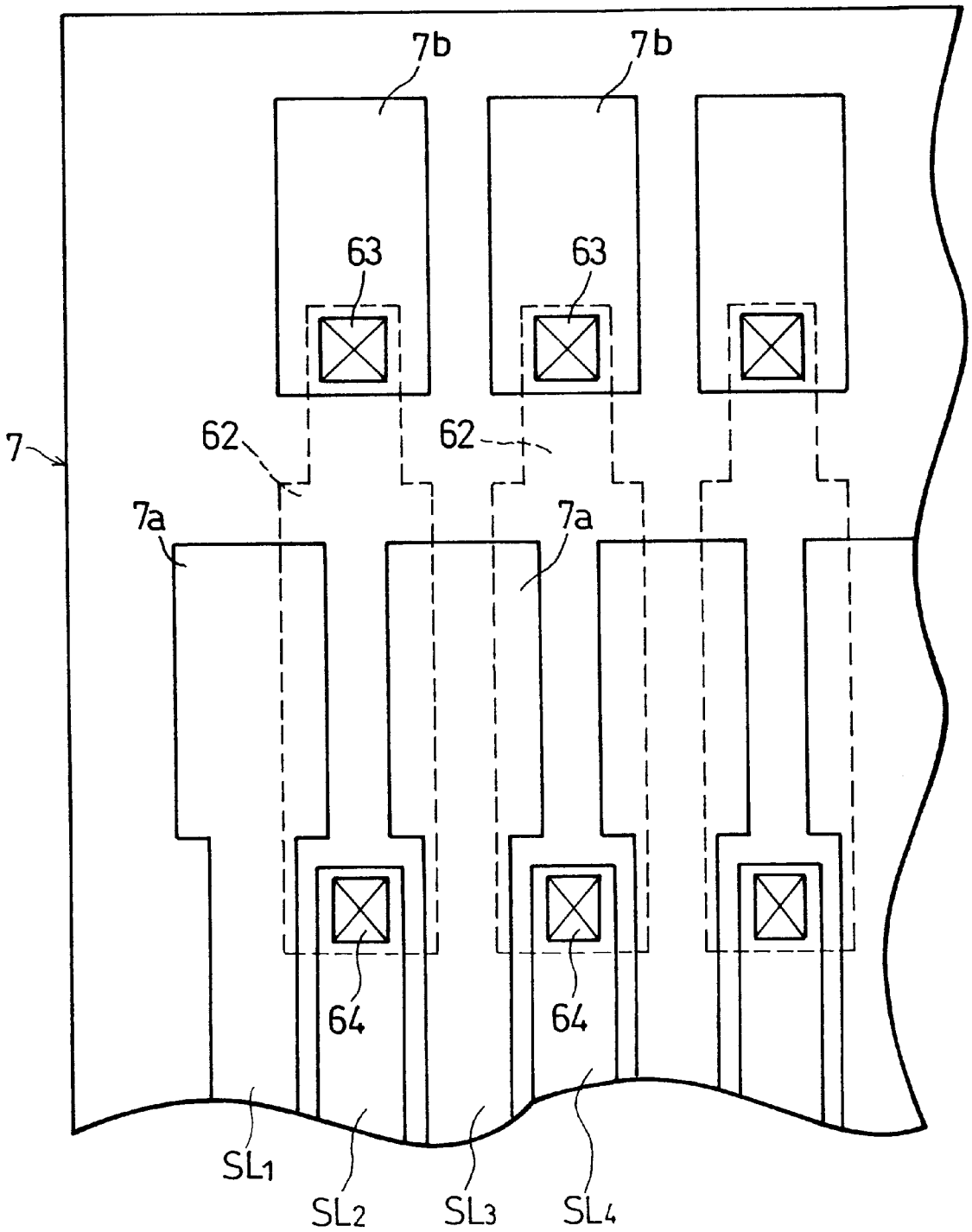
FIG. 41 is a plan view which shows a wiring structure on a substrate for realizing the mounting structure.

As shown in FIG. 41, the contact pads 7*a* are directly connected to the odd-numbered data signal lines $SL_1$, $SL_3$, . . . . Meanwhile, the contact pads 7*b* are connected to the even-numbered data signal lines $SL_2$, $SL_4$, . . . through bypass wiring 62. The bypass wiring 62 are formed on an electrically conductive layer which is different from the surface of the substrate 7 where the contact pads 7*a*, the contact pads 7*b* and the data signal lines SL are formed.

The bypass wiring 62 are formed on the back face of the substrate 7 when the substrate 7 is a monolayered substrate, and are formed on the surface of a layer which is different from a surface of a layer where the contact pads 7*a*, etc. are formed when the substrate 7 is composed of a multi-layered substrate. The bypass wiring 62 and the contact pads 7*b* are electrically connected through contact holes 63. Moreover, the bypass wiring 62 and data signal lines $SL_2$, $SL_4$, . . . are electrically connected through contact holes 64.

As a result, the contact pads 7*a* and the contact pads 7*b* can be arranged so that a relationship "$PT_2=PT_1/2$" is fulfilled with respect to an arrangement pitch $PT_2$ of the data signal lines SL. For this reason, enough strength for soldering can be secured between the output terminals 61*a* and the contact pads 7*a* and between the output terminals 61*b* and the contact pads 7*b*. Moreover, an allowance for displacement in the case of mounting of the driver IC 61 to the substrate 7 can be also secured.

In the above arrangement, high-density wiring of the data signal lines SL is possible by narrowing the arrangement pitch $PT_2$. As a result, a wiring structure corresponding to multi-gradation display can be provided by using the first through third source drivers, thereby easily realizing high resolution.

Figure 42:
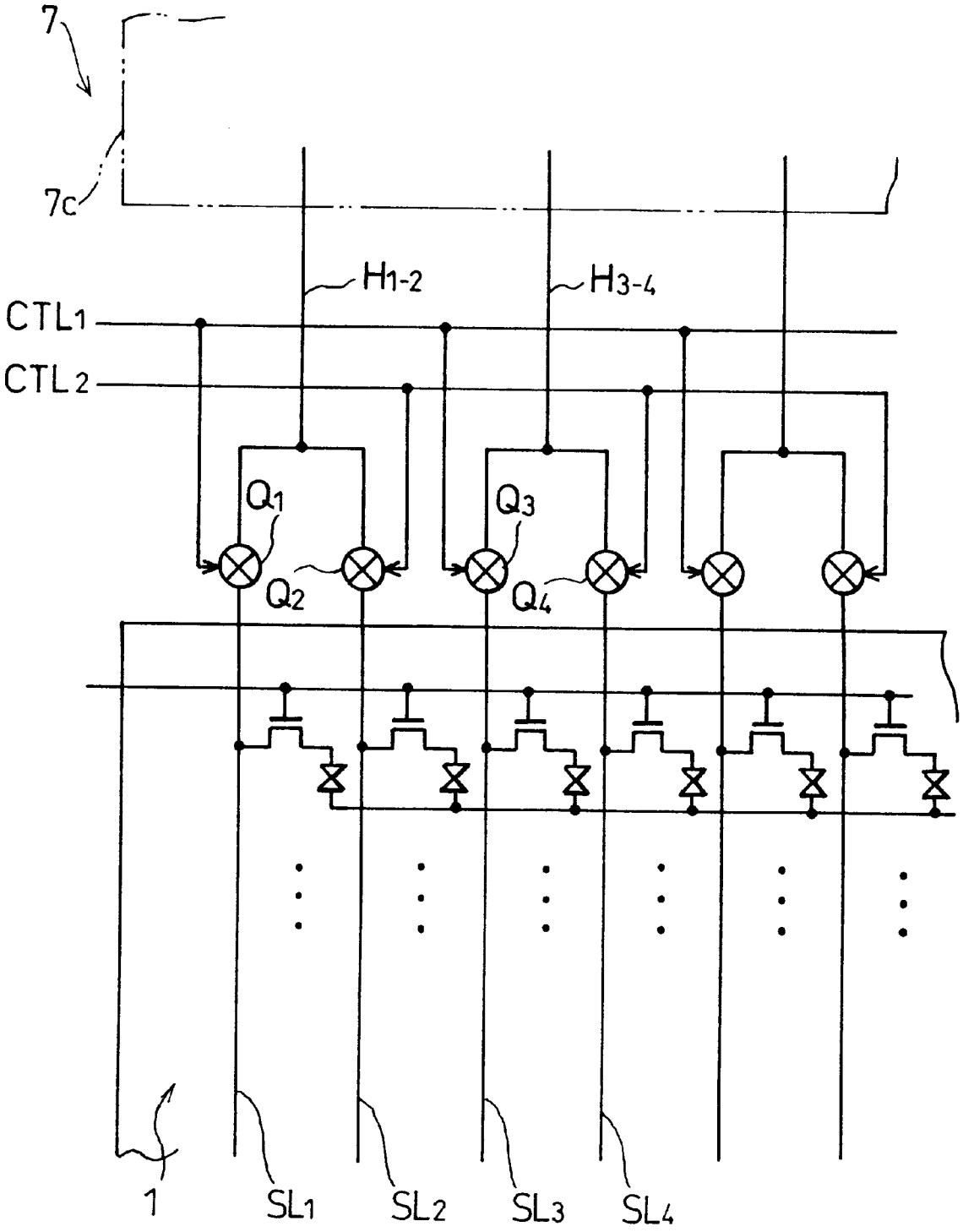
FIG. 42 is a circuit diagram which shows a circuit for realizing divided driving which is applied to the mounting structure.
Figure 43:
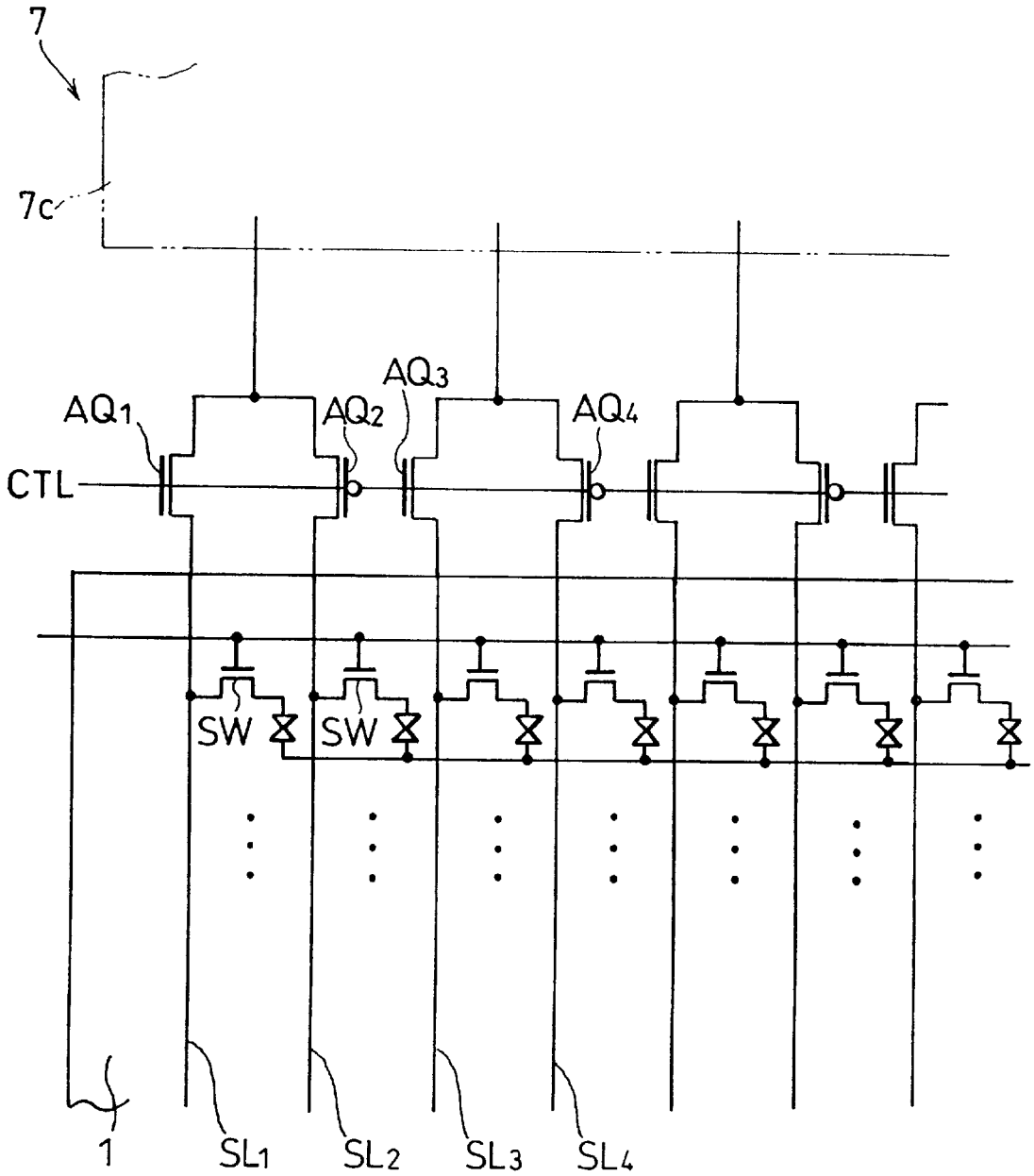
FIG. 43 is a circuit diagram which shows another circuit for realizing divided driving which is applied to the mounting structure.

Next, the following describes an arrangement in connection with driving which is suitable for the aforementioned mounting structure on reference to FIGS. 42 and 43.

As shown in FIG. 42, analog switches $Q_1$, $Q_2$, . . . are provided between a mounting area 7*c*, where the driver IC 61 is mounted, and the picture element array 1 on the substrate 7. The data signal lines $SL_1$, $SL_2$, . . . are connected to output terminals of the analog switches $Q_1$, $Q_2$, . . . respectively.

In addition, the odd-numbered analog switches $Q_1$, $Q_3$, . . . and the even-numbered analog switches $Q_2$, $Q_4$, . . . are respectively make a pair. Each of the paired analog switches Q are connected to output lines $H_{1-2}$, $H_{3-4}$, as output lines of the driver IC 61 on the input side.

Output terminals (not shown) of the driver IC 61 mounted to the mounting area 7*c* are connected to the output lines $H_{1-2}$, $H_{3-4}$, respectively. Moreover, a control signal $CTL_1$ is applied commonly to control terminals of the odd-numbered analog switches $Q_1$, $Q_3$, . . . , and a control signal $CTL_2$ is applied commonly to control terminals of the even-numbered analog switches $Q_2$, $Q_4$, . . . . In the liquid crystal display device having the above arrangement, driving is performed for the first half and the latter half of one horizontal scanning period (1H), and thus the renewed gradation voltages are outputted from the driver IC 61 (source driver) to the output lines $H_{1-2}$, $H_{3-4}$, per 1H/2. For example, when the level of the control signal $CTL_1$ becomes high for the first half of one horizontal scanning period, the odd-numbered analog switches $Q_1$, $Q_3$, . . . conduct. Meanwhile, when the level of the control signal $CTL_2$ becomes high for the latter half of one horizontal scanning period, the even-numbered analog switches $Q_2$, $Q_4$, . . . conduct.

As a result, a number of the output terminals of the driver IC 61 can be reduced to about ½, without reducing a number of the data signal lines SL which determines resolution.

Here, with the above arrangement, two data signal lines SL are connected to the common output terminal of the driver IC 61, but three or more data signal lines SL may be connected to the common output terminal by increasing a number of control signals.

In the arrangement shown in FIG. 43, instead of the analog switches $Q_1$, $Q_2$, . . . , analog switches $AQ_1$, $AQ_2$, . . . are provided between the mounting area 7*c* and the picture element array 1. The odd-numbered analog switches $AQ_1$, $AQ_3$, . . . and the even-numbered analog switches $AQ_2$, $AQ_4$, . . . are formed so as to have different electrical conduction type from each other. For example, the analog switches $AQ_1$, $AQ_3$, . . . are composed of an n-channel type MOS FET (Metal-Oxide-Semiconductor Field-Effect-Transistor), and the analog switches $AQ_2$, $AQ_4$, . . . are composed of a p-channel type MOS FET.

With this arrangement, since the analog switches $AQ_1$, $AQ_3$, . . . and the analog switches $AQ_2$, $AQ_4$, . . . operates compensatingly with respect to the common control signal CTL, a number of control signal lines can be reduced to one.

In addition, since these analog switches $AQ_1$, $AQ_2$, . . . perform the ON/OFF operation per 1H/2 like the aforementioned analog switches $Q_1$, $Q_2$, . . . , they can perform the operation even at comparatively low speed. Therefore, the analog switches $AQ_1$, $AQ_2$, . . . as well as switching elements SW, etc. in the picture element array 1 can be formed on the substrate 7 monolithically.

Furthermore, in the present embodiment, the explanation was given as to the example that the present invention is applied to the liquid crystal display device, but the present invention can be applied to another image display device. Moreover, the present invention is not limited to this, so it can be applied to devices other than image display devices in order to achieve similar objects.

EMBODIMENT 2

The following describes the second embodiment of the present invention on reference to FIGS. 44 through 51. Here, for convenience of explanation, those members that have the same arrangement and functions, and that are described in the first embodiments are indicated by the same reference numerals.

Figure 44:
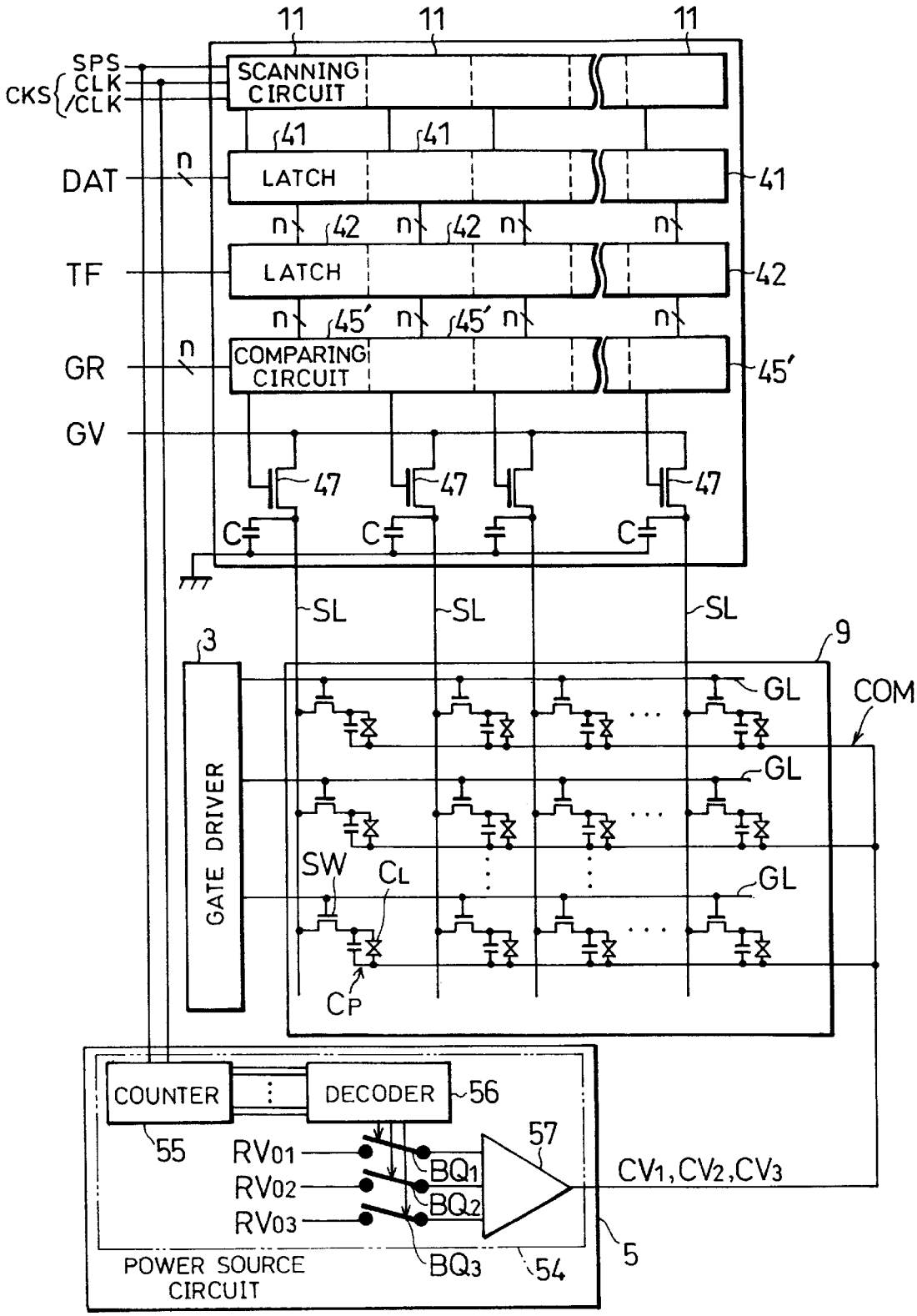
FIG. 44 is a block diagram which shows an arrangement of a first liquid crystal display device according to the second embodiment of the present invention.

As shown in FIG. 44, a first liquid crystal display device is provided with a display panel 9, the source driver 2, a gate driver 3 and a power source circuit 5.

The source driver 2 is composed of the scanning circuits 11, the latches 41, the latches 42, comparing circuits 45', the transistors 47 and the hold capacitor C. The comparing circuit 45', not shown, is composed of the equality comparator 45*a* in the aforementioned third source driver (see FIG. 36). When the comparing circuit 45' detects equality of a gradation reference signal GR (n bit) with a digital signal DAT (n bit) from the latch 42, it outputs a gate signal with high level.

Figure 45:
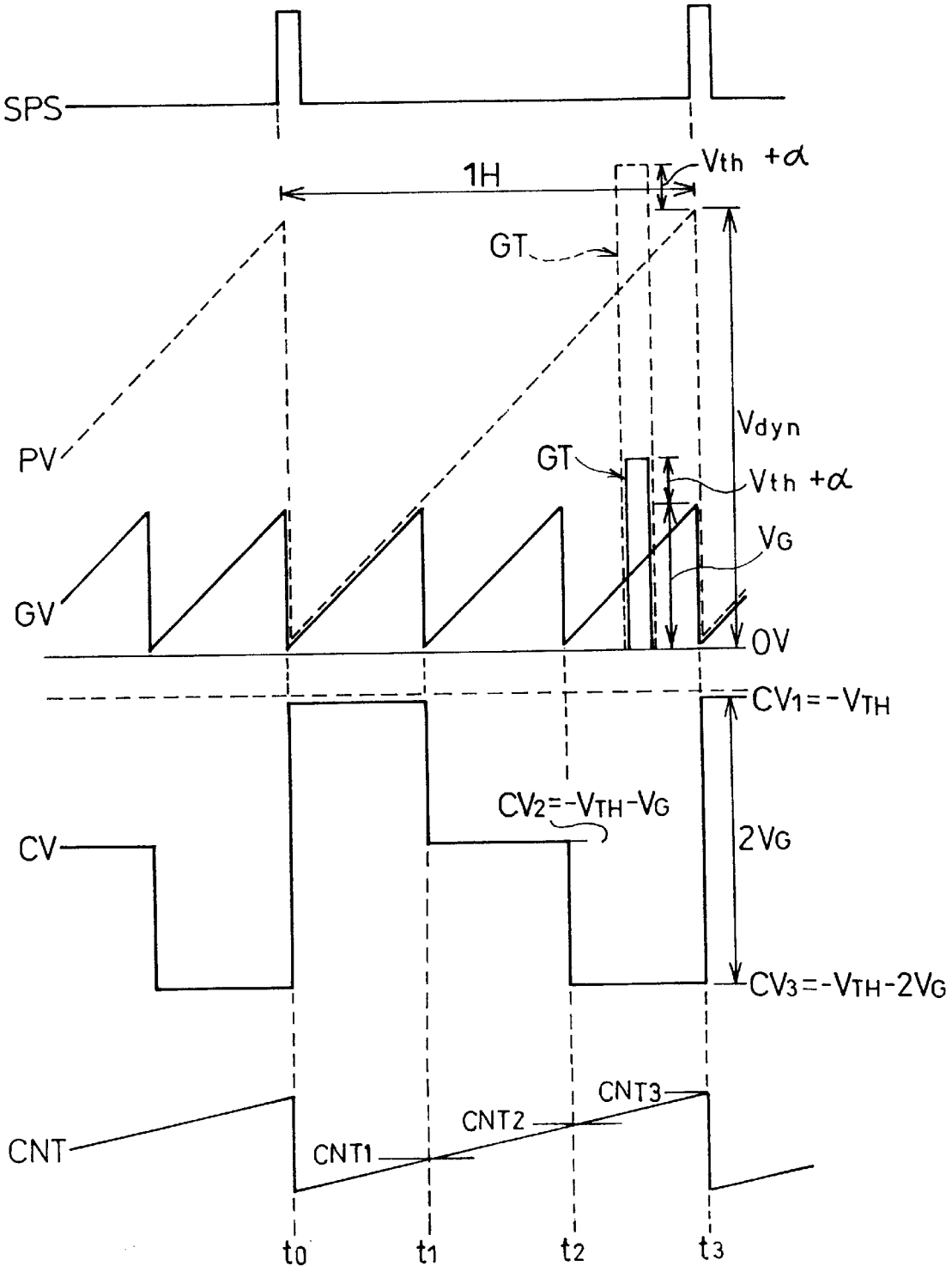
FIG. 45 is a waveform chart which shows an operation of the first liquid crystal display device.

The transistor 47 as an analog switch conducts due to the gate signal with high level so as to output a gradation voltage GV. The gradation voltage GV is applied from the gradation power source 6 (see FIG. 2), for example, and as shown in FIG. 45, the gradation voltage GV periodically changed in synchronization with the gradation reference voltage GR so that its amplitude level changes in a range of 0 to $V_G$. $V_G$ is set to a value which is ⅓ of a dynamic range $V_{dyn}$ corresponding to a range of off-level to on-level of liquid crystal as a display medium.

The selecting output circuit (selecting output means) is composed of the comparing circuit 45', the transistor 47 and the hold capacitor C.

In the source driver 2, when the transistors 47 conduct due to the gate signals outputted from the comparing circuits 45', voltages with 1 level of the gradation voltages GV is selected so as to be outputted from the transistors 47 through the hold capacitors C to the data signal line SL respectively. These voltages have a value corresponding to luminance levels of a video signal (digital signal DAT).

Here, since impedance becomes high when the transistor 47 is in the off-state, electric charges of the hold capacitor C are not discharged through the transistor 47.

On the other hand, the power source circuit 5 is provided with a common electric potential generating circuit 54 for generating a common electric potential CV to be applied to a common electrode COM. The common electric potential generating circuit 54 includes a counter 55, a decoder 56, a buffer 57 and analog switches $BQ_1$ through $BQ_3$. In FIG. 44, the common electrode COM is drawn linearly, but actually it is a face-like electrode which is connected to the switching element SW and faces a picture element electrodes, not shown.

As shown in FIG. 45, when a start pulse SPS is inputted to the counter 55 at time $t_o$, the counter 55 resets a count value CNT and starts a counting operation in synchronization with a clock CLK.

Every time when the counter 55 outputs the count values $CNT_1$ through $CNT_3$, the decoder 56 selectively switches conduction of the analog switches $BQ_1$ through $BQ_3$ per time $t_1$ through $t_3$ which is such that time between $t_0$ and $t_1$, time between $t_1$ and $t_2$, time between $t_2$ and $t_3$ are ⅓ of one horizontal scanning period (1H). For example, the analog switch $BQ_1$ conducts at the time between $t_0$ and $t_1$, the analog switch $BQ_2$ conducts at the time between $t_1$ and $t_2$, and the analog switch $BQ_3$ conducts at the time between $t_2$ and $t_3$.

Reference voltages $RV_{01}$ through $RV_{03}$ are applied respectively to contacts on the input side of the analog switches $BQ_1$ through $BQ_3$. The buffer 57 buffers and amplifies the reference voltage $RV_{01}$, $RV_{02}$ or $RV_{03}$ inputted from any contact on the output side of the analog switches $BQ_1$ through $BQ_3$ so as to output a common electric potential $CV_1$, $CV_2$ or $CV_3$ as a common electric potential CV to the common electrode COM. As a result, the common electric potential CV changes as shown in FIG. 45 for one horizontal scanning period.

Figure 46:
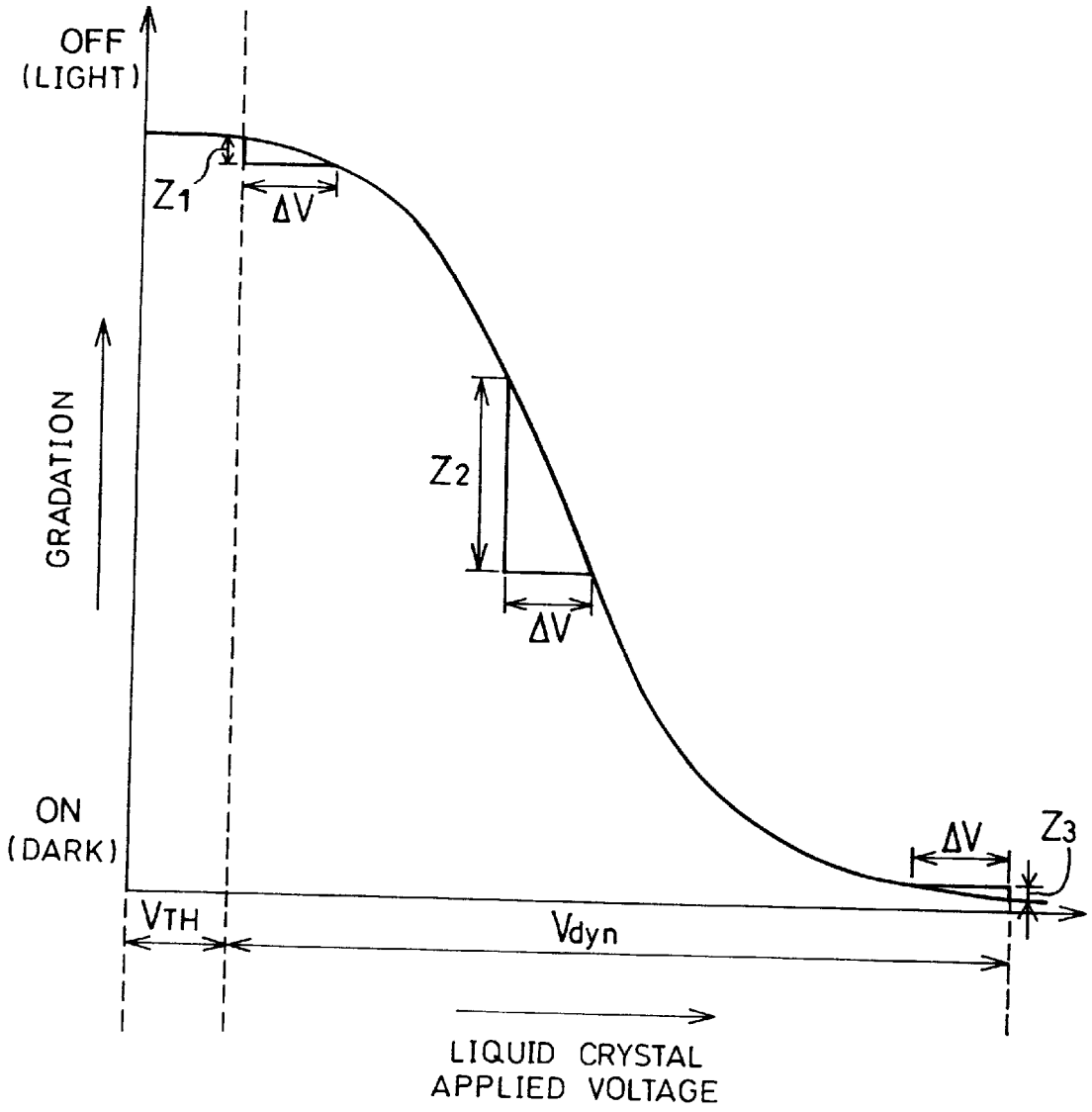
FIG. 46 is a graph which shows a changing characteristic of a display gradation with respect to an applied voltage to the liquid crystal.

As shown in FIG. 46, liquid crystal has such a property that as an applied voltage rises, gradation is lowered. For this reason, the applied voltage to the liquid crystal is determined by a dynamic range $V_{dyn}$ which makes it possible to obtain corresponding gradations in the range of on-level (dark) to off-level (light) and a threshold voltage $V_{TH}$ for operating the liquid crystal.

The common electric potential CV is set based upon such a property of the liquid crystal. Namely, the common electric potential $CV_1$ is set to electric potential $-V_{TH}$ so that the liquid crystal can be securely turned off even if the gradation voltage GV is 0V. Moreover, the common electric potential $CV_2$ is set to a value lower than $-V_{TH}$ by the voltage $V_G$, and the common electric potential $CV_3$ is set to a value lower than $-V_{TH}$ by $2V_G$.

Therefore, seemingly, a voltage PV to be applied to the picture element capacity $C_P$ changes as shown in TABLE 1. As a result, the voltage in the dynamic range $V_{dyn}$ of prescribed off-level to on-level.

TABLE 1

| Period | Common electric potential CV | Changing range |
|---|---|---|
| Time between $t_0$ and $t_1$ | $CV_1$ | $V_{TH}$ to $V_{TH} + V_G$ |
| Time between $t_1$ and $t_2$ | $CV_2$ | $V_{TH} + V_G$ to $V_{TH} + 2\ V_G$ |
| Time between $t_2$ and $t_3$ | $CV_3$ | $V_{TH} + 2\ V_G$ to $V_{TH} + 3\ V_G$ |

Here, the power consumption of the source driver 2 having the above arrangement is considered.

Figure 63:
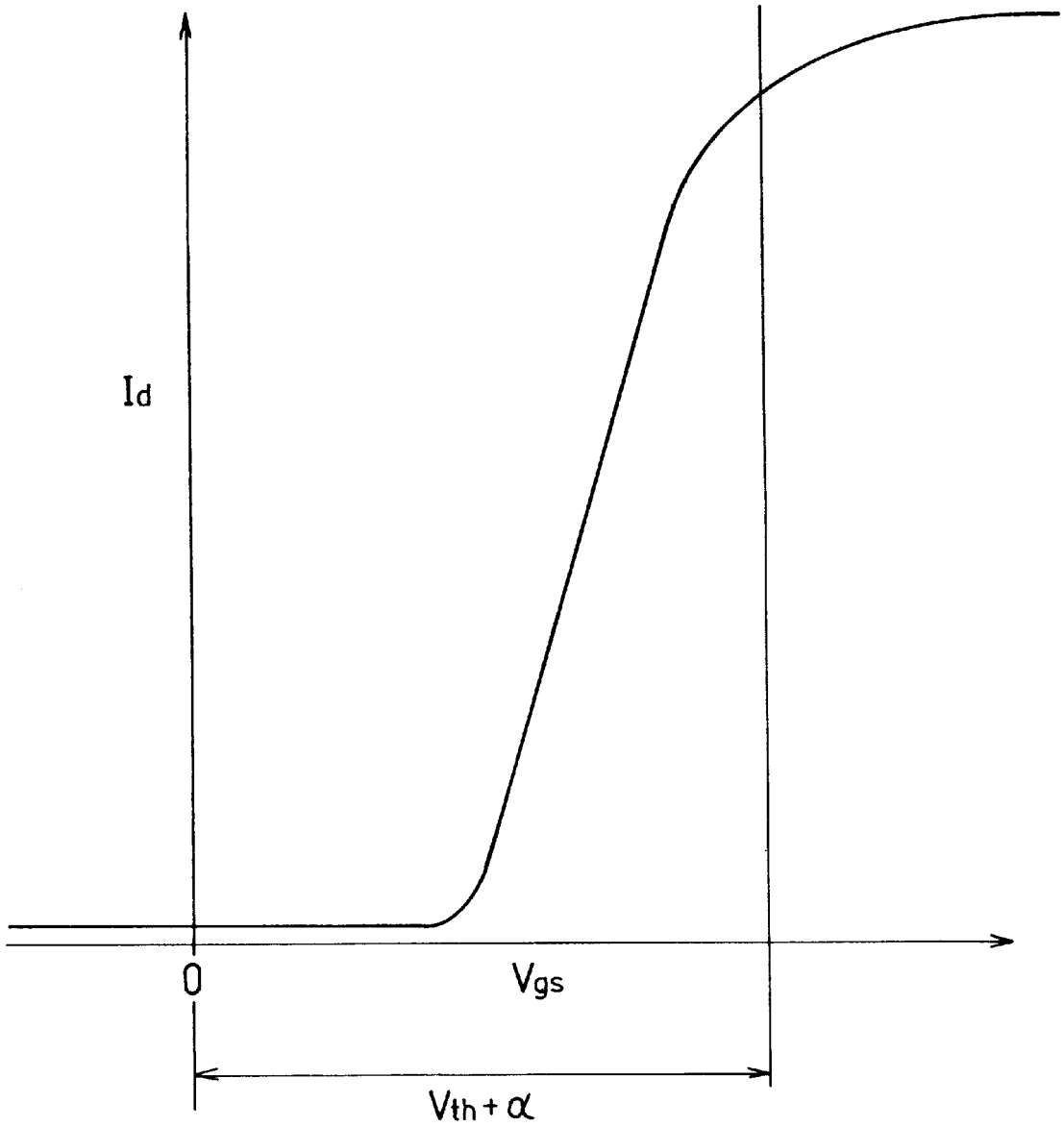
FIG. 63 PRIOR ART
FIG. 63 is a graph which shows an operating characteristic of an analog switch in the data signal line driving circuit in FIG. 58.
Figure 64:
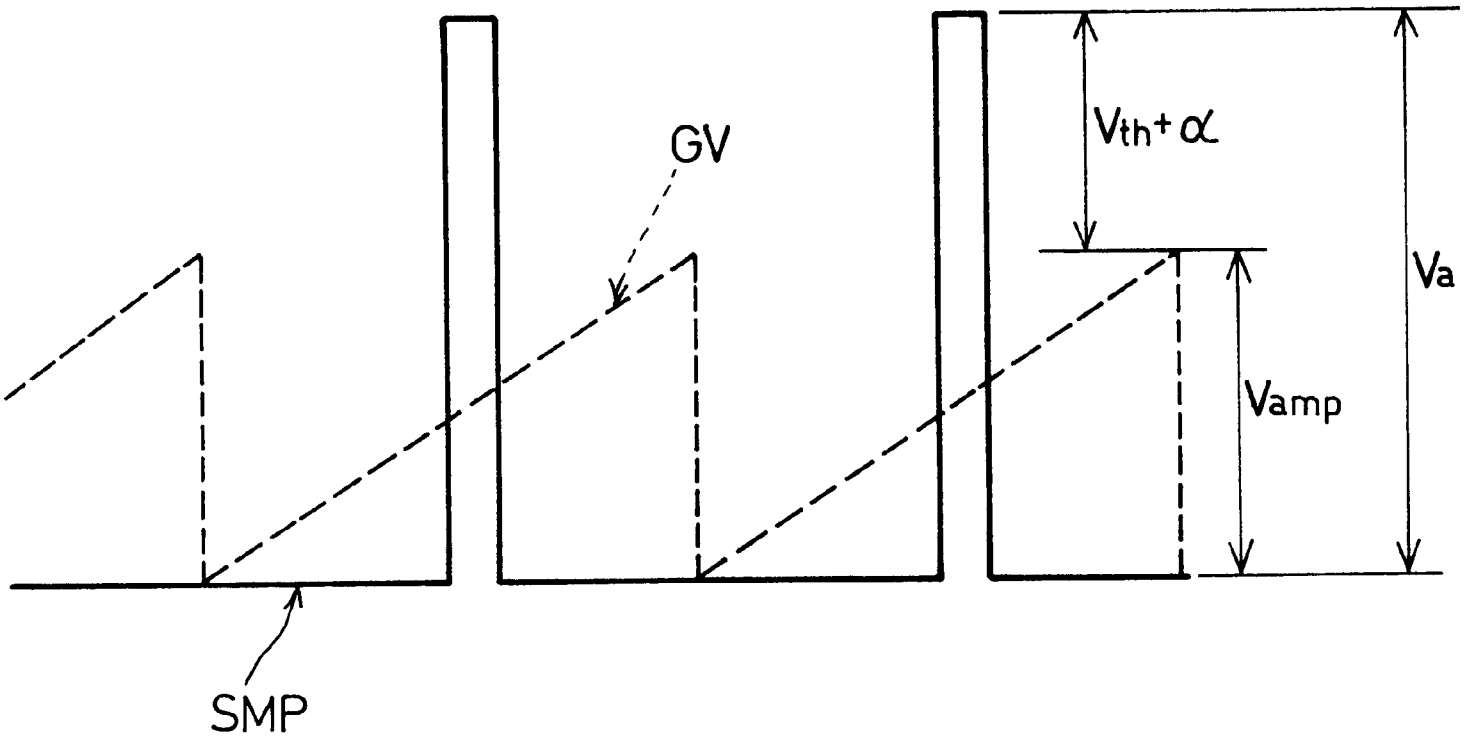
FIG. 64 PRIOR ART
FIG. 64 is a waveform chart which shows an operation of an output section in the data signal line driving circuit in FIG. 58 including the analog switch.
Figure 65:
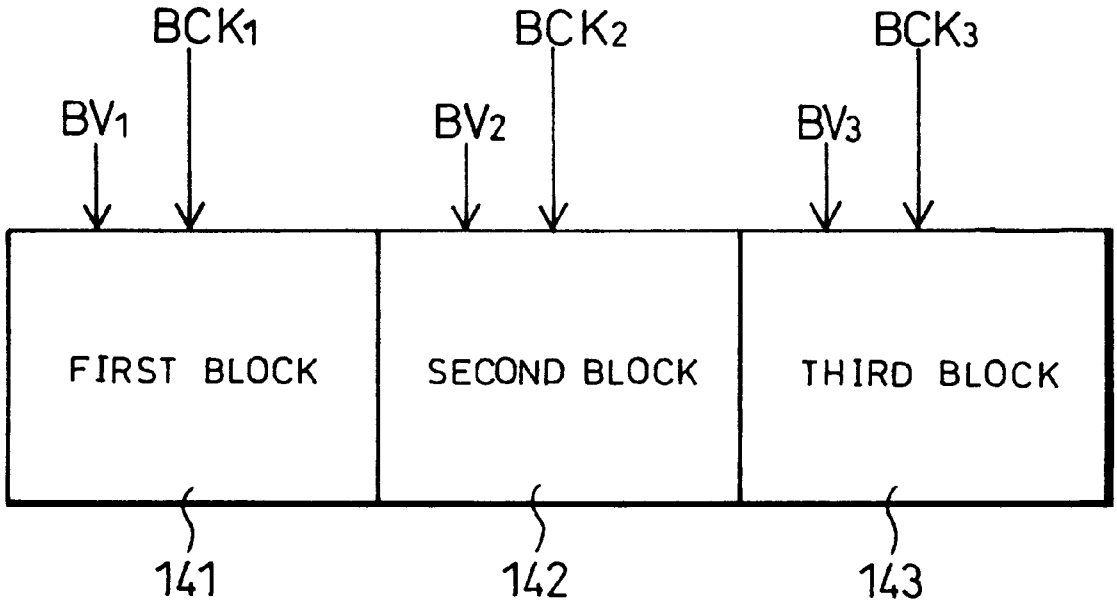
FIG. 65 PRIOR ART
FIG. 65 is a block diagram which shows a configuration of conventional divided data signal line driving circuits.
Figure 66:
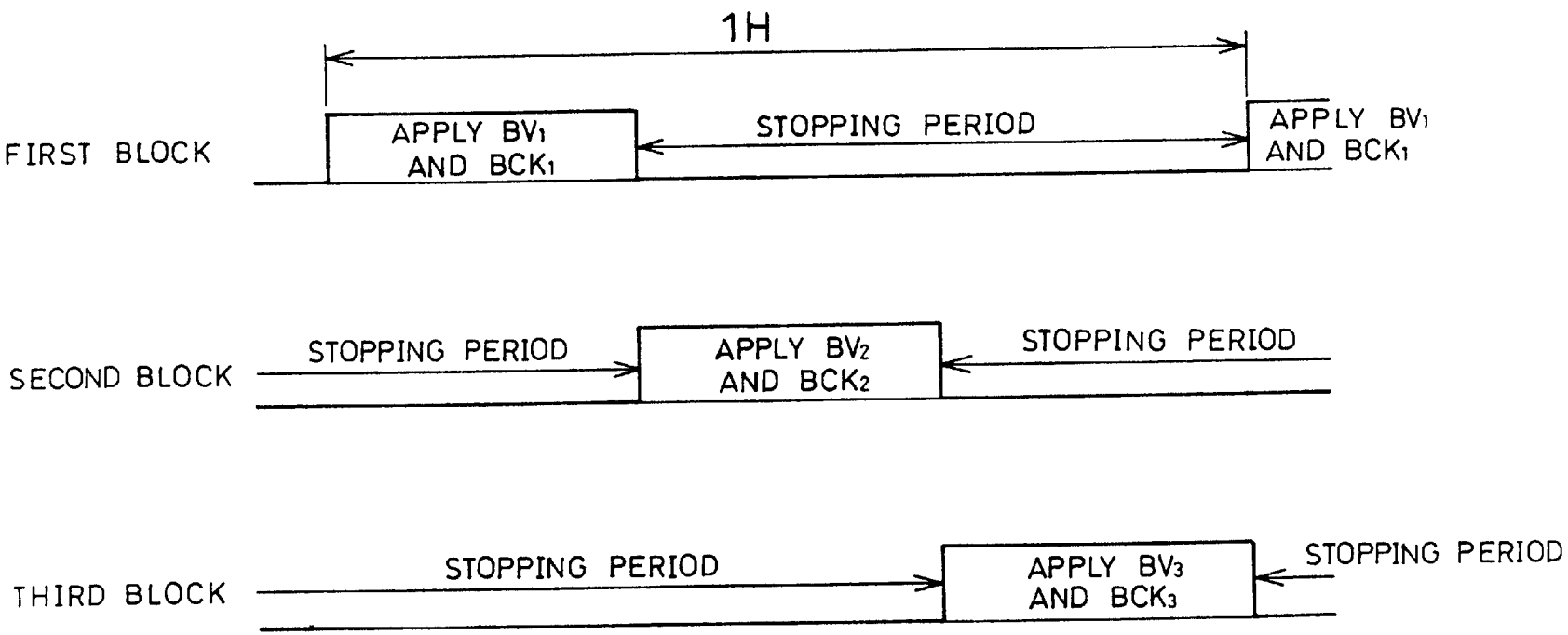
FIG. 66 PRIOR ART
FIG. 66 is a timing chart which shows operations of the data signal line driving circuits in FIG. 65.

In the transistor 47 as an n-channel type field effect transistor, a specific relationship is found between a gate-source voltage $V_{gs}$ and a drain current $I_d$ (see FIG. 63). According to this relationship, the electric potential $V_g$ of the gate electrode should have a value obtained by adding the threshold voltage $V_{th}$ required for conduction of the transistor 47 and an allowance $\alpha$ to the electric potential $V_s$ of the source electrode so that the drain current $I_d$ (gradation signal) can be sufficiently applied.

Therefore, an amplitude $V_{GT}$ of the gate signal GT should have a value obtained by adding "$V_{th}+\alpha$" to $V_G$ which is the maximum amplitude value of the gradation voltage GV as shown by the following equation. Moreover, an amplitude $V_{GT}'$ of the gate signal GT with respect to the voltage PV should have a value obtained by adding "$V_{th}+\alpha$" to the dynamic range $V_{dyn}$ as shown by the following equation.

$$V_{GT}=V_G+V_{th}+\alpha$$

$$V_{GT}'=V_{dyn}+V_{th}+\alpha$$

In the source driver 2 of the liquid crystal display device of the present invention, when the common voltage CV is set so as to have three stages, the maximum amplitude value of the gradation voltage GV can be suppressed to $V_G$, and thus the amplitude $V_{GT}'$ required for the voltage PV can be suppressed to the amplitude $V_{GT}$. As a result, in the source driver 2, the driving voltage of the circuits including the comparing circuit 45' for outputting the gate signal GT is lowered. For this reason, the power consumption of the source driver 2 can be reduced, and withstand voltages of the circuits become low, thereby reducing the cost of the source driver 2.

The output stage in the source driver 2 of the second liquid crystal display device is provided with output switches 48 for each of the data signal lines SL. The selecting output circuit (selecting output means) is composed of the comparing circuit 45', the output switch 48 and the hold capacitor C.

The output switches 48 have CMOS arrangement where an n-channel type transistor 48*a* and a p-channel type transistor 48*b* are connected in parallel. In order to actuate the transistor 48*b* and the transistor 48*a* simultaneously, an inverter 48*c* for inverting the gate signal from the comparing circuit 45' is required. In such output switches 48, the gradation voltage GV which changes between positive polarity and negative polarity can be used by providing the transistors 48*a* and 48*b* which respectively have different polarities.

Figure 48:
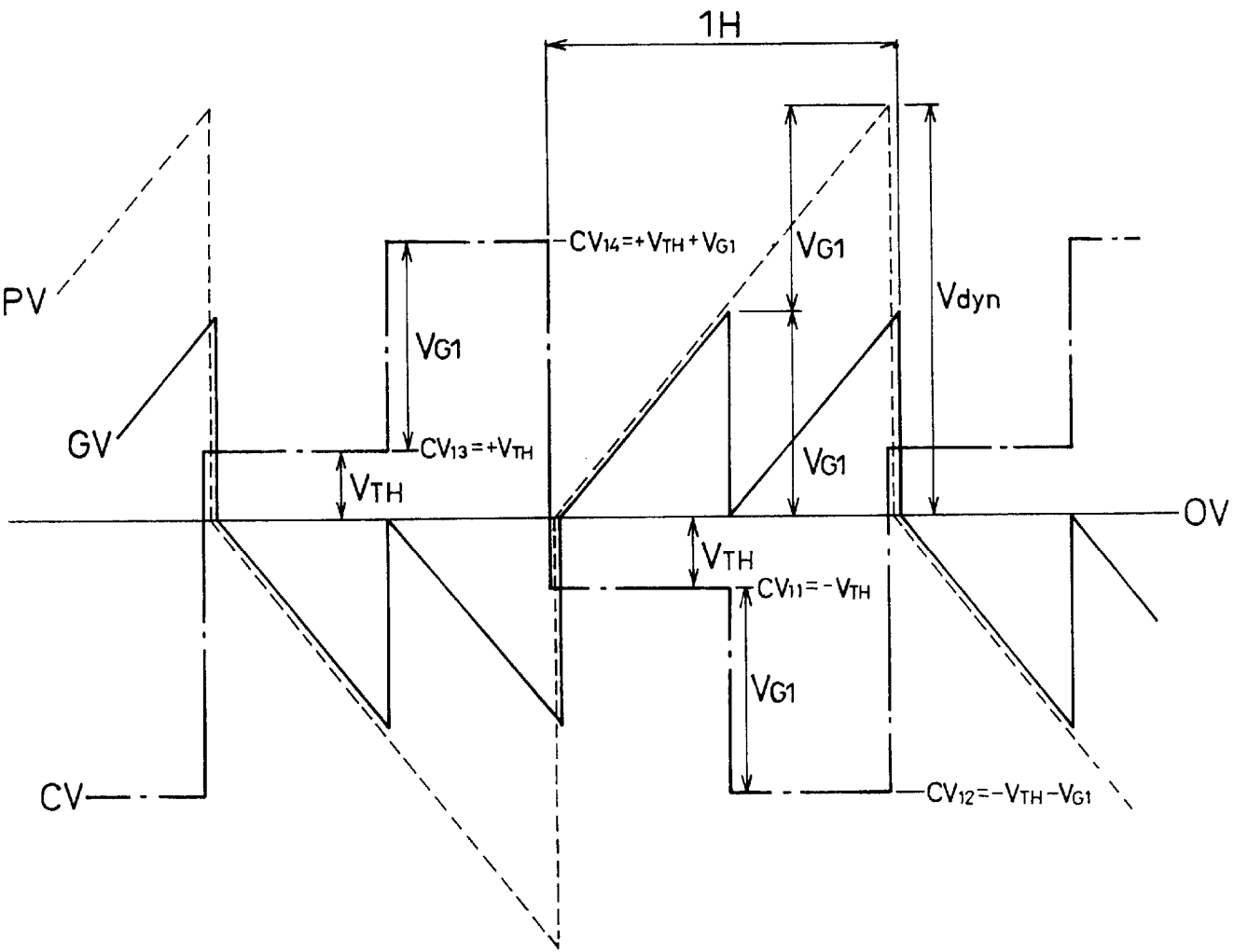
FIG. 48 is a waveform chart which shows an operation of the second liquid crystal display device.

The gradation voltage GV is applied from the aforementioned gradation power source 6 (see FIG. 2), for example, and as shown in FIG. 48, it is changed twice in the range of 0 to $V_{G1}$ for one horizontal scanning period (1H) in synchronization with the gradation reference voltage GR, and its polarity is inverted per 1H. $V_{G1}$ is set to ½ of the dynamic range $V_{dyn}$ corresponding to the range of off-level to on-level of liquid crystal as a display medium.

The common electric potential generating circuit 54 selectively outputs four common electric potentials $CV_{11}$ through $CV_{14}$ shown in FIG. 48 as the common electric potential CV to the common electrode COM correspondingly to the gradation voltage GV. More concretely, the common electric potential $CV_{11}$ is set to $-V_{th}$, and the common electric potential $CV_{12}$ is set to $-V_{th}-V_{G1}$. On the contrary, the common electric potential $CV_{13}$ is set to $+V_{th}$, and the common electric potential $CV_{14}$ is set to $+V_{th}+V_{G1}$. Moreover, the common electric potentials $CV_{11}$ through $CV_{14}$ has the opposite polarities to those of the corresponding gradation voltages GV.

Figure 47:
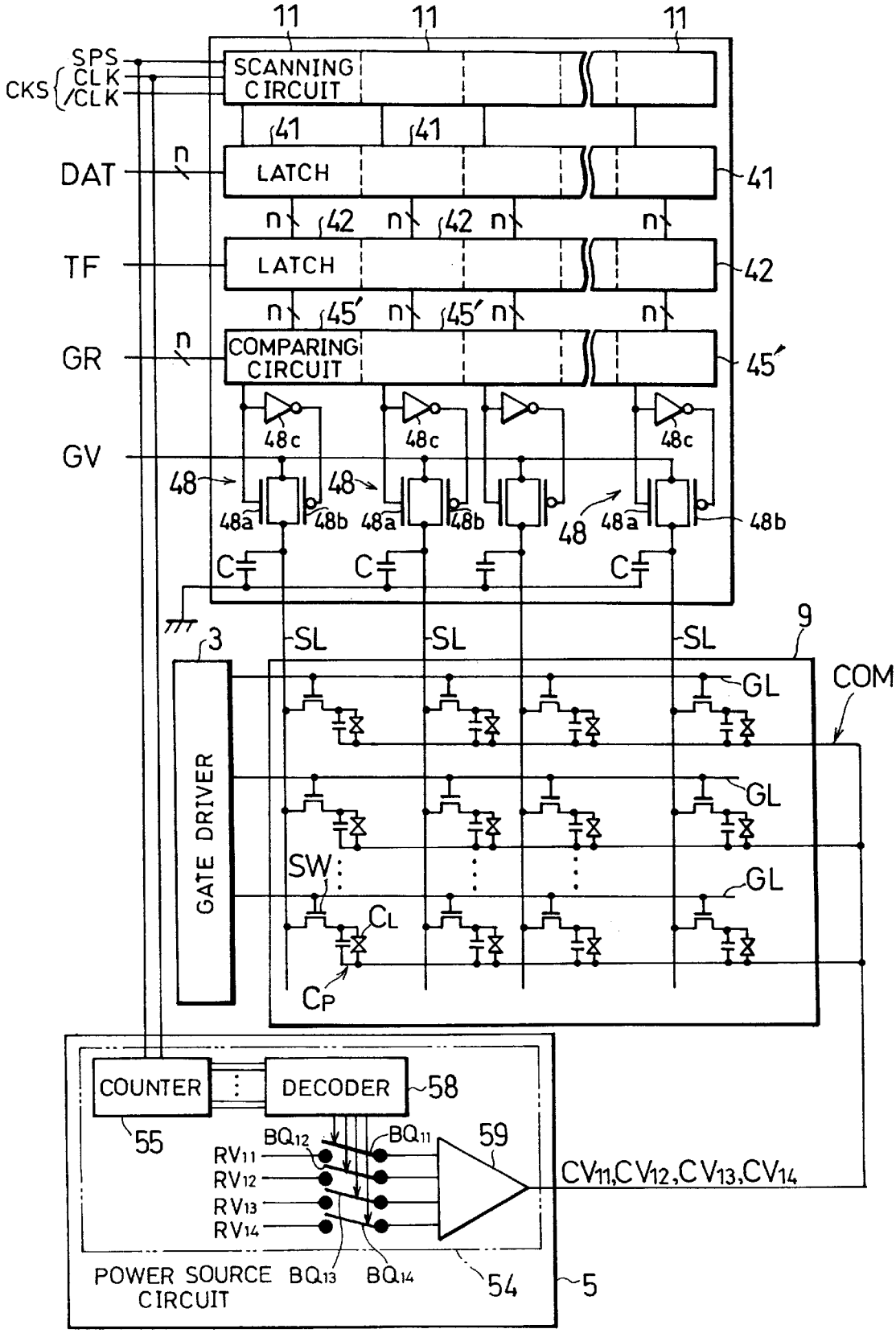
FIG. 47 is a block diagram which shows an arrangement of a second liquid crystal display de vice according to the second embodiment of the present invention.

In addition, as shown in FIG. 47, a decoder 58 selectively makes conduction of the analog switches $BQ_{11}$ through $BQ_{14}$ correspondingly to a counting value of the counter 55. A buffer 59 buffers and amplifies a reference voltage $RV_{11}$, $RV_{12}$, $RV_{13}$ or $RV_{14}$ inputted from any contact on the output side of the analog switches $BQ_{11}$ through $BQ_{14}$ so as to output the common electric potential $CV_{11}$, $CV_{12}$, $CV_{13}$ or $CV_{14}$ as the common electric potential CV to the common electrode COM. As a result, as shown in FIG. 48, the common electric potential CV becomes an electric potential which is different between the first half and the latter half of 1H by $V_{G1}$.

Therefore, the voltage PV applied to the picture element capacity $C_P$ changes between 0 to $V_{dyn}$ for 1H seemingly, and becomes an alternating voltage which inverts polarity per 1H. As a result, a chemical change of the liquid crystal which occurs due to applying of a driving voltage is suppressed compared to d.c. driving. For this reason, the reliability of the liquid crystal against aging is improved, and defective in display such as flicker can be suppressed.

Here, when the arrangement is made so that the common electric potential CV changes in the range of $+V_{th}$ to $+V_{th}+V_{G1}$ and in the range of $-V_{th}$ to $-V_{th}-V_{G1}$, if the common electric potentials $CV_{11}$ and $CV_{13}$ are 0V, one analog switch can be used in common as the analog switches $BQ_{11}$ and $BQ_{13}$.

In addition, the waveform of the gradation voltage GV is such a sawtooth waveform that its absolute value is increased from 0V, and when the absolute value becomes $V_{G1}$, the absolute value is again increased from 0V. The waveform of the gradation voltage GV is not limited to this, so it may be such a triangular waveform that when the absolute value reaches $V_{G1}$, it is decreased.

In addition, the gradation voltage GV may have polarities which are opposite to each other between two adjacent lines (data signal lines SL). Namely, in a certain frame, if the gradation voltage GV to the odd-numbered line has positive polarity and the gradation voltage GV to the even-numbered line has negative polarity, in the next frame, the gradation voltage GV to the odd-numbered line has negative polarity and the gradation voltage GV to the even-numbered line has positive polarity. In such a manner, when the polarity of the gradation voltage GV is inverted between lines, a display image with less flicker can be obtained.

In addition, in the first liquid crystal display device, the gradation voltage GV is changed three times per 1H, and in the second liquid crystal display device, the gradation voltage GV is changed three times per 1H. In the first and second liquid crystal display devices, the gradation voltage GV may be changed four times or more.

The following describes the gradation power source 6 which is suitable for the first and second liquid crystal display devices.

Figure 49:
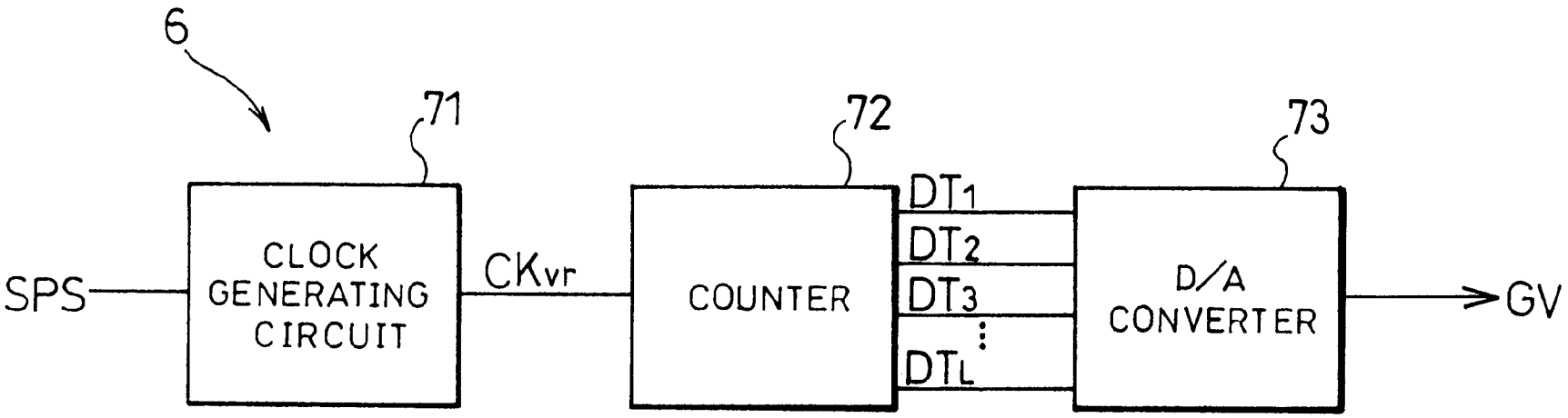
FIG. 49 is a block diagram which shows an arrangement of a gradation power source which is suitable for the first and second liquid crystal display devices.

As shown in FIG. 49, the gradation power source 6 is composed of a clock generating circuit 71, a counter 72 and a digital/analog converter (D/A converter) 73.

Figure 50:
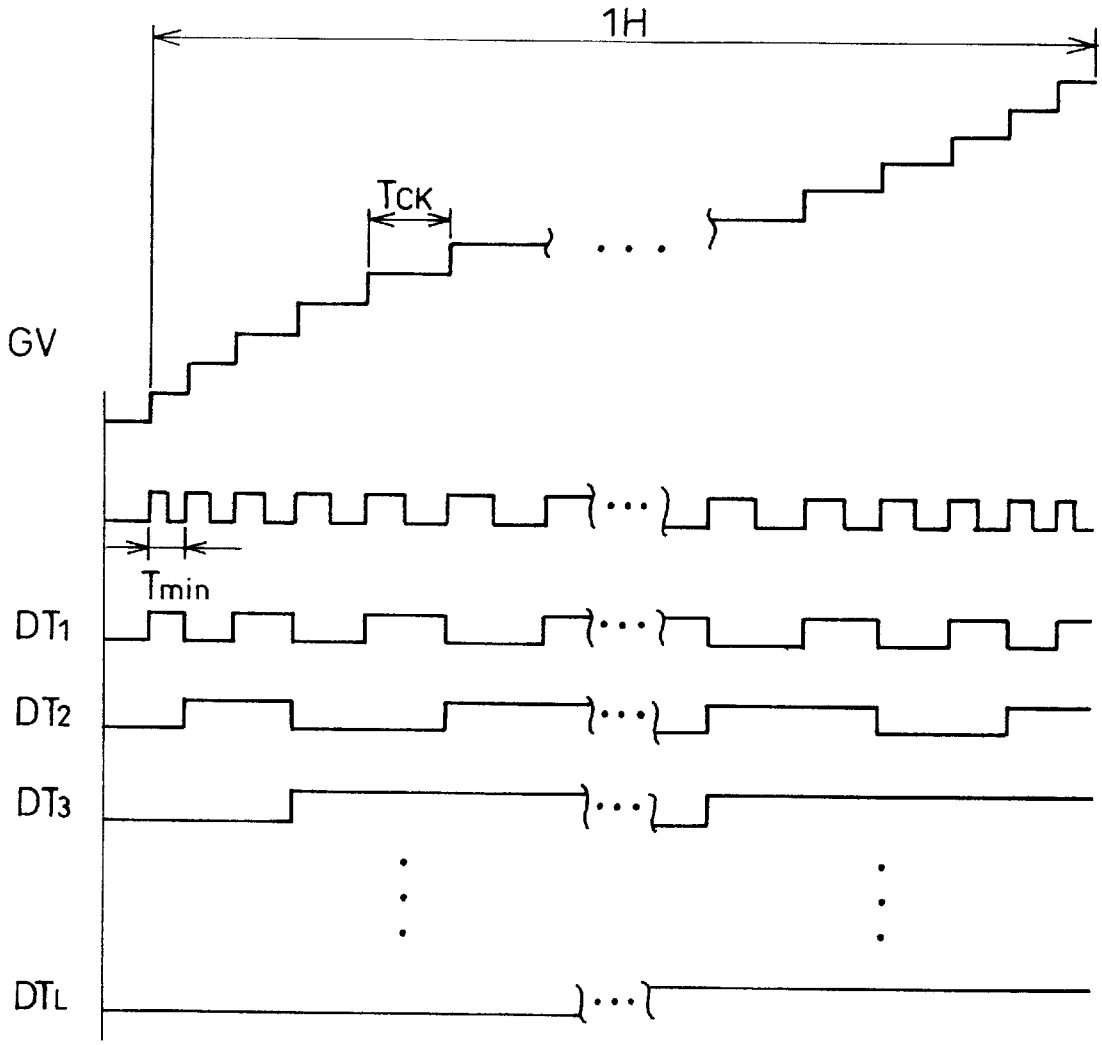
FIG. 50 is a timing chart which shows an operation of the gradation power source.
Figure 51:
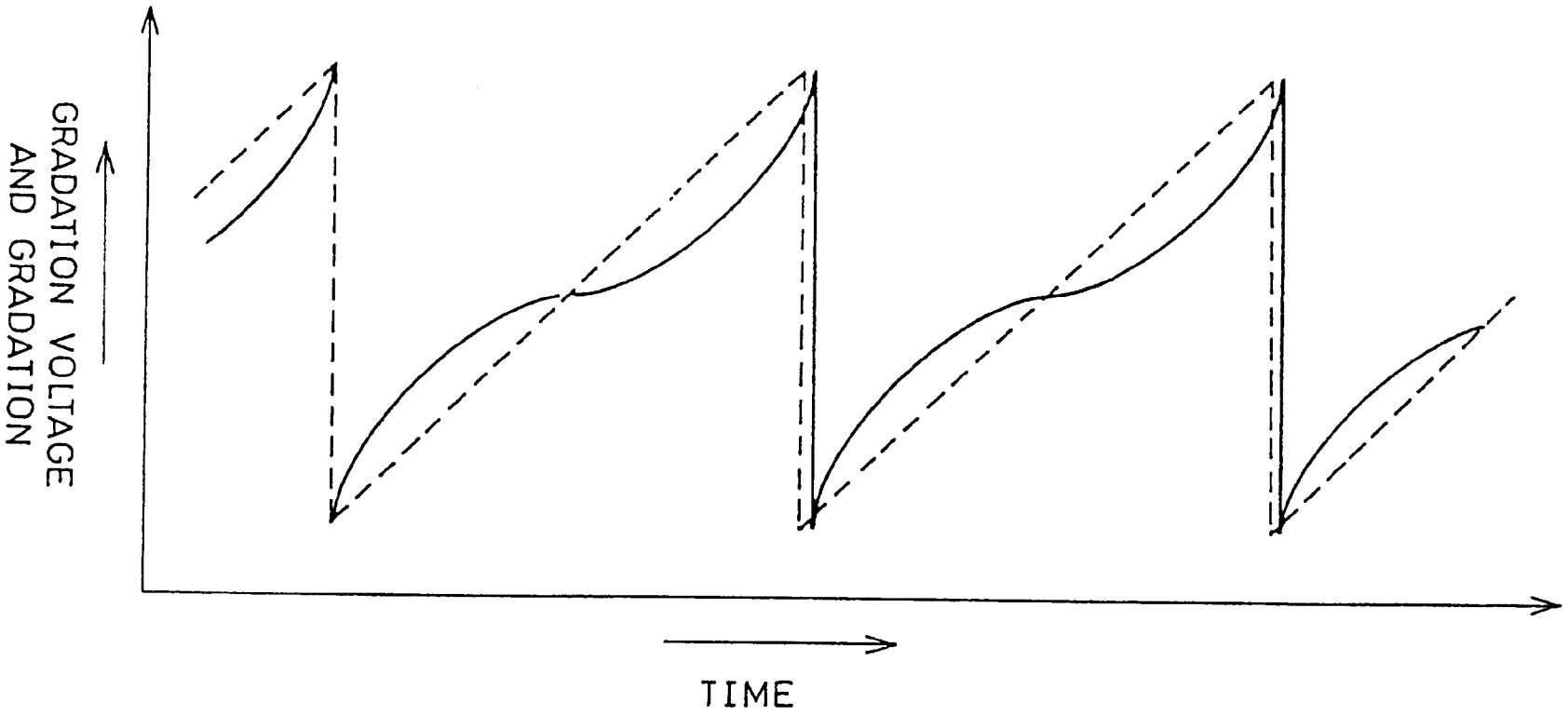
FIG. 51 is a waveform chart which shows a gradation voltage generated by the gradation power source and a gradation which changes according to the gradation voltage.
Figure 52:
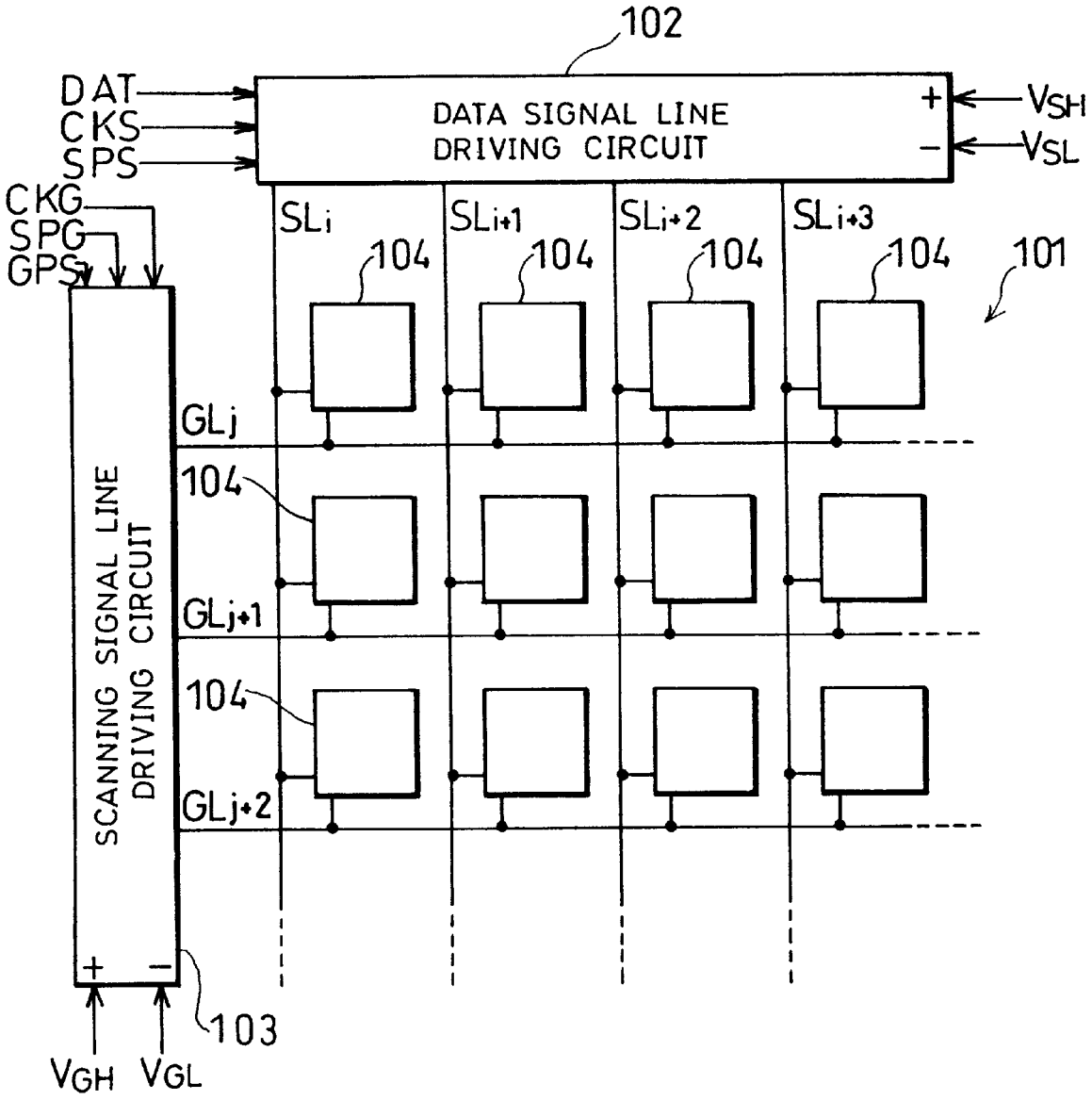
FIG. 52 PRIOR ART
FIG. 52 i s a block diagram which shows an arrangement of a main section of a conventional liquid crystal display device.
Figure 53:
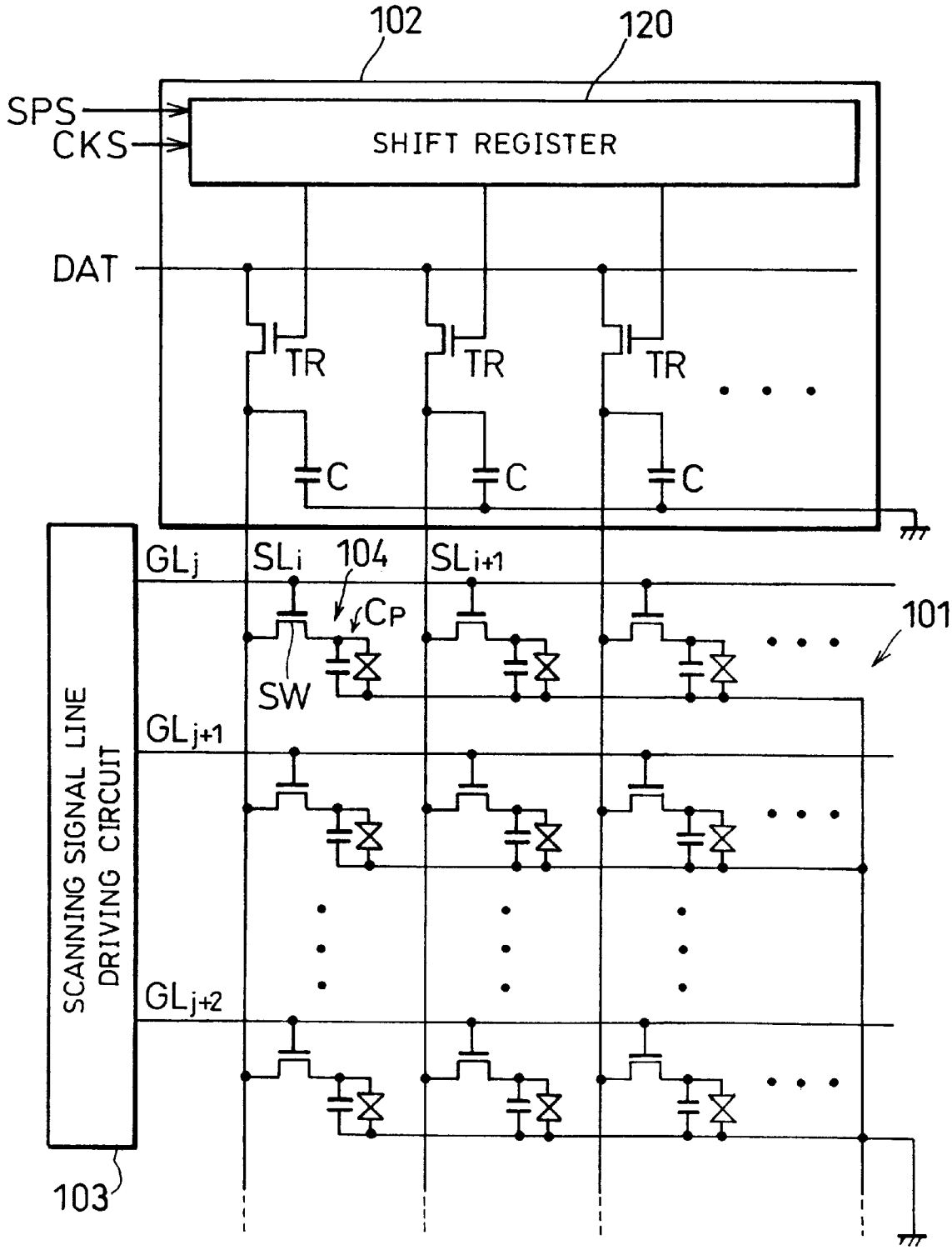
FIG. 53 PRIOR ART
FIG. 53 is a block diagram which shows an arrangement of a data signal line driving circuit adopting an analog method used in the liquid crystal display device shown in FIG. 52.
Figure 54:
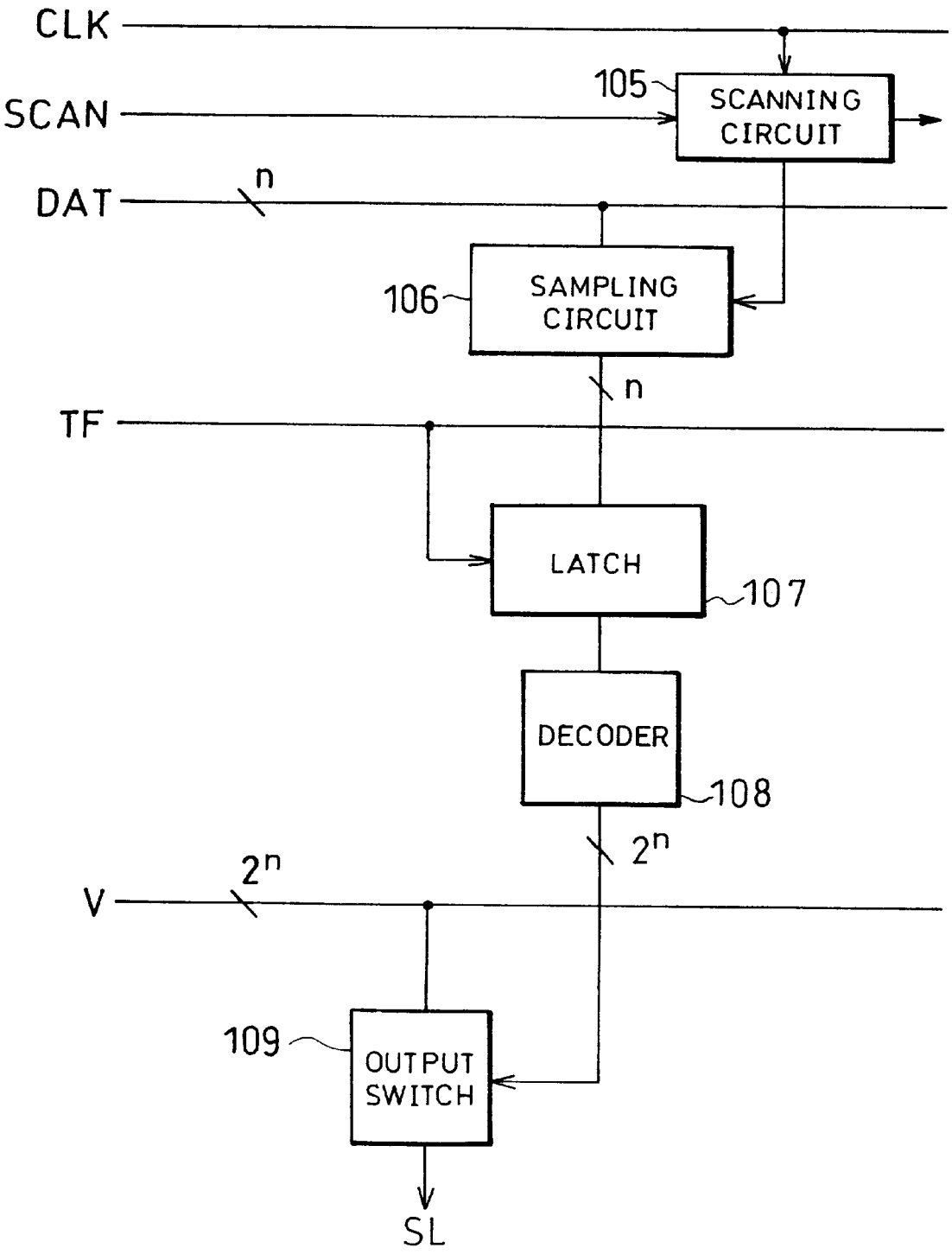
FIG. 54 PRIOR ART
FIG. 54 is a block diagram which shows an arrangement of a data signal line driving circuit adopting a digital method used in the liquid crystal display device shown in FIG. 52.
Figure 55:
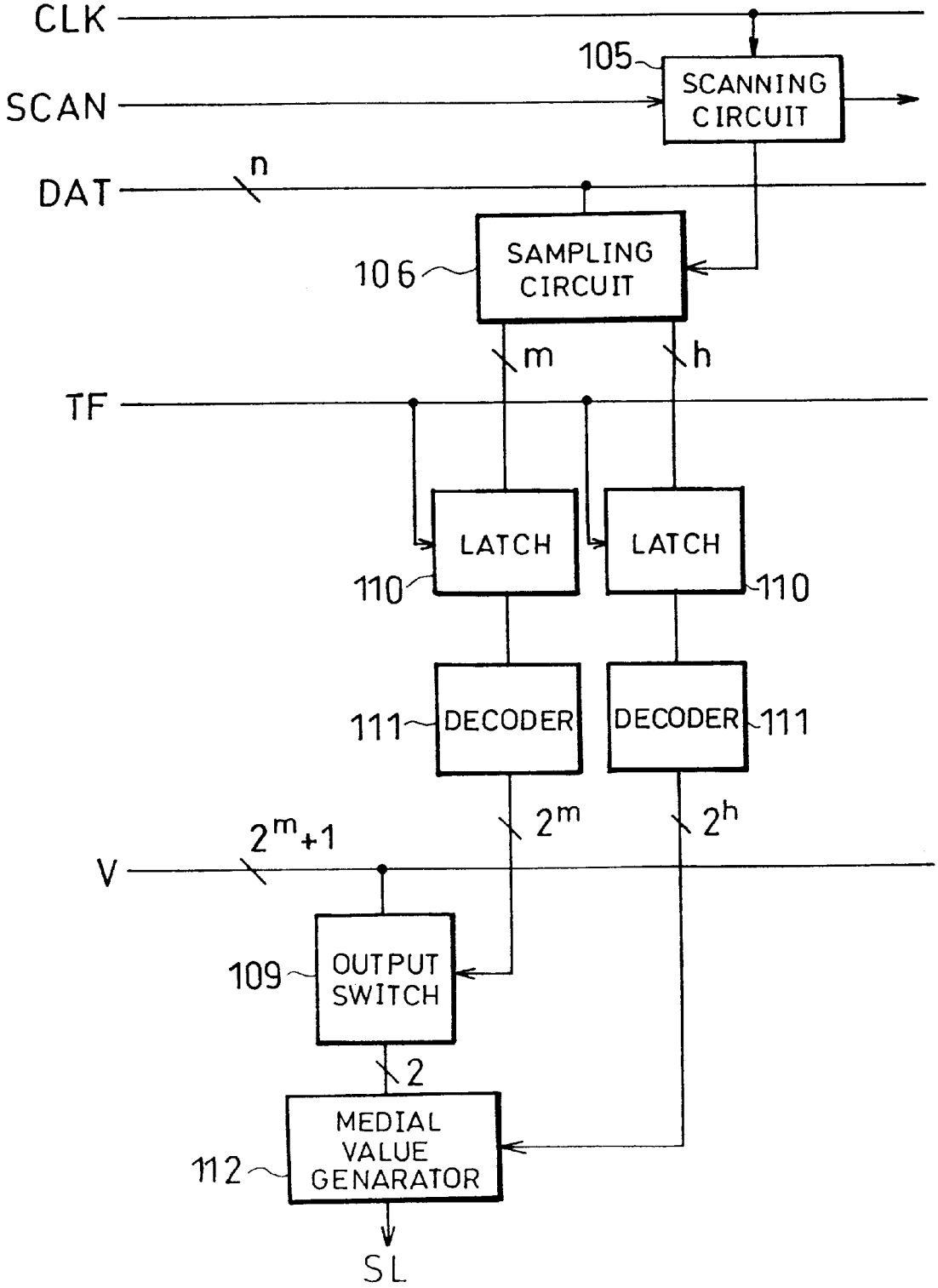
FIG. 55 PRIOR ART
FIG. 55 is a block diagram which shows another arrangement of the data signal line driving circuit adopting the digital method.
Figure 56:
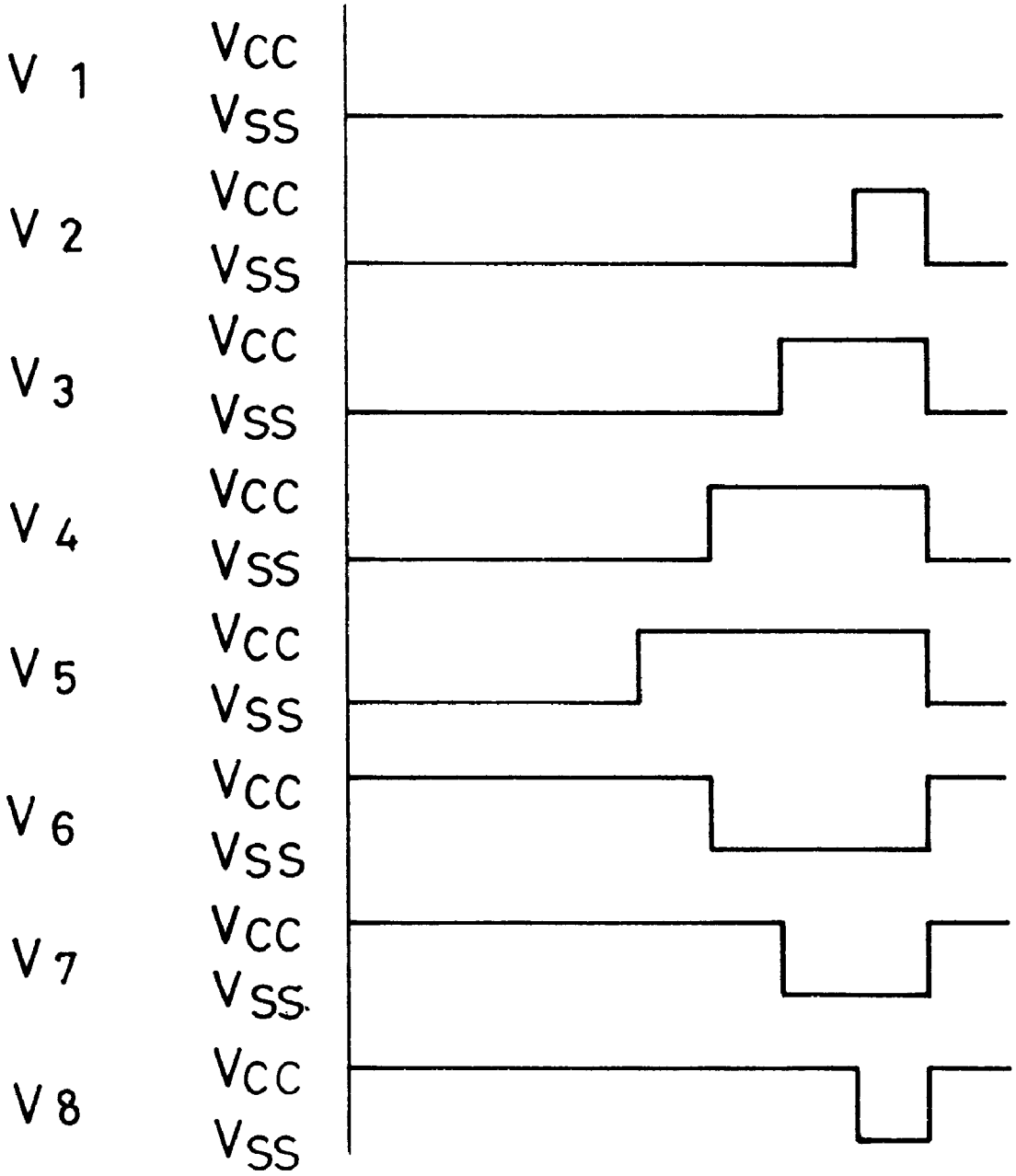
FIG. 56 PRIOR ART
FIG. 56 is a waveform chart which shows waveforms of an oscillating voltage used in a conventional data signal line driving circuit for displaying half-tone.
Figure 57:
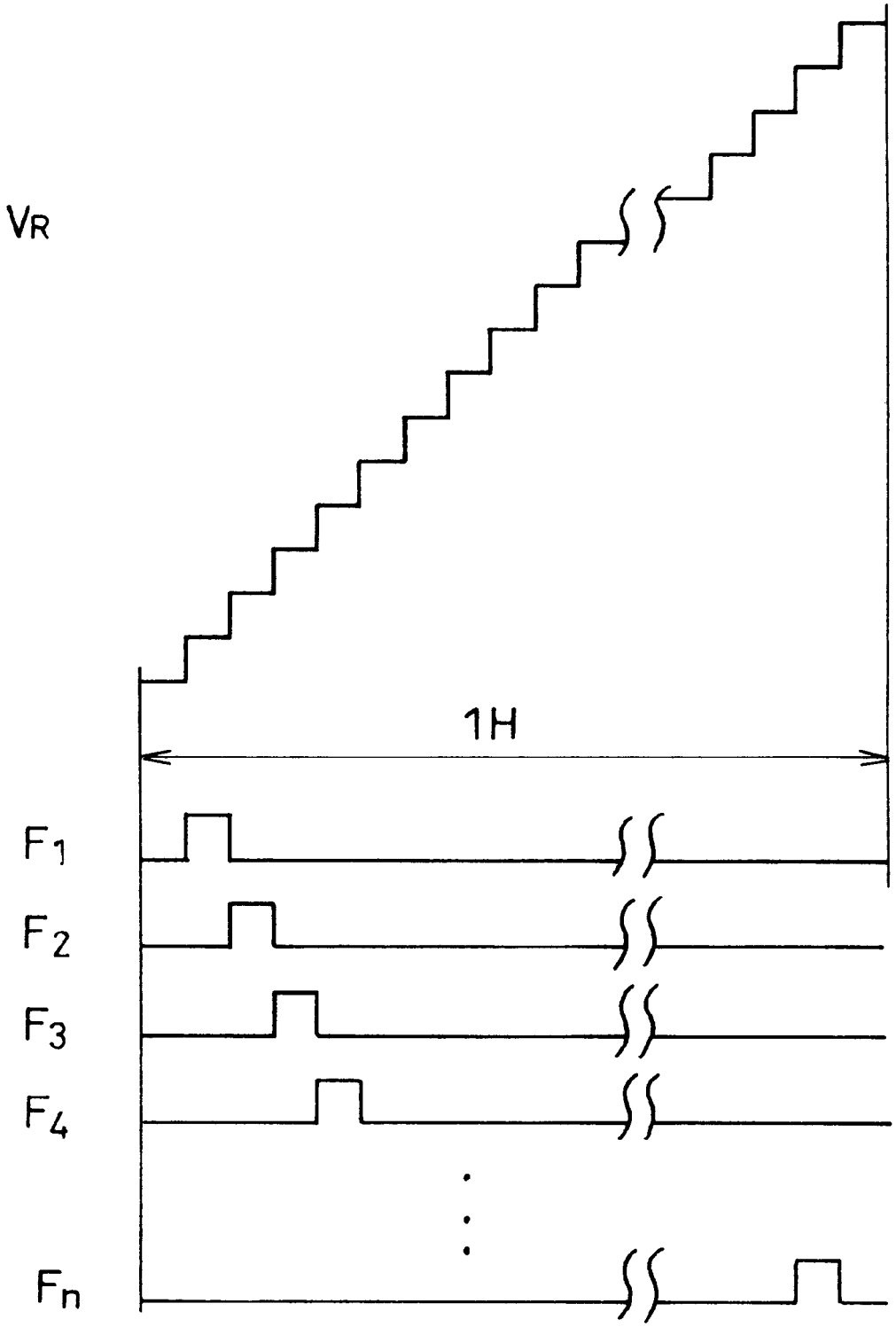
FIG. 57 PRIOR ART
FIG. 57 is a waveform chart which shows waveforms of the gradation voltage to be applied to another conventional data signal line driving circuit having one gradation power source line and of a signal for selecting the gradation voltage.

The clock generating circuit 71 generates a clock $CK_{vr}$ whose oscillating frequency changes per 1H in synchronization with the start pulse SPS. As shown in FIG. 50, as to the clock $CK_{vr}$, as the period comes closer to the beginning and the end of 1H, the period $T_{CK}$ becomes smaller, and becomes large in the proximity of the center portion.

The counter 72 divides the clock $CK_{vr}$, and outputs multi-bit divided signals $DT_1$ through $DT_L$ shown in FIG. 50. A rate of change in the level of the gradation voltage GV outputted from the D/A converter 73, as shown in FIG. 50, becomes large at the beginning and the end of 1H and becomes small in the proximity of its center portion.

As shown in FIG. 46, the liquid crystal has such a gamma characteristic that variations $Z_1$, $Z_2$ and $Z_3$ of the gradation per unit voltage $\Delta V$ in the proximity of the maximum value, minimum value and median of the applied voltage are different. For this reason, as shown by a solid line in FIG. 51, when the variation of the gradation voltage is set so as to become large in the proximity of the beginning and end of 1H and become small in the proximity of the central portion, as shown by a broken line in FIG. 51, the change of the gradation becomes linear. For this reason, the gamma characteristic of the liquid crystal can be corrected.

Needless to say, a shortest period $T_{min}$ of the clock $CK_{vr}$ is set longer than the times $T_{s1}$ and $T_{s2}$ required for writing the gradation signal to the liquid crystal capacity $C_L$.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A voltage output circuit comprising:

a plurality of power source lines to which different voltages are applied per divided period obtained by dividing a scanning period into a plurality of periods;

first decoding means for outputting $2^m$ decoded signals based upon m bits (1<m<n) from a n-bit digital signal;

second decoding means for outputting $2^k$ decoded signals based upon k bits (k=n−m) of the digital signal, wherein $2^m$ power source lines are provided for the digital signal; and selecting output means for selecting one of said power source lines for at least one divided period of the divided periods based upon a plural bit digital signal so as to output a voltage applied to the selected power source line during the divided period wherein said selecting output means includes:

period selecting means for selecting at least one divided period of the divided $2^k$ periods based upon the decoded signal from said second decoding means, output control means for outputting a control signal, which is effective in one of said power source lines only for the divided period selected by said period selecting means, based upon an output signal from said period selecting means and the decoded signal from said first decoding means, and output means which conducts due to the control signal from said output control means and outputs a voltage to be applied to the selected power source line.

2. The voltage output circuit according to claim 1, wherein said output means includes $2^m$ transistors respectively connected to said power source lines.

3. The voltage output circuit according to claim 1, wherein said output means includes $2^m$ transfer gates respectively connected to said power source lines.

4. The voltage output circuit according to claim 1, wherein the ranges of the voltages to be applied respectively to said power source lines for the scanning period are separated from each other among said power source lines.

5. The voltage output circuit according to claim 4, wherein the voltages have a lamp waveform that levels of the voltages change like a staircase per divided period.

6. The voltage output circuit according to claim 4, wherein the voltages have a lamp waveform such that levels of the voltages change linearly.

7. The voltage output circuit according to claim 4, wherein the voltages have a lamp waveform that levels of the voltages rise like a staircase per divided period with distances of each level being kept uniform and the voltages are applied to said $2^m$ power source lines simultaneously for the same divided periods.

8. The voltage output circuit according to claim 1, wherein said period selecting means selects one of the divided periods.

9. The voltage output circuit according to claim 8, wherein said period selecting means includes:

inverters for inverting pulse signals having different periods individually;

AND circuits for obtaining ANDs of different combination of a prescribed number of signals in the pulse signals and the inverted pulse signals from said inverters so as to output period selecting signals corresponding to the divided periods respectively; and transistors which conduct due to the decoded signal from said second decoding means and output one of the period selecting signals from said AND circuits.

10. The voltage output circuit according to claim 1, wherein said period selecting means selects a plurality of continuing divided periods from a first divided period to a divided period of inputting a desired digital signal in the divided periods.

11. The voltage output circuit according to claim 10, wherein said period selecting means includes:

inverters for inverting pulse signals having different periods individually;

AND circuits for obtaining ANDs of different combinations of a prescribed number of signals in the pulse signals and the inverted pulse signals from said inverters;

OR circuits for obtaining ORs of the output signal from the corresponding AND circuit and the output signal from the next AND circuit so as to output period selecting signals corresponding to the divided periods respectively; and transistors which conduct due to the decoded signal from said second decoding means and output one of the period selecting signals from said OR circuits.

12. The voltage output circuit according to claim 10, wherein said period selecting means includes:

inverters for inverting pulse signals having different periods individually;

AND circuits for obtaining ANDs of different combinations of a prescribed number of signals in the pulse signals and the inverted pulse signals from said inverters;

RS-type flip flops which are reset by the output signal from the corresponding AND circuit and are set commonly by an external signal so as to output the period selecting signals corresponding to the divided periods; and transistors which conduct due to the decoded signal from said second decoding means and output one of the period selecting signals from said flip flops.

13. The voltage output circuit according to claim 1, further comprising:

a counter for generating k-numbered pulse signals having different periods, wherein said period selecting means outputs $2^k$ period selecting signals, which are effective for each divided period, based upon the pulse signals from said counter.

14. The voltage output circuit according to claim 1, further comprising sampling means provided separately from signal lines for supplying each bit composing the digital signal, said sampling means sampling the bits based upon a common sampling signal.

15. The voltage output circuit according to claim 1, further comprising sampling means provided on signal lines for supplying each bit composing the digital signal, said sampling means sampling the bits based upon a common clock.

16. The voltage output circuit according to claim 1, further comprising:

decoding means for outputting $2^n$ decoded signals based upon all bits of the n-bit digital signal, wherein said m-numbered power source lines are provided for the digital signal, and said selecting output means includes:

period selecting means for selecting at least one divided period of the periods divided into k based upon the decoded signal from said decoding means;

output control means for outputting a control signal, which is effective only for the divided period selected by said period selecting means on one of said power source lines, based upon the output signal from said period selecting means and the decoded signal from said decoding means; and output means which conducts due to the control signal from said output control means and outputs a voltage to be applied to a selected power source line, wherein a number m of said power source lines and a number k of the divided periods are set so that a relationship "$2^n \leqq m*k$" is fulfilled.

17. The voltage output circuit according to claim 16, wherein said output means includes $2^m$ transistors respectively connected to said power source lines.

18. The voltage output circuit according to claim 16, wherein said output means includes $2^m$ transfer gates respectively connected to said power source lines.

19. The voltage output circuit according to claim 16, wherein said period selecting means selects one of the divided periods.

20. The voltage output circuit according to claim 16, wherein said period selecting means selects a plurality of continuing divided periods from a first divided period to a divided period of inputting a desired digital signal in the divided periods.

21. The voltage output circuit according to claim 16, further comprising:

a counter for generating k-numbered pulse signals having different periods, wherein said period selecting means outputs k-numbered period selecting signals, which are effective for the divided periods, based upon the pulse signals from said counter.

22. The voltage output circuit according to claim 16, further comprising sampling means provided separately from signal lines for supplying each bit composing the digital signal, said sampling means sampling the bits based upon a common sampling signal.

23. The voltage output circuit according to claim 16, further comprising sampling means provided on signal lines for supplying each bit composing the digital signal, said sampling means sampling the bits based upon a common clock.

24. A voltage output circuit comprising:

a plurality of power source lines to which different voltages are applied per divided period obtained by dividing a scanning period into a plurality of periods;

selecting output means for selecting two of said power source lines for at least one divided period of the divided periods based upon a plural bit digital signal so as to output voltages applied to the selected power source lines during the divided period; and medial value generating means for generating a plurality of medial values of two voltages selected by said selecting output means.

25. The voltage output circuit according to claim 24, further comprising:

first decoding means for outputting $2^m$ decoded signals based upon m bits ($1<m<n$) from a n-bit digital signal;

second decoding means for outputting $2^k$ decoded signals based upon k bits ($1<k<n-m$) of the digital signal; and third decoding means for outputting $2^h$ decoded signals based upon h bits ($h=n-m-k$) of the digital signal, wherein $2^m+1$ power source lines are provided for the n-bit digital signal, and said selecting output means includes:

period selecting means for selecting at least one divided period of the divided $2^k$ periods based upon the decoded signal from said second decoding means, output control means for outputting a control signal, which is effective in two of said power source lines only for the divided period selected by said period selecting means, based upon an output signal from said period selecting means and the decoded signal from said first decoding means, and output means which conducts due to the control signal from said output control means and outputs voltages to be applied to the selected power source lines, wherein said medial value generating means selects one of voltages divided plurally between two voltages based upon the decoded signal from said third decoding means.

26. The voltage output circuit according to claim 25, wherein said output means includes $2^{m+1}$ transistors respectively connected to said power source lines.

27. The voltage output circuit according to claim 25, wherein said output means includes $2^{m+1}$ transfer gates respectively connected to said power source lines.

28. The voltage output circuit according to claim 24, wherein the ranges of the voltages to be applied respectively to said power source lines for the scanning period are continued among said power source lines.

29. The voltage output circuit according to claim 28, wherein the voltages have a ramp waveform such that levels of the voltages rise like staircase per divided period with distances of each level being kept uniform and the voltages are applied to said $2^{m+1}$ power source lines simultaneously for the same divided periods, and a highest voltage for each divided period and a lowest voltage for the next divided period are set so as to have the same level.

30. The voltage output circuit according to claim 25, wherein said period selecting means selects one of the divided periods.

31. The voltage output circuit according to claim 30, wherein said period selecting means includes:

inverters for inverting pulse signals having different periods individually;

AND circuits for obtaining ANDs of different combinations of a prescribed number of signals in the pulse signals and the inverted pulse signals from said inverters so as to output period selecting signals corresponding to the divided periods respectively; and transistors which conduct due to the decoded signal from said second decoding means and output one of the period selecting signals from said AND circuits.

32. The voltage output circuit according to claim 25, wherein said period selecting means selects a plurality of continuing divided periods from a first divided period to a divided period of inputting a desired digital signal in the divided periods.

33. The voltage output circuit according to claim 32, wherein said period selecting means includes:

inverters for inverting pulse signals having different periods individually;

AND circuits for obtaining ANDs of different combinations of a prescribed number of signals in the pulse signals and the inverted pulse signals from said inverters;

OR circuits for obtaining ORs of the output signal from the corresponding AND circuit and the output signal from the next AND circuit so as to output period selecting signals corresponding to the divided periods respectively; and transistors which conduct due to the decoded signal from said second decoding means and output one of the period selecting signals from said OR circuits.

34. The voltage output circuit according to claim 32, wherein said period selecting means includes:

inverters for inverting pulse signals having different periods individually;

AND circuits for obtaining ANDs of different combinations of a prescribed number of signals in the pulse signals and the inverted pulse signals from said inverters;

RS-type flip flops which are reset by the output signal from the corresponding AND circuit and are set commonly by an external signal so as to output the period selecting signals corresponding to the divided periods; and transistors which conduct due to the decoded signal from said second decoding means and output one of the period selecting signals from said flip flops.

35. The voltage output circuit according to claim 25, further comprising:

a counter for generating k-numbered pulse signals having different periods, wherein said period selecting means outputs $2^k$ period selecting signals, which are effective for the divided periods, based upon the pulse signals from said counter.

36. The voltage output circuit according to claim 25, further comprising sampling means provided separately from signal lines for supplying each bit composing the digital signal, said sampling means sampling the bits based upon a common sampling signal.

37. The voltage output circuit according to claim 25, further comprising sampling means provided on signal lines for supplying each bit composing the digital signal, said sampling means sampling the bits based upon a common clock.

38. The voltage output circuit according to claim 25, wherein said medial value generating means includes:

$2^h$ resistors connected each other in a series; and the same number of transfer gates as said resistors, which conduct due to the decoded signal from said third decoding means and output a voltage on one terminal of said each resistor.

39. The voltage output circuit according to claim 25, wherein said medial value generating means is resistor dividing circuits composed of $2^h$ resistors connected in a series, said resistors connecting adjacent two power source lines.

40. The voltage output circuit according to claim 25, wherein the ranges of the voltages to be applied respectively to said power source lines for the scanning period are continued among said power source lines.

41. The voltage output circuit according to claim 25, wherein the voltages have a ramp waveform that levels of the voltages rise like staircase per divided period with distances of each level being kept uniform and they are applied to said $2^{m+1}$ power source lines simultaneously for the same divided periods, and a highest voltage for each divided period and a lowest voltage for the next divided period are set so as to have the same level.

42. An image display device comprising:

a plurality of picture elements arranged in a matrix pattern for displaying;

data signal lines connected to said picture elements; and a data signal line driving circuit having a voltage output circuit, the voltage output circuit including:

(a) a plurality of power source lines to which different voltages are applied per divided period obtained by dividing a horizontal scanning period into a plurality of periods, and (b) the same number of selecting output means as said data signal lines for selecting one of said power source lines for at least one of the divided periods based upon a video signal composed of a multi-bit digital signal so as to output a voltage, which is applied to the power source line selected for the divided period, to said data signal lines, the voltage output circuit comprising:

first decoding means for outputting $2^m$ decoded signals based upon m bits ($1<m<n$) from a n-bit digital signal; and second decoding means for outputting $2^k$ decoded signals based upon k bits ($k=n-m$) of the digital signal, wherein $2^m$ power source lines are provided for the digital signal, and said selecting output means includes:

period selecting means for selecting at least one divided period of the divided $2^k$ periods based upon the decoded signal from said second decoding means, output control means for outputting a control signal, which is effective in one of said power source lines only for the divided period selected by said period selecting means, based upon an output signal from said period selecting means and the decoded signal from said first decoding means, and output means which conducts due to the control signal from said output control means and outputs a voltage to be applied to the selected power source line.

43. The image display device according to claim 42, further comprising power source means for generating voltages to be applied to said power source lines.

44. The image display device according to claim 43, wherein said power source means alternately changes polarities of the voltages to be applied to said power source lines per horizontal scanning period.

45. The image display device according to claim 43, wherein said power source means alternately changes polarities of the voltages to be applied to said power source lines per vertical scanning period.

46. The image display device according to claim 42 wherein the digital signal is generated by using a pseudo gradation display method which utilizes a characteristic of human eyes.

47. The image display device according to claim 42 wherein switching elements composing said picture elements are polycrystal silicon thin film transistors.

48. The image display device according to claim 42 wherein said data signal line driving circuit is composed of a polycrystal silicon thin film transistor.

49. An image display device comprising:

a plurality of picture elements arranged in a matrix pattern for displaying;

data signal lines connected to said picture elements; and a data signal line driving circuit having a voltage output circuit, the voltage output circuit including:

(a) a plurality of power source lines to which different voltages are applied per divided period obtained by dividing a horizontal scanning period into a plurality of periods;

(b) the same number of selecting output means as said data signal lines for selecting two of said power source lines for at least one of the divided periods based upon a video signal composed of a multi-bit digital signal so as to output voltages, which is applied to the power source lines selected for the divided period, to said data signal lines; and (c) the same number of medial value generating means as said data signal lines for generating a plurality of medial voltages between two voltages selected by said selecting output means.

50. The image display device according to claim 49, further comprising power source means for generating voltages to be applied to said power source lines.

51. The image display device according to claim 50, wherein said power source means alternately changes polarity of the voltage to be applied to said power source lines per horizontal scanning period.

52. The image display device according to claim 50, wherein said power source means alternately changes polarity of the voltages to be applied to said power source lines per vertical scanning period.

53. The image display device according to claim 49, wherein the digital signal is generated by using a pseudo gradation display method which utilizes a characteristic of human eyes.

54. The image display device according to claim 49, wherein switching elements composing said picture elements are polycrystal silicon thin film transistors.

55. The image display device according to claim 49, wherein said data signal line driving circuit is composed of a polycrystal silicon thin film transistor.

56. The image display device according to claim 49, wherein switching elements composing said picture elements are polycrystal silicon thin film transistors.

57. The image display device according to claim 49, wherein said data signal line driving circuit is composed of a polycrystal silicon thin film transistor.

58. A voltage output circuit comprising:

a plurality of power source lines to which different voltages are applied per divided period obtained by dividing a scanning period into plural periods, the voltages changing within prescribed different voltage ranges; and selecting output means for comparing a multi-bit reference signal with a multi-bit digital signal for determining the divided periods, and when both the signals coincide with each other, selecting one of said power source lines for the divided period determined by the coincident reference signal so as to output a voltage applied to the power source line selected for the divided period.

59. The voltage output circuit according to claim 58, wherein said selecting output means includes:

output control means for outputting a control signal which is effective only for the divided period determined by the reference signal when the reference signal coincides with the digital signal; and output means which conducts due to the control signal from said output control means and outputs the voltage to be applied to the selected power source line.

60. The voltage output circuit according to claim 59, wherein said output control means includes:

an equality comparator for comparing the reference signal with the digital signal excluding at least most significant bit per bit; and a plurality of AND circuits for obtaining ANDs of an equality signal, which is outputted from said equality comparator when the reference signal coincides with the digital signal, and the most significant bit or multi-bits from the most significant bit side so as to output the control signal.

61. The voltage output circuit according to claim 59, wherein said output means includes the same number of transistors as said power source lines respectively connected to said power source lines.

62. The voltage output circuit according to claim 59, further comprising a counter for generating the reference signal.

63. The voltage output circuit according to claim 58, wherein the voltage ranges are continued among said power source lines.

64. The voltage output circuit according to claim 63, wherein the voltage ranges are divided approximately uniformly per power source line.

65. An image display device comprising:

a plurality of picture elements arranged in a matrix pattern for displaying, said picture elements have display medium;

data signal lines connected to said picture elements; and a data signal line driving circuit having a voltage output circuit, the voltage output circuit including:

(a) a plurality of power source lines to which different voltages are applied per divided period obtained by dividing a horizontal scanning period into plural periods, the voltages changing within different voltage ranges of off-level to on-level of the display medium; and (b) the same number of selecting output means as said data signal lines for comparing a multi-bit reference signal with a video signal composed of a multi-bit digital signal for determining the divided periods, and when both the signals coincide with each other, selecting one of said power source lines for the divided period determined by the coincident reference signal so as to output a voltage applied to the power source line selected for the divided period.

66. The image display device according to claim 65, wherein said selecting output means includes:

output control means for outputting a control signal which is effective only for the divided period determined by the reference signal when the reference signal coincides with the digital signal; and output means which conducts due to the control signal from said output control means and outputs the voltage to be applied to the selected power source line.

67. The image display device according to claim 66, wherein said output means includes the same number of transistors as said power source lines for outputting the voltage from said power source line to the common data signal line.

68. The image display device according to claim 67, wherein said selecting output means further includes:

a capacitor which is connected in series to the control terminal of the transistor to which the control signal is inputted; and a resistor connected across input terminals of the transistors connected to said power source lines and the control terminals.

69. The image display device according to claim 65, wherein said data signal line driving circuit is composed of first and second driving sections having one power source line respectively, and the first and second driving sections, from which said data signal lines are taken out, are arranged on both sides of the display section including said picture elements, and a first power source voltage and a second power source voltage which is higher than the first power source voltage are applied to the first driving section, while the first power source voltage and a third power source voltage which is lower than the first power source voltage are applied to the second driving section.

70. The image display device according to claim 65, wherein said data signal line driving circuit is formed as an integrated circuit chip so as to be mounted to a prescribed mounting area on a substrate where said picture elements are formed, and said data signal line driving circuit has a first output terminals and second output terminals for outputting the voltages to said data signal lines, the first output terminals being arranged in a side edge which is close to said picture elements at a prescribed pitch, the second output terminals being arranged in a side edge which is farther from said picture elements at the above pitch so as to be displaced from the first output terminals by ½ pitch, wherein said first output terminals are connected to end sections of said data signal lines arranged on the picture element side, and the second output terminals are connected to end sections of said data signal lines through bypass wiring formed on an electrically conductive layer which is different from an electrically conductive layer, on which the data signal lines are formed, on a substrate.

71. The image display device according to claim 70, further comprising:

first switching elements respectively connected between one output terminal of said data signal line driving circuit and one data signal line in a series; and second switching elements respectively connected between the output terminal and a data signal line which is adjacent to and pairs with the above data signal line in a series, wherein said first switching elements and second switching elements conduct compensatingly per ½ period in the horizontal scanning period.

72. The image display device according to claim 71, wherein said first and second switching elements are composed of complementary metal oxide semiconductor whose conduction is controlled by a common control signal.

73. The image display device according to claim 65, wherein the display medium is liquid crystal.

74. An image display device comprising:

a plurality of picture element electrodes arranged in a matrix pattern;

common electrodes arranged so as to respectively face said picture element electrodes through the display medium;

data signal lines connected to said picture element electrodes;

a data signal line driving circuit having a voltage output circuit, the voltage output circuit including:

(a) power source lines to which a voltage, which is changed N times for horizontal scanning period within a voltage range where the voltage becomes 1/N of a maximum voltage required for driving the display medium, are applied; and (b) the same number of selecting output means as said data signal lines for comparing a multi-bit reference signal with a video signal composed of a multi-bit digital signal for determining the divided periods, and when both the signals coincide with each other, outputting a voltage applied to the power source line for the divided period determined by the coincident reference signal; and common electric potential generating means for giving N-numbered common electric potentials, which are different from each other by a level equal to the voltage range, to said common electrode one by one per different period in the horizontal scanning period in synchronization with the changing of the voltage.

75. The image display device according to claim 74, wherein said selecting output means includes:

output control means for outputting a control signal which is effective only for the divided period determined by the reference signal when the reference signal coincide with the digital signal; and output means which conducts due to the control signal from said output control means and outputs the voltage to be applied to the selected power source line.

76. The image display device according to claim 75, wherein said output means includes transistors for outputting the voltage from the power source line to said data signal lines.

77. The image display device according to claim 76, wherein said common electric potential generating means includes:

a counter for outputting a multi-bit code signal based upon a clock;

a decoder for decoding the code signal so as to output a selecting signal which is effective for each different period;

analog switches for selecting one of plural reference potentials which becomes a reference of the common electric potential based upon the selecting signal; and a buffer for buffering and amplifying the selected reference voltage so as to generate the common electric potential.

78. The image display device according to claim 75, further comprising:

power source means for generating voltages to be applied to the power source lines and for inverting polarity of the voltages per horizontal scanning period, wherein said output means includes:

a p-channel type transistor and an n-channel type transistor for outputting the voltages from the power source lines to the common data signal line, said p-channel and n-channel type transistors are connected to each other in parallel; and an inverter for inverting the control signal which is applied one of the p-channel type transistor and the n-channel type transistor so that both the p-channel and n-channel type transistors conduct in response to the control signal.

79. The image display device according to claim 74, wherein said common electric potential generating means inverts the polarity of the common electric potential so that it is opposite to the polarity of the voltage.

80. The image display device according to claim 79, wherein said common electric potential generating means includes:

a counter for outputting a multi-bit code signal based upon a clock;

a decoder for decoding the code signals so as to output selecting signals which are effective for different periods respectively;

analog switches for selecting one of reference voltages, which becomes a reference of the common electric potential, based upon the selecting signal, the reference voltages forming plural pairs of the two reference electric potentials whose absolute values are the same and polarities are different; and a buffer for buffering and amplifying the selected reference voltage so as to generate the common electric potential.

81. The image display device according to claim 74, further comprising power source means for generating voltages to be applied to said power source lines, and varying a rate of change of the voltage for the horizontal scanning period.

82. The image display device according to claim 81, wherein said power source means includes:

a clock generating circuit for generating a clock whose period changes for a horizontal scanning period;

a counter for outputting a multi-bit dividing signal based upon the clock; and a digital/analog converter for converting the dividing signal into an analog signal.

83. The image display device according to claim 74 wherein the display medium is liquid crystal.

* * * * *